US006306034B1

(12) United States Patent
Sakamoto et al.

(10) Patent No.: US 6,306,034 B1
(45) **Date of Patent: *Oct. 23, 2001**

(54) GAME MACHINE INFORMING PRIZE MODE INFORMATION IN A SERIES OF FLOW OF GAME

(75) Inventors: Yoshikazu Sakamoto; Hiroshi Yoshida, both of Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/206,382

(22) Filed: Dec. 7, 1998

(30) Foreign Application Priority Data

Dec. 5, 1997 (JP) ..... 9-352171
Aug. 28, 1998 (JP) ..... 10-243695

(51) Int. Cl.[7] ..... A63F 9/24
(52) U.S. Cl. ..... 463/20; 273/143 R
(58) Field of Search ..... 463/20, 16; 273/143 R, 273/138.1, 138.2

(56) References Cited

U.S. PATENT DOCUMENTS

| | | | | |
|---|---|---|---|---|
| 4,618,150 | | 10/1986 | Kimura . | |
| 4,624,459 | | 11/1986 | Kaufman . | |
| 4,993,713 | * | 2/1991 | Harada | 273/138 A |
| 5,024,439 | * | 6/1991 | Okada | 273/143 R |
| 5,400,301 | * | 3/1995 | Rackley | 368/72 |
| 5,603,659 | * | 2/1997 | Okada | 463/25 |
| 5,667,219 | * | 9/1997 | Ishibashi | 273/143 R |
| 5,695,188 | * | 12/1997 | Ishibashi | 273/143 R |
| 5,713,572 | | 2/1998 | Hagiwara . | |
| 5,722,891 | * | 3/1998 | Inoue | 463/20 |
| 5,803,451 | | 9/1998 | Kelly et al. . | |
| 5,954,422 | * | 9/1999 | Marchini et al. | 362/227 |
| 6,106,393 | * | 8/2000 | Sunaga et al. | 463/20 |
| 6,174,223 | * | 1/2001 | Sunaga et al. | 463/20 |
| B1 6,077,163 | * | 6/2000 | Walker et al. | 463/26 |

FOREIGN PATENT DOCUMENTS

| | | |
|---|---|---|
| 38 30 648 | 3/1990 | (DE) . |
| 19542625A | 2/1997 | (DE) . |
| 0 391 667 | 10/1990 | (EP) . |
| 0 414 427 | 2/1991 | (EP) . |
| 0414427A | 2/1991 | (EP) . |
| 0443738A | 8/1991 | (EP) . |
| 0 720 129 | 7/1996 | (EP) . |
| 0720129A | 7/1996 | (EP) . |
| 0 875 870 | 11/1998 | (EP) . |
| 0918307A | 5/1999 | (EP) . |
| 0875870A | 6/2000 | (EP) . |
| 2 057 738 | 4/1981 | (GB) . |
| 2 117 155 | 10/1983 | (GB) . |
| 2 147 442 | 5/1985 | (GB) . |
| 2 326 260 | 12/1998 | (GB) . |
| 62-127086 | 6/1987 | (JP) . |
| 9-271559 | 10/1997 | (JP) . |
| 9-309735 | 10/1997 | (JP) . |
| 10-33750 | 2/1998 | (JP) . |
| 10-272230 | 10/1998 | (JP) . |
| 10-305128 | 11/1998 | (JP) . |

* cited by examiner

*Primary Examiner*—Valencia Martin-Wallce
*Assistant Examiner*—Julie Kasick
(74) *Attorney, Agent, or Firm*—Pillsbury Winthrop LLP

(57) ABSTRACT

A game machine informs the player about the prize mode using combinations of the individual stagings by the sound emitting means, the connective staging means and the stop staging means. When rotations of individual reels 3 to 5 are started by operating a start lever 15, a game starting sound 1 or 2 according to a hit flag is generated by sound emitting means. In connection with the stopping of the individual reels 3 to 5 according to the individual operations of individual stop buttons 16 to 18, individual back lamps 57*a* to 57*c* are then sequentially staged by connective staging means in the connective display mode according to the hit flag. When all the individual reels 3 to 5 are stopped, the individual back lamps 57*a* to 57*c* are then staged by stop staging means in accordance with the hit flag.

24 Claims, 91 Drawing Sheets

— Prior Art —

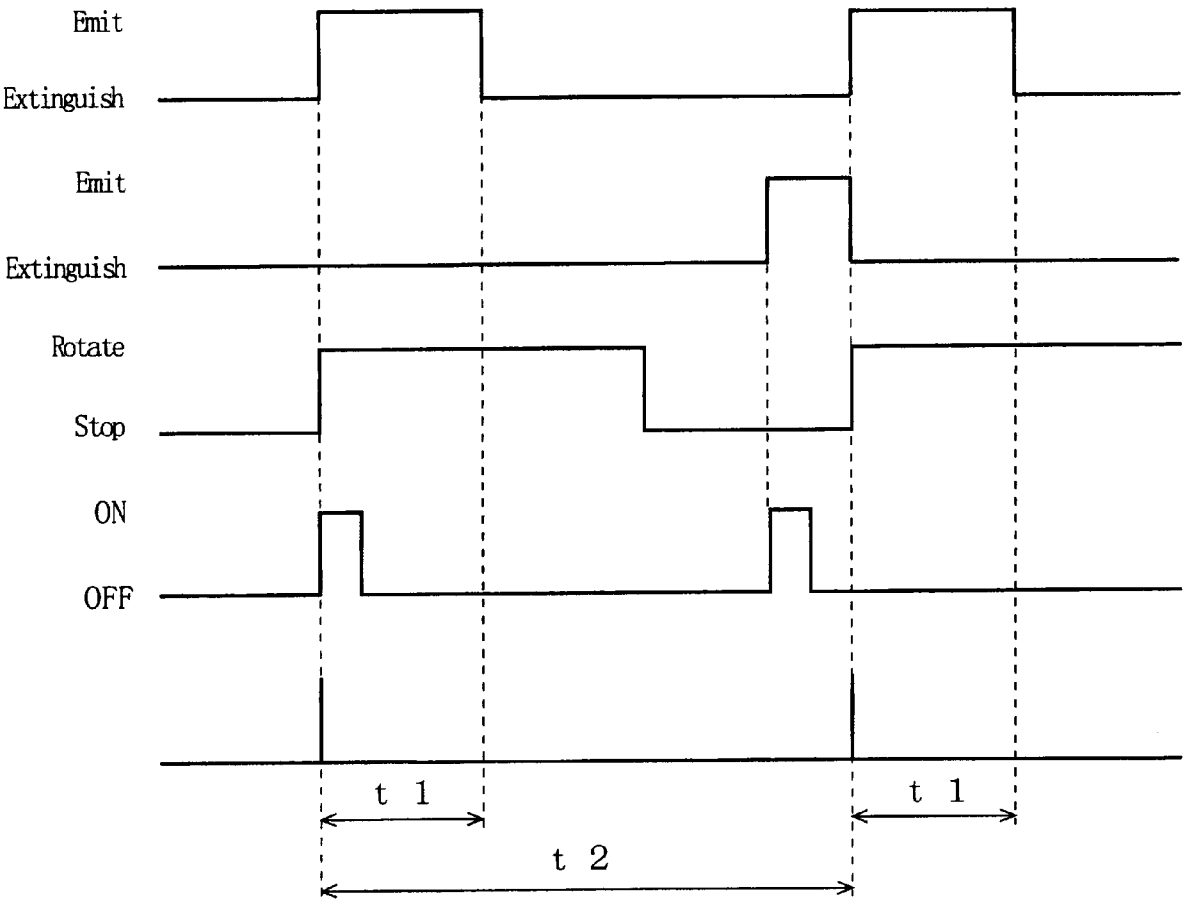
Fig. 7A Game starting sounds 1 & 2
Fig. 7B Reel rotation inhibit sound
Fig. 7C Final stop reel
Fig. 7D Start lever
Fig. 7E Lottery timing

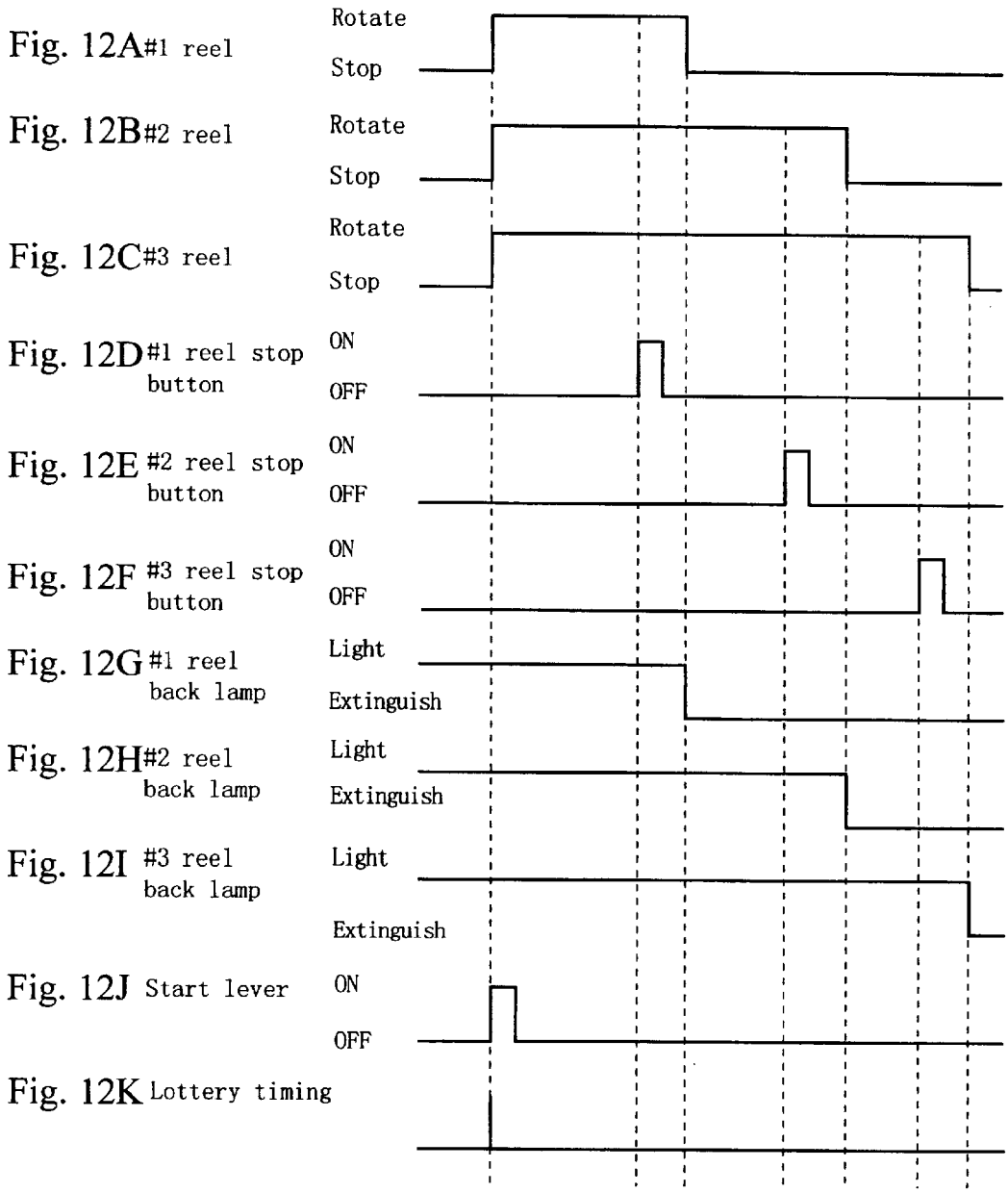
Fig. 12A #1 reel
Rotate
Stop
Fig. 12B #2 reel
Rotate
Stop
Fig. 12C #3 reel
Rotate
Stop
Fig. 12D #1 reel stop button
ON
OFF
Fig. 12E #2 reel stop button
ON
OFF
Fig. 12F #3 reel stop button
ON
OFF
Fig. 12G #1 reel back lamp
Light
Extinguish
Fig. 12H #2 reel back lamp
Light
Extinguish
Fig. 12I #3 reel back lamp
Light
Extinguish
Fig. 12J Start lever
ON
OFF
Fig. 12K Lottery timing all lighted extinguished extinguished extinguished all lighted

Fig. 17

| Hit / No. of coins | Big | Medium | Small | | | | |
|---|---|---|---|---|---|---|---|
| | BB | RB | Water melon | Bell | 4 Cherry | 2 Cherry | Replay |
| 1 | a 1 | b 1 | c 1 | d 1 | e 1 | f 1 | g 1 |
| 2 | a 2 | b 2 | c 2 | d 2 | e 2 | f 2 | g 2 |
| 3 | a 3 | b 3 | c 3 | d 3 | e 3 | f 3 | g 3 |

Fig. 18

| Code No. | #1 reel | #2 reel | #3 reel |
|---|---|---|---|
| 0 | A | E | B |
| 1 | G | C | H |
| 2 | F | D | F |
| 3 | C | G | E |
| 4 | F | D | F |
| 5 | A | A | A |
| 6 | D | E | E |
| 7 | C | G | F |
| 8 | G | D | D |
| 9 | F | E | F |
| 10 | C | B | H |
| 11 | F | D | B |
| 12 | A | E | F |
| 13 | E | D | E |
| 14 | C | A | F |
| 15 | F | E | H |
| 16 | B | G | C |
| 17 | F | D | F |
| 18 | C | B | D |
| 19 | E | F | E |
| 20 | F | D | F |

Fig. 19

| Combination | Game starting sound | Interlocking display mode | Stop display mode | Hit informing flag |
|---|---|---|---|---|
| ① | 1 | No reel lamp extinguishment | No reel lamp flash | Blank |
| ② | 1 | Reel lamp extinguishing pattern 1 | Reel lamp flash A | Replay |
| ③ | 1 | Reel lamp extinguishing pattern 2 | Reel lamp flash B | 2 Cherry |
| ④ | 1 | Reel lamp extinguishing pattern 3 | Reel lamp flash C | 4 Cherry |
| ⑤ | 2 | No reel lamp extinguishment | No reel lamp flash | Bell |
| ⑥ | 2 | Reel lamp extinguishing pattern 1 | Reel lamp flash A | Watermelon |
| ⑦ | 2 | Reel lamp extinguishing pattern 2 | Reel lamp flash B | RB |
| ⑧ | 2 | Reel lamp extinguishing pattern 3 | Reel lamp flash C | BB |

Fig. 20A

| | Sounding Frequency of general game | Sounding frequency of bonus flag |
|---|---|---|
| Game starting sound 1 | High | Low |
| Game starting sound 2 | Low | High |

Fig. 20B

| | Appearing frequency of general game | Appearing frequency of bonus flag |
|---|---|---|
| No reel lamp extinguishment | High | Low |
| Reel lamp extinguishing pattern 1 | ↓ | ↓ |
| Reel lamp extinguishing pattern 2 | ↓ | ↓ |
| Reel lamp extinguishing pattern 3 | Low | High |

Fig. 20C

| | Appearing frequency of general game | Appearing frequency of bonus flag |
|---|---|---|
| No reel lamp flash | High | Low |
| Reel lamp flash A | ↓ | ↓ |
| Reel lamp flash B | ↓ | ↓ |
| Reel lamp flash C | Low | High |

| Hit flag | BB | RB | Water melon | Bell | 4 Cherry | 2 Cherry | Replay | Blank |
|---|---|---|---|---|---|---|---|---|
| Hit section Data | 0~200 (a3=201) | 201~380 (b3=381) | 381~800 (c3=801) | 801~1900 (d3=1901) | 1901~4000 (e3=4001) | 4001~10000 (f3=10001) | 10001~18000 (g3=18001) | 18001~65535 |
| Inform section Data | 0~150 20000~20200 | 201~340 20201~20380 | 381~770 20381~20800 | 801~1800 20801~21900 | 1901~3500 21901~24000 | 4001~9000 24001~30000 | 10001~17500 30001~38000 | 38001~65535 |

Fig. 21

Fig. 22

| Hit flag | Blank | JAC hit | | | | | | |
|---|---|---|---|---|---|---|---|---|
| in RB operation | P11 | 0 | | | | | | |
| Hit flag | Blank | 2 Cherry | 4 Cherry | Bell | Water melon | RB hit | | |
| General game in BB operation | P12 | P21 | P31 | P41 | P51 | P61 | | |
| Hit flag | Blank | 2 Cherry | 4 Cherry | Bell | Water melon | Replay | RB | BB |
| General game | P13 | P22 | P32 | P42 | P52 | P62 | P71 | P81 |
| Hit flag | Blank | 2 Cherry | 4 Cherry | Bell | Water melon | Replay | | |
| General game in inner hit of RB | P14 | P23 | P33 | P43 | P53 | P63 | | |
| Hit flag | Blank | 2 Cherry | 4 Cherry | Bell | Water melon | Replay | | |
| General game in inner hit of BB | P15 | P24 | P34 | P44 | P54 | P64 | | |

Fig. 26A

| #1 reel | #2 reel | #3 reel |
|---|---|---|
| F | ↓ | ↓ |
| A | ↓ | ↓ |
| E | ↓ | ↓ |

Fig. 26B

| #1 reel | #2 reel | #3 reel |
|---|---|---|
| F | D | ↓ |
| A | A | ↓ |
| E | E | ↓ |

Fig. 26C

| | #1 reel | #2 reel | #3 reel |
|---|---|---|---|
| Prize line L 1 | A | A | ↓ |
| 〃 L 2 A | F | D | ↓ |
| 〃 L 2 B | E | E | ↓ |
| 〃 L 3 A | F | A | ↓ |
| 〃 L 3 B | E | A | ↓ |

Fig. 27

| Code No. | Hit prediction flag | | | |
|---|---|---|---|---|
| | Big hit | Medium hit | Small hit | No prize |
| 0 | 0 | 0 | 0 | 1 |
| 1 | 0 | 1 | 0 | 0 |
| 2 | 0 | 1 | 0 | 0 |
| 3 | 0 | 0 | 0 | 1 |
| 4 | 0 | 0 | 0 | 1 |
| 5 | 1 | 0 | 1 | 0 |
| ⋮ | ⋮ | ⋮ | ⋮ | ⋮ |
| 20 | 0 | 0 | 0 | 1 |

Fig. 28A

| | Blank | Small lottery | BB & RB flags |
|---|---|---|---|
| Appearing frequency | High | High | Low |

Fig. 28B

| | Blank | Small lottery | BB & RB flags |
|---|---|---|---|
| Appearing frequency | Low | Low | High |

Fig. 31
| | Light reel lamp | Extinguish reel lamp |
|---|---|---|
| #1 stop | Reel stop sound 1 (327.60 [ms] ) | Reel stop sound 2 (393.12 [ms] ) |
| #2 stop | Reel stop sound 1 (327.60 [ms] ) | Reel stop sound 3 (499.59 [ms] ) |
| #3 stop | Reel stop sound 1 (327.60 [ms] ) | Reel stop sound 4 (589.68 [ms] ) |
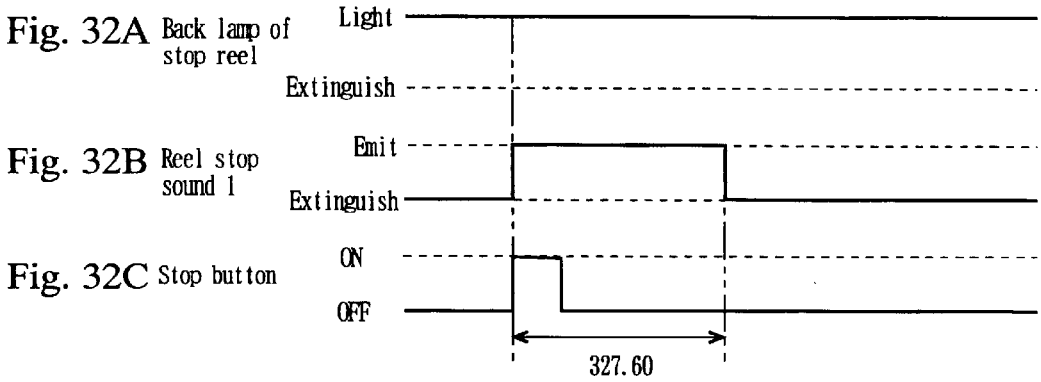
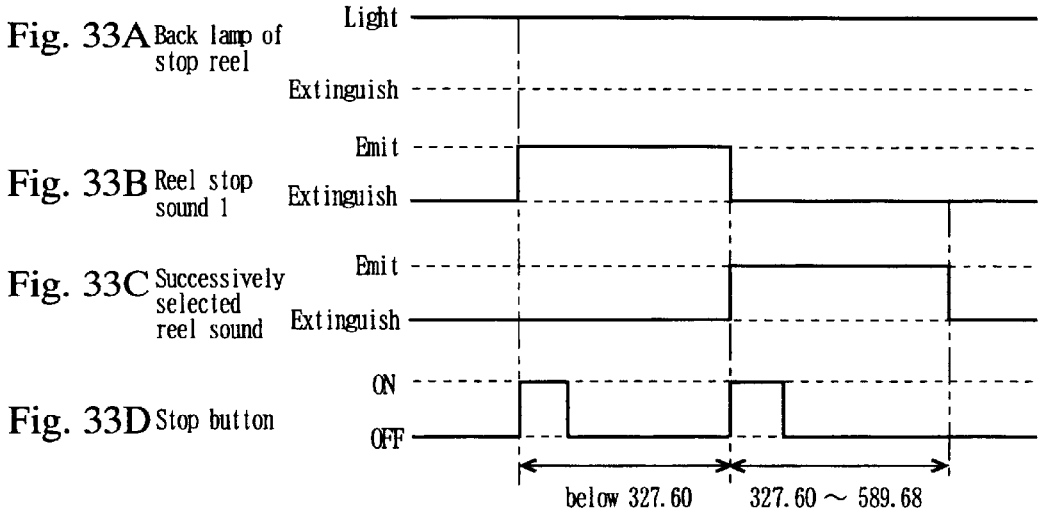

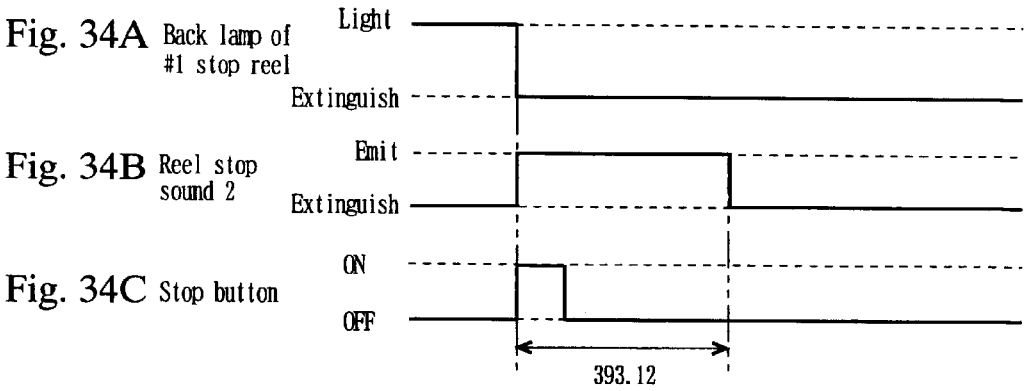
Fig. 34A Back lamp of #1 stop reel
Light
Extinguish
Fig. 34B Reel stop sound 2
Emit
Extinguish
Fig. 34C Stop button
ON
OFF
393.12

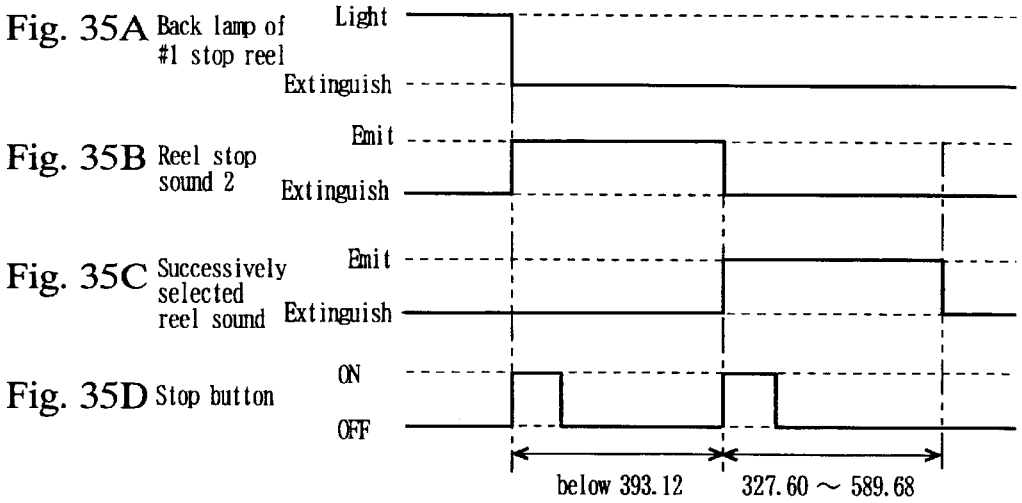
Fig. 35A Back lamp of #1 stop reel
Light
Extinguish
Fig. 35B Reel stop sound 2
Emit
Extinguish
Fig. 35C Successively selected reel sound
Emit
Extinguish
Fig. 35D Stop button
ON
OFF
below 393.12
327.60 ~ 589.68

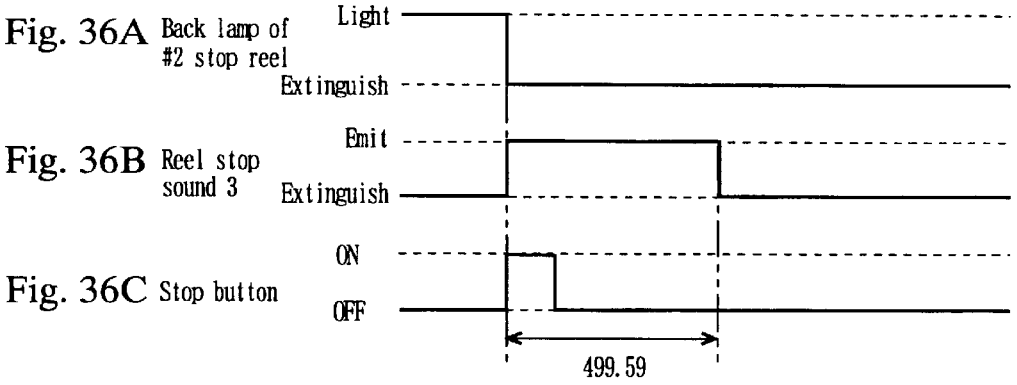
Fig. 36A Back lamp of #2 stop reel
Light
Extinguish
Fig. 36B Reel stop sound 3
Emit
Extinguish
Fig. 36C Stop button
ON
OFF
499.59

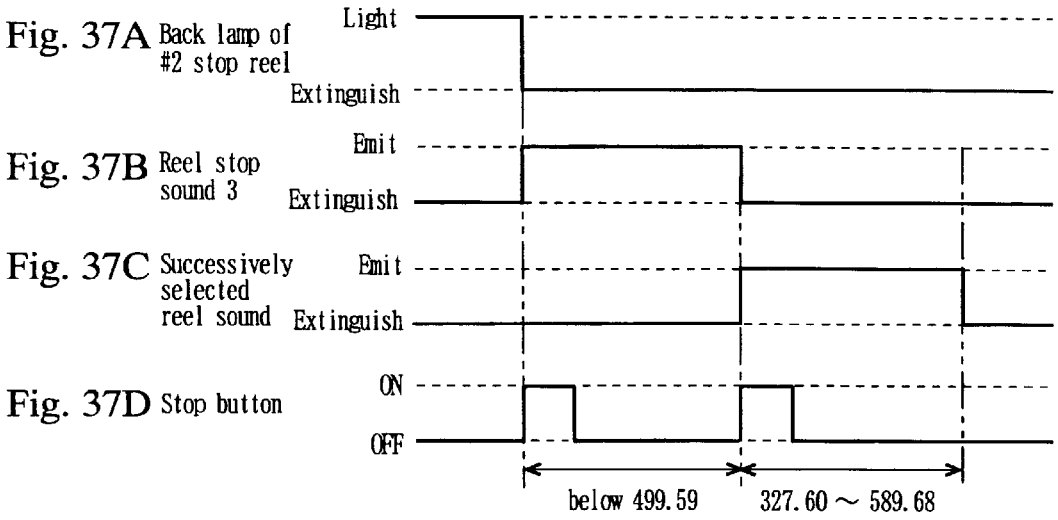
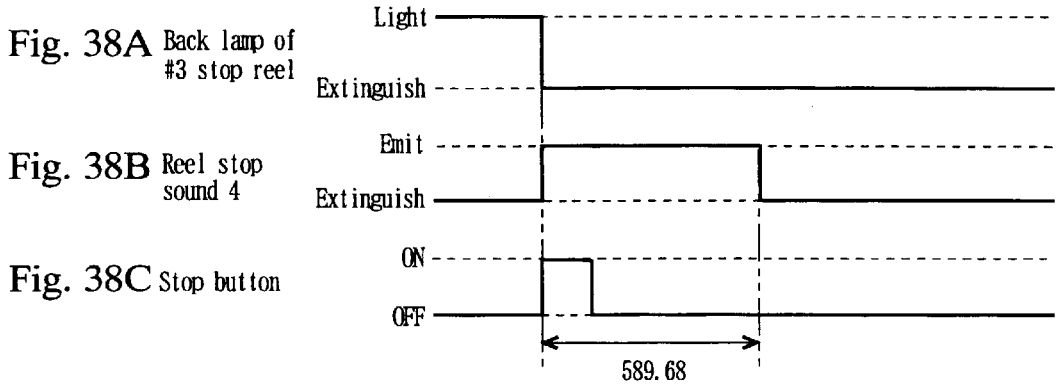
Fig. 39
| | Light reel lamp | Extinguish reel lamp |
|---|---|---|
| #1 stop | Reel stop sound 1 (do) | Reel stop sound 2 (re) |
| #2 stop | Reel stop sound 1 (do) | Reel stop sound 3 (mi) |
| #3 stop | Reel stop sound 1 (do) | Reel stop sound 4 (fa) |

Fig. 40

| Step | Flash pattern | Step | Flash pattern |
|---|---|---|---|
| 1 | (1) (2) (3)<br>(4) (5) (6)<br>(7) (8) (9) | 3 | (1) (2) (3)<br>(4) (5) (6)<br>(7) (8) (9) |
| 2 | (1) (2) (3)<br>(4) (5) (6)<br>(7) (8) (9) | 4 | (1) (2) (3)<br>(4) (5) (6)<br>(7) (8) (9) |

Fig. 41

| Step | Flash pattern | Step | Flash pattern |
|---|---|---|---|
| 1 | (1) (2) (3)<br>(4) (5) (6)<br>(7) (8) (9) | 4 | (1) (2) (3)<br>(4) (5) (6)<br>(7) (8) (9) |
| 2 | (1) (2) (3)<br>(4) (5) (6)<br>(7) (8) (9) | 5 | (1) (2) (3)<br>(4) (5) (6)<br>(7) (8) (9) |
| 3 | (1) (2) (3)<br>(4) (5) (6)<br>(7) (8) (9) | 6 | (1) (2) (3)<br>(4) (5) (6)<br>(7) (8) (9) |

Fig. 42

| Step | Flash pattern | Step | Flash pattern |
|---|---|---|---|
| 1 | (1) (2) (3)<br>(4) (5) (6)<br>(7) (8) (9) | 4 | (1) (2) (3)<br>(4) (5) (6)<br>(7) (8) (9) |
| 2 | (1) (2) (3)<br>(4) (5) (6)<br>(7) (8) (9) | 5 | (1) (2) (3)<br>(4) (5) (6)<br>(7) (8) (9) |
| 3 | (1) (2) (3)<br>(4) (5) (6)<br>(7) (8) (9) | 6 | (1) (2) (3)<br>(4) (5) (6)<br>(7) (8) (9) |

Fig. 43

| Step | Flash pattern | Step | Flash pattern |
|---|---|---|---|
| 1 | (1) (2) (3)<br>(4) (5) (6)<br>(7) (8) (9) | 3 | (1) (2) (3)<br>(4) (5) (6)<br>(7) (8) (9) |
| 2 | (1) (2) (3)<br>(4) (5) (6)<br>(7) (8) (9) | 4 | (1) (2) (3)<br>(4) (5) (6)<br>(7) (8) (9) |

Fig. 44

| Step | Flash pattern | Step | Flash pattern |
|---|---|---|---|
| 5 | (1) (2) (3)<br>(4) (5) (6)<br>(7) (8) (9) | 10 | (1) (2) (3)<br>(4) (5) (6)<br>(7) (8) (9) |
| 6 | (1) (2) (3)<br>(4) (5) (6)<br>(7) (8) (9) | 11 | (1) (2) (3)<br>(4) (5) (6)<br>(7) (8) (9) |
| 7 | (1) (2) (3)<br>(4) (5) (6)<br>(7) (8) (9) | 12 | (1) (2) (3)<br>(4) (5) (6)<br>(7) (8) (9) |
| 8 | (1) (2) (3)<br>(4) (5) (6)<br>(7) (8) (9) | 13 | (1) (2) (3)<br>(4) (5) (6)<br>(7) (8) (9) |
| 9 | (1) (2) (3)<br>(4) (5) (6)<br>(7) (8) (9) | | |

Fig. 45

| Step | Flash pattern | Step | Flash pattern |
|---|---|---|---|
| 1 | (1) (2) (3)<br>(4) (5) (6)<br>(7) (8) (9) | 7 | (1) (2) (3)<br>(4) (5) (6)<br>(7) (8) (9) |
| 2 | (1) (2) (3)<br>(4) (5) (6)<br>(7) (8) (9) | 8 | (1) (2) (3)<br>(4) (5) (6)<br>(7) (8) (9) |
| 3 | (1) (2) (3)<br>(4) (5) (6)<br>(7) (8) (9) | 9 | (1) (2) (3)<br>(4) (5) (6)<br>(7) (8) (9) |
| 4 | (1) (2) (3)<br>(4) (5) (6)<br>(7) (8) (9) | 10 | (1) (2) (3)<br>(4) (5) (6)<br>(7) (8) (9) |
| 5 | (1) (2) (3)<br>(4) (5) (6)<br>(7) (8) (9) | 11 | (1) (2) (3)<br>(4) (5) (6)<br>(7) (8) (9) |
| 6 | (1) (2) (3)<br>(4) (5) (6)<br>(7) (8) (9) | | |

Fig. 46

| Step | Flash pattern | Step | Flash pattern |
|---|---|---|---|
| 1 | (1) (2) (3)<br>(4) (5) (6)<br>(7) (8) (9) | 4 | (1) (2) (3)<br>(4) (5) (6)<br>(7) (8) (9) |
| 2 | (1) (2) (3)<br>(4) (5) (6)<br>(7) (8) (9) | 5 | (1) (2) (3)<br>(4) (5) (6)<br>(7) (8) (9) |
| 3 | (1) (2) (3)<br>(4) (5) (6)<br>(7) (8) (9) | 6 | (1) (2) (3)<br>(4) (5) (6)<br>(7) (8) (9) |

Fig. 47

| Step | Flash pattern | Step | Flash pattern |
|---|---|---|---|
| 1 | (1) (2) (3)<br>(4) (5) (6)<br>(7) (8) (9) | 3 | (1) (2) (3)<br>(4) (5) (6)<br>(7) (8) (9) |
| 2 | (1) (2) (3)<br>(4) (5) (6)<br>(7) (8) (9) | 4 | (1) (2) (3)<br>(4) (5) (6)<br>(7) (8) (9) |

Fig. 48

| Step | Flash pattern | Step | Flash pattern |
|---|---|---|---|
| 5 | (1) (2) (3)<br>(4) (5) (6)<br>(7) (8) (9) | 11 | (1) (2) (3)<br>(4) (5) (6)<br>(7) (8) (9) |
| 6 | (1) (2) (3)<br>(4) (5) (6)<br>(7) (8) (9) | 12 | (1) (2) (3)<br>(4) (5) (6)<br>(7) (8) (9) |
| 7 | (1) (2) (3)<br>(4) (5) (6)<br>(7) (8) (9) | 13 | (1) (2) (3)<br>(4) (5) (6)<br>(7) (8) (9) |
| 8 | (1) (2) (3)<br>(4) (5) (6)<br>(7) (8) (9) | 14 | (1) (2) (3)<br>(4) (5) (6)<br>(7) (8) (9) |
| 9 | (1) (2) (3)<br>(4) (5) (6)<br>(7) (8) (9) | 15 | (1) (2) (3)<br>(4) (5) (6)<br>(7) (8) (9) |
| 10 | (1) (2) (3)<br>(4) (5) (6)<br>(7) (8) (9) | 16 | (1) (2) (3)<br>(4) (5) (6)<br>(7) (8) (9) |

Fig. 49

| Step | Flash pattern | Step | Flash pattern |
|---|---|---|---|
| 17 | (1) (2) (3)<br>(4) (5) (6)<br>(7) (8) (9) | 20 | (1) (2) (3)<br>(4) (5) (6)<br>(7) (8) (9) |
| 18 | (1) (2) (3)<br>(4) (5) (6)<br>(7) (8) (9) | 21 | (1) (2) (3)<br>(4) (5) (6)<br>(7) (8) (9) |
| 19 | (1) (2) (3)<br>(4) (5) (6)<br>(7) (8) (9) | | |

Fig. 50

| Step | Flash pattern | Step | Flash pattern |
|---|---|---|---|
| 1 | (1) (2) (3)<br>(4) (5) (6)<br>(7) (8) (9) | 7 | (1) (2) (3)<br>(4) (5) (6)<br>(7) (8) (9) |
| 2 | (1) (2) (3)<br>(4) (5) (6)<br>(7) (8) (9) | 8 | (1) (2) (3)<br>(4) (5) (6)<br>(7) (8) (9) |
| 3 | (1) (2) (3)<br>(4) (5) (6)<br>(7) (8) (9) | 9 | (1) (2) (3)<br>(4) (5) (6)<br>(7) (8) (9) |
| 4 | (1) (2) (3)<br>(4) (5) (6)<br>(7) (8) (9) | 10 | (1) (2) (3)<br>(4) (5) (6)<br>(7) (8) (9) |
| 5 | (1) (2) (3)<br>(4) (5) (6)<br>(7) (8) (9) | 11 | (1) (2) (3)<br>(4) (5) (6)<br>(7) (8) (9) |
| 6 | (1) (2) (3)<br>(4) (5) (6)<br>(7) (8) (9) | 12 | (1) (2) (3)<br>(4) (5) (6)<br>(7) (8) (9) |

Fig. 51

| Step | Flash pattern | Step | Flash pattern |
|---|---|---|---|
| 1 | (1) (2) (3)<br>(4) (5) (6)<br>(7) (8) (9) | 7 | (1) (2) (3)<br>(4) (5) (6)<br>(7) (8) (9) |
| 2 | (1) (2) (3)<br>(4) (5) (6)<br>(7) (8) (9) | 8 | (1) (2) (3)<br>(4) (5) (6)<br>(7) (8) (9) |
| 3 | (1) (2) (3)<br>(4) (5) (6)<br>(7) (8) (9) | 9 | (1) (2) (3)<br>(4) (5) (6)<br>(7) (8) (9) |
| 4 | (1) (2) (3)<br>(4) (5) (6)<br>(7) (8) (9) | 10 | (1) (2) (3)<br>(4) (5) (6)<br>(7) (8) (9) |
| 5 | (1) (2) (3)<br>(4) (5) (6)<br>(7) (8) (9) | 11 | (1) (2) (3)<br>(4) (5) (6)<br>(7) (8) (9) |
| 6 | (1) (2) (3)<br>(4) (5) (6)<br>(7) (8) (9) | 12 | (1) (2) (3)<br>(4) (5) (6)<br>(7) (8) (9) |

Fig. 52

| Step | Flash pattern | Step | Flash pattern |
|---|---|---|---|
| 13 | (1) (2) (3)<br>(4) (5) (6)<br>(7) (8) (9) | 19 | (1) (2) (3)<br>(4) (5) (6)<br>(7) (8) (9) |
| 14 | (1) (2) (3)<br>(4) (5) (6)<br>(7) (8) (9) | 20 | (1) (2) (3)<br>(4) (5) (6)<br>(7) (8) (9) |
| 15 | (1) (2) (3)<br>(4) (5) (6)<br>(7) (8) (9) | 21 | (1) (2) (3)<br>(4) (5) (6)<br>(7) (8) (9) |
| 16 | (1) (2) (3)<br>(4) (5) (6)<br>(7) (8) (9) | 22 | (1) (2) (3)<br>(4) (5) (6)<br>(7) (8) (9) |
| 17 | (1) (2) (3)<br>(4) (5) (6)<br>(7) (8) (9) | 23 | (1) (2) (3)<br>(4) (5) (6)<br>(7) (8) (9) |
| 18 | (1) (2) (3)<br>(4) (5) (6)<br>(7) (8) (9) | 24 | (1) (2) (3)<br>(4) (5) (6)<br>(7) (8) (9) |

Fig. 53

| Step | Flash pattern | Step | Flash pattern |
|---|---|---|---|
| 25 | (1) (2) (3)<br>(4) (5) (6)<br>(7) (8) (9) | 27 | (1) (2) (3)<br>(4) (5) (6)<br>(7) (8) (9) |
| 26 | (1) (2) (3)<br>(4) (5) (6)<br>(7) (8) (9) | 28 | (1) (2) (3)<br>(4) (5) (6)<br>(7) (8) (9) |

Fig. 54

| GMLVSTS | FLGCTR | Table No. |
|---|---|---|
| in RB operation | Blank | 17 |
| | Hit | 17 |
| in BB operation | Blank | 17 |
| | 2 Cherry | 17 |
| | 4 Cherry | 17 |
| | Bell | 17 |
| | Watermelon | 17 |
| | Replay | 17 |
| in General game | Blank | 0 |
| | 2 Cherry | 1 |
| | 4 Cherry | 2 |
| | Bell | 3 |
| | Watermelon | 4 |
| | Replay | 5 |
| | RB | 6 |
| | BB | 7 |
| in inner hit of RB | Blank | 8 |
| | 2 Cherry | 9 |
| | 4 Cherry | 10 |
| | Bell | 11 |
| | Watermelon | 12 |
| | Replay | 13 |
| in inner hit of BB | Blank | 14 |
| | 2 Cherry | 9 |
| | 4 Cherry | 15 |
| | Bell | 11 |
| | Watermelon | 16 |
| | Replay | 13 |

Fig. 55

| Talbe No. | Lottery value | Game starting sound | Reel lamp extinguish | Reel lamp flash |
|---|---|---|---|---|
| No. 0 | 100 | 1 | No | No |
| | 9 | 1 | 1 | No |
| | 8 | 1 | 2 | No |
| | 3 | 1 | 3 | 4 |
| | 8 | 2 | 3 | 9 |
| No. 1 | 93 | 1 | No | No |
| | 26 | 1 | 2 | No |
| | 4 | 1 | 3 | 6 |
| | 5 | 2 | No | No |
| No. 2 | 3 | 1 | No | 1 |
| | 10 | 1 | No | 3 |
| | 5 | 1 | 1 | 2 |
| | 49 | 1 | 3 | 5 |
| | 30 | 1 | 3 | 7 |
| | 1 | 1 | 3 | 9 |
| | 30 | 2 | 3 | 4 |
| No. 3 | 70 | 1 | No | No |
| | 18 | 1 | No | 2 |
| | 30 | 1 | 1 | No |
| | 2 | 1 | 1 | 2 |
| | 8 | 1 | 2 | No |
| No. 4 | 60 | 1 | No | 3 |
| | 42 | 1 | 3 | 4 |
| | 14 | 1 | 3 | 6 |
| | 12 | 1 | 3 | 8 |
| No. 5 | 97 | 1 | No | 1 |
| | 18 | 1 | 1 | 1 |
| | 8 | 1 | 2 | 1 |
| | 3 | 1 | 3 | 6 |
| | 2 | 1 | 3 | 8 |
| No. 6 | 36 | 1 | No | No |
| | 26 | 1 | No | 3 |
| | 20 | 1 | 3 | 5 |
| | 10 | 1 | 3 | 7 |
| | 18 | 2 | No | No |
| | 7 | 2 | 3 | 5 |
| | 7 | 2 | 3 | 7 |
| | 4 | 2 | 3 | 9 |

Fig. 56

| | | | | |
|---|---|---|---|---|
| No. 7 | 55 | 1 | No | No |
| | 9 | 1 | 3 | 5 |
| | 12 | 1 | 3 | 7 |
| | 22 | 2 | No | No |
| | 6 | 2 | 3 | 5 |
| | 6 | 2 | 3 | 7 |
| | 18 | 2 | 3 | 9 |
| No. 8 | 77 | 1 | No | No |
| | 6 | 1 | 1 | 8 |
| | 16 | 1 | 3 | 6 |
| | 16 | 1 | 3 | 8 |
| | 10 | 2 | 3 | 6 |
| | 3 | 2 | 3 | 8 |
| No. 9 | 40 | 1 | No | No |
| | 20 | 1 | 1 | 1 |
| | 13 | 1 | 3 | 3 |
| | 36 | 2 | No | No |
| | 10 | 2 | 1 | 2 |
| | 9 | 2 | 3 | 6 |
| No. 10 | 10 | 1 | 3 | 4 |
| | 50 | 1 | 3 | 5 |
| | 68 | 2 | 2 | No |
| No. 11 | 38 | 1 | No | No |
| | 38 | 1 | No | 2 |
| | 24 | 1 | 1 | 2 |
| | 14 | 1 | 2 | 2 |
| | 7 | 2 | 3 | 6 |
| | 7 | 2 | 3 | 8 |
| No. 12 | 37 | 1 | No | No |
| | 35 | 1 | No | 3 |
| | 28 | 1 | 3 | 3 |
| | 4 | 1 | 3 | 4 |
| | 14 | 1 | 3 | 8 |
| | 10 | 2 | 3 | 5 |

Fig. 57

| | | | | |
|---|---|---|---|---|
| No. 13 | 50 | 1 | No | No |
| | 8 | 1 | 1 | 1 |
| | 18 | 1 | 2 | 1 |
| | 14 | 1 | 3 | 6 |
| | 12 | 1 | 3 | 8 |
| | 16 | 2 | No | 1 |
| | 10 | 2 | 3 | 8 |

| | | | | |
|---|---|---|---|---|
| No. 14 | 80 | 1 | No | No |
| | 7 | 1 | 1 | 6 |
| | 15 | 1 | 3 | 6 |
| | 17 | 1 | 3 | 8 |
| | 2 | 2 | 3 | 6 |
| | 7 | 2 | 3 | 8 |

| | | | | |
|---|---|---|---|---|
| No. 15 | 42 | 1 | 3 | 7 |
| | 38 | 1 | 3 | 9 |
| | 48 | 2 | 2 | No |

| | | | | |
|---|---|---|---|---|
| No. 16 | 30 | 1 | No | 3 |
| | 32 | 1 | 3 | 3 |
| | 16 | 1 | 3 | 6 |
| | 2 | 1 | 3 | 9 |
| | 38 | 2 | No | No |
| | 10 | 2 | 3 | 7 |

| | | | | |
|---|---|---|---|---|
| No. 17 | 128 | 1 | No | No |

Fig. 58A

| GMLVSTS | | |
|---|---|---|
| Content | | Data |
| bit 7 | Not used | Normally 0 |
| 6 | | |
| 5 | | |
| 4 | in inner hit of BB | 0:off 1:on |
| 3 | in inner hit of RB | 0:off 1:on |
| 2 | in general game | 0:off 1:on |
| 1 | in BB operation | 0:off 1:on |
| 0 | in RB operation | 0:off 1:on |

Fig. 58B

| FLGCTR | |
|---|---|
| Content | Data |
| in blank | 0 0 H |
| in hit of 2 cherry | 0 1 H |
| in hit of 4 cherry | 0 2 H |
| in hit of bell | 0 3 H |
| in hit of watermelon | 0 4 H |
| in hit of replay | 0 5 H |
| in hit of RB | 0 6 H |
| in hit of BB | 0 7 H |

Fig. 59

| Fixed pattern | Game starting sound | Reel lamp extinguish | Reel lamp flash |
|---|---|---|---|
| 1 | 1 | 1 | 6 |
| 2 | 1 | 1 | 8 |
| 3 | 1 | 2 | 2 |
| 4 | 1 | 3 | 3 |
| 5 | 2 | No | 1 |
| 6 | 2 | 1 | 2 |
| 7 | 2 | 2 | No |
| 8 | 2 | 3 | 5 |
| 9 | 2 | 3 | 6 |
| 10 | 2 | 3 | 7 |
| 11 | 2 | 3 | 8 |

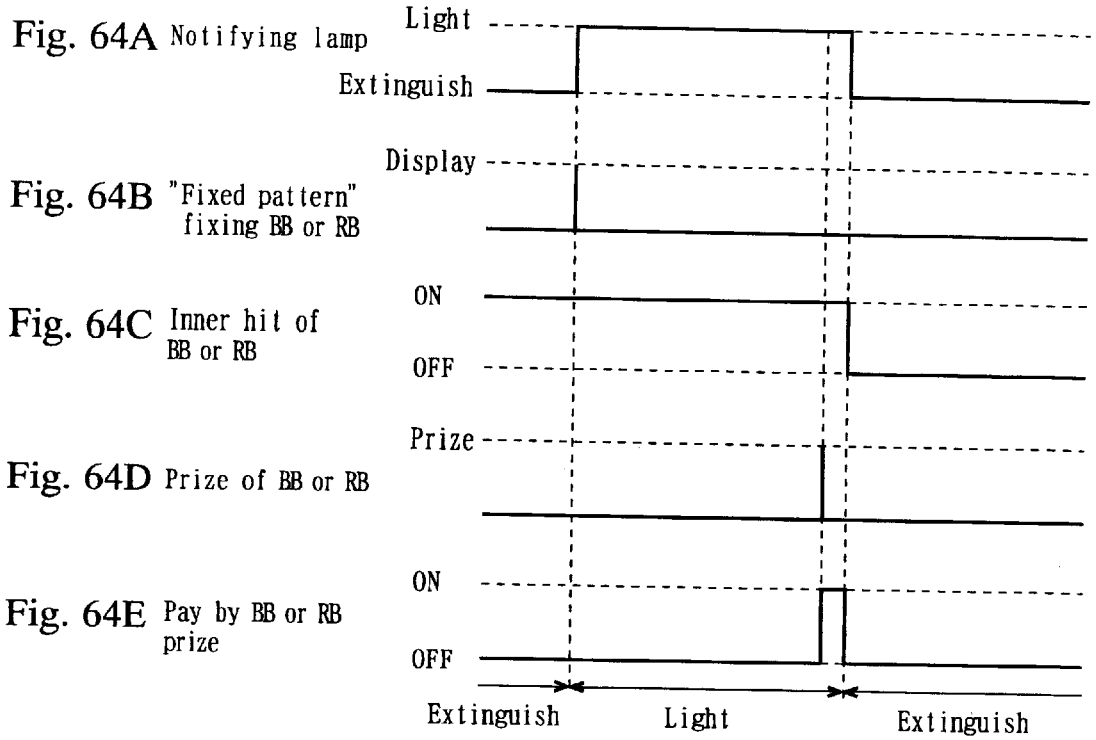
Fig. 64A Notifying lamp
Light
Extinguish
Fig. 64B "Fixed pattern" fixing BB or RB
Display
Fig. 64C Inner hit of BB or RB
ON
OFF
Fig. 64D Prize of BB or RB
Prize
Fig. 64E Pay by BB or RB prize
ON
OFF
Extinguish
Light
Extinguish

GAME MACHINE INFORMING PRIZE MODE INFORMATION IN A SERIES OF FLOW OF GAME

This patent application claims priority based on the Japanese patent applications, H09-352171 filed on Dec. 5, 1997 and H10-243695 filed on Aug. 28, 1998 the contents of which are incorporated herein by reference.

BACKGROUND OF THE INVENTION

1. Field of the Invention

The present invention relates to a game machine having a function to inform a player of a prize mode determined by a random number lottery.

2. Related Art

There has conventionally been, for example, a slot machine as a game machine of this kind. In a general slot machine, as shown in FIG. 1A, three reels 3, 4 and 5 are installed in parallel on the rear side of a front panel 2. Various patterns are illustrated on the outer circumferences of the individual reels 3 to 5, and the patterns are illuminated by built-in light sources (back lights), not shown, installed at the individual reels and are observed via individual windows 6, 7 and 8 formed at the front panel 2. Five prize lines are described in the windows, and the slot machine game is carried out depending upon whether or not a combination of predetermined patterns is set on any of the prize lines.

The game is started when a player puts a coin into a slot and when the coin is put into the slot, as shown in FIG. 1A, all of the back lights are lighted. When a coin of the player has not been put thereinto by the player for a predetermined time period after finishing the game, or the like, all of the back lights are extinguished, as shown in FIG. 1B. The individual reels 3 to 5 are rotated in response to the operation of a start lever by the player, and the individual windows 6 to 8 are displayed with the patterns which move to rotate in the directions of columns thereof. When the individual reels 3 to 5 reach a constant speed, the operation of the individual stop buttons installed in correspondence with the individual reels 3 to 5 becomes effective.

The player operates the individual stop buttons while observing the moving patterns and stops the rotation of the individual reels 3 to 5 thereby to stop and display desired patterns on any of the prize lines. The individual reels 3 to 5 stop rotating in response to the operational timings of the individual stop buttons. When a predetermined combination of patterns is displayed on any of the prize lines at the time of stopping them, a prize in response the combination of patterns is obtained.

There are a big hit prize, a medium hit prize, a small hit prize and so on in prize modes, and the big hit prize or the medium hit prize is caused when three of patterns "7" or patterns of a predetermined character are set on the prize line. A special game of big bonus game (BB game) in the case of the big hit prize or regular bonus game (RB game) in the case of the medium hit prize is carried out, and a large amount of coins can be acquired. Further, the small hit prize is caused when a predetermined number of patterns of "cherry" or "bell" are aligned on the prize line, and several coins can be acquired in the small hit prize. FIG. 1C shows a case in which patterns "bell" are aligned on a central prize line, and in this case, the back lights are flashed.

Such prize modes are determined by a lottery of random numbers which is carried out immediately after operating the start lever and has already been determined before the individual reels are operated to stop by the player. The lottery of random numbers is executed by prize mode determining means constituted inside of the game machine. When the big hit prize is determined by the lottery of random numbers, a display such as a notification lamp installed at the front panel of the machine is lighted, and the player is informed of the fact that the big hit prize is caused by the inner lottery of the machine. After this, the rotation of the individual reels is controlled to stop in response to the operation of stopping the buttons by the player, and the prize can be actually experienced by the player when a combination of patterns of the prize determined by the lottery of random numbers is stopped and displayed on the prize line.

In the aforementioned game machine of the prior art, however, the player is informed of the fact that the prize of the big hit is caused by the lottery inside of the machine, but this is informed by simply lighting the notification lamp which is devoid of interest in game.

According to the aforementioned conventional game machine, furthermore, the player is informed of the fact that a situation of causing a big hit prize is brought about by the inner lottery by displaying a predetermined combination of patterns which is referred to as "reach spot" (i.e., a hit anticipating state in Mahjong Game) in stopping to rotate the individual reels. However, only a skilled player accustomed to the game can read that the combination of patterns in stopping the reels constitutes the "reach spot" which is one of methods of informing establishment of the big hit, and a beginner of the game is different finds it difficult to read the "reach spot" from the output display of the reels.

According to the aforementioned conventional game machine, furthermore, when a big hit prize is caused by the inner lottery, as mentioned above, the notification lamp is immediately lighted, and the player is informed of a result of the inner lottery. According to the conventional game machine, therefore, the player is mechanically informed of the result of the inner lottery, as it is, for causing the big hit prize and cannot enjoy the pleasure of searching the result of the inner lottery as in, for example, searching for the "reach spot".

Furthermore, what is informed is only the case in which the big hit prize is caused by the inner lottery, and the information to be conveyed to the player is limited. Therefore, the result of the inner lottery which has been determined by the lottery of random numbers inside of the machine is not known until the patterns are actually stopped and displayed at the individual windows with regard to the prize modes other than big hit prize. Accordingly, the player cannot previously grasp the result of the inner lottery, and therefore, what patterns are to be aligned on the prize line cannot be known to the player at all when the rotation of the reels is operated to stop initially.

SUMMARY OF THE INVENTION

According to the invention, as conceived to solve those problems, there is provided a game machine which comprises: prize mode determining means for determining a prize mode of a game by a random number lottery; a variable display device for display various patterns variably in a plurality of columns and for displaying a combination of the patterns stationarily in said individual columns in accordance with the prize mode which is determined by said prize mode determining means; variable display starting means for starting the variable display of said variable display device; and variable display stopping means for stopping said variable display for the individual columns. Further comprised is information means for informing a player, at a predetermined probability, of an information corresponding to the prize mode determined by said prize mode determining means, in a series of flow of the game from the start of said variable display by said variable display starting means to the end of one game stopped by stopping said variable display by said variable display stopping means.

According to this construction, the prize mode determined by the inner lottery is informed to the player by the information corresponding to the prize mode through a series of flow of the game. This allows the player to predict the prize mode with the information mode according to the progress of the game. Specifically, the player is gradually informed of what prize mode is determined, by the inner lottery as the operations progress, so that the player becomes more excited by the prize mode which becomes clearer and clearer as the operations advance the farther, unlike the mere information of the result of the inner lottery.

Furthermore, the informing operation is not carried out in respect of all the results of the inner lottery but by predetermined probability. Accordingly, the prize modes may or may not be informed to the player. Accordingly, it is expected by the player to inform the prize modes, and the pleasure is also enhanced so far when the informing operation is carried out, as to extend from the start to the end of the variable display. As a result, the player can experience a series of games with an enhanced feeling of enjoyment based on the variable display.

Furthermore, the informing operation is carried out not only for a mode of the big hit prize but also for the individual prize modes, and the player can also be informed of the result of the inner lottery other than big hit prize. Therefore, the operation of the stop buttons, for example, can be easily carried out.

Furthermore, the information to be notified in correspondence with a prize mode different from that determined by the prize mode determining means may be notified at a predetermined probability. Therefore, the player may encounter a result different from a predicted prize and can further be excited by an unexpected feature of the game.

Furthermore, the aforementioned notification is more effective if its output mode is uniquely changed in a featuring scene throughout a series of flow of the game. Specifically, the notification is effective if the player is informed of the prize mode in combination of the kinds of operative sounds to be generated by the sound emitting means when the variable display is started, the kinds of the display modes of the individual columns to be sequentially made by the connective staging means cooperating with the stop of the variable displays of the individual columns, and the kinds of the display modes of the variable display device to be staged by the stop staging means when all the variable displays of the individual columns are stopped.

According to this constitution, the variable display of the variable display device is started by the variable display starting means and is stopped by the variable display stopping means. As all the variable displays are stopped, the prize modes determined by the inner lottery are sequentially informed to the player. As a result, the excitement is enhanced by the start of the variable displays by the variable display starting means and by the stop of the variable displays of the individual columns by the variable display stopping means.

According to another aspect of the invention, the game machine further comprises the notification means for notifying to the player information in a specific informing mode on a condition in which the information is a predetermined one corresponding to a specific prize mode determined by the prize mode determining means.

According to the constitution, when a specified prize mode is informed as the predetermined one, the result of the inner lottery of causing the specific prize mode is notified to the player by the notification means. In respect of the specific prize mode, when it is informed through the information other than the predetermined one, the result of the inner lottery is not notified by the notification means. Therefore, the player can be informed of the result of the inner lottery causing the specific prize mode through the information notified by the notification means even when the result of the inner lottery of causing the specific prize mode is not notified by the notification means.

Furthermore, the notification means notifies to the player the information by the specific informing mode on a condition in which the information by the notification means is one corresponding to the specific prize mode determined by the prize mode determining means and the predetermined information informed to the player at a probability of 100%.

According to the constitution, when the specific prize mode is informed at the probability of 100%, the result of the inner lottery of causing the specific prize mode is notified to the player by the notification means. When the specific prize mode is informed at a probability smaller than 100%, that is, in case even when the specified prize mode is caused by the inner lottery, the specific prize mode may not necessarily be informed, the result of the inner lottery is not notified by the notification means. Therefore, even when the result of the inner lottery of causing the specific prize mode by the information which is notified through a series of flow of the game.

That is, according to the invention, the prize mode determined by the inner lottery is informed to the player in a series of flow of the game. Therefore, the operation enhances. Furthermore, even the beginner of the game who cannot determine the "reach spot", can predict the prize mode to some extent by the informing operation in a series of flow of the game. Furthermore, the informing operation is carried out at a predetermined probability and therefore, when the informing operation is carried out, the pleasure is enhanced, and the interest is further enhanced. The informing operation is also carried out for the individual prize modes and therefore, the operation of the stop buttons is easily carried out.

Furthermore, even when the result of the inner lottery of causing the specific prize is not notified by the notification means, the player can be informed of the result of the inner lottery of causing the specific prize by the information of the notification means. Therefore, the pleasure for searching the occurrence of the specific prize mode is felt in the game from the information of the notification means.

BRIEF DESCRIPTION OF THE DRAWINGS

FIGS. 7A to 7E are timing charts illustrating the timings at which game starting sounds are outputted in a game process of the slot machines according to first and second embodiments;

FIGS. 12A to 12K are timing charts illustrating individual circuit portions when the fourth interlocking display mode shown in FIG. 11 is executed;

FIG. 17 is a diagram showing a prize probability table used in the game process of the slot machines according to the first and second embodiments;

FIG. 18 is a diagram showing a symbol table used in the game process of the slot machines according to the first and second embodiments;

FIG. 19 is a diagram enumerating a combination of staging display modes to be informed to the player by notification means in the game process of the slot machine according to the first embodiment;

FIG. 20A enumerates a relation between the kind of the game starting sound and the appearing frequency of the individual prize modes in the first embodiment, FIG. 20B enumerates a relation between the kind of the interlocking display mode and the appearing frequency of the individual prize modes in the first embodiment, and FIG. 20C enumerates a relation between the kind of the stop display mode and the appearing frequency of the individual prize modes in the first embodiment;

FIG. 21 is a diagram enumerating a lottery probability table for informing the selection of the prize mode used in the game process of the slot machine according to the first embodiment;

FIG. 22 is an appearance probability table enumerating probabilities of appearance of prediction informing patterns as a result of using the lottery probability table for informing the selection of the prize mode enumerated in FIG. 21;

FIGS. 26A to 26C are diagrams showing a relationship among symbol codes which are allocated to the individual rotating reels and read in the game process of the slot machine according to the first and second embodiments;

FIG. 27 is a diagram enumerating a hit prediction flag table used in the game process of the slot machine according to the first and second embodiments;

FIG. 28A is a diagram enumerating the appearing frequency of the individual prize modes in the staging mode combination ③ enumerated in FIG. 19, and FIG. 28B is a diagram enumerating the appearing frequency of the individual prize modes in the staging mode combination ⑧ enumerated in FIG. 19;

FIG. 31 is a diagram showing a first reel stop sound selecting table used in the game process of the slot machine according to the second embodiment;

FIGS. 32A to 32C are timing charts of a reel stop sound 1 shown in FIG. 31;

FIGS. 33A to 33D are timing charts of the reel stop sound 1 when a successive stop button is pushed before silencing the reel stop sound 1;

FIGS. 34A to 34C are timing charts of a reel stop sound 2 shown in FIG. 31;

FIGS. 35A to 35D are timing charts of the reel stop sound 2 when a successive stop button is pushed before silencing the reel stop sound 2;

FIGS. 36A to 36C are timing charts of a reel stop sound 3 shown in FIG. 31;

FIGS. 37A to 37D are timing charts of the reel stop sound 3 when a successive stop button is pushed before silencing the reel stop sound 3;

FIGS. 38A to 38C are timing charts of a reel stop sound 4 shown in FIG. 31;

FIG. 39 is a diagram enumerating a second reel stop sound selecting table used in the game process of the slot machine according to the second embodiment;

FIG. 40 is a diagram illustrating a second stop display mode (or a reel lamp flashing pattern 1) informed by the player by the stop staging means in the game process of the slot machine according to the second embodiment;

FIG. 41 is a diagram illustrating a third stop display mode (or a reel lamp flashing pattern 2) informed by the player by the stop staging means in the game process of the slot machine according to the second embodiment;

FIG. 42 is a diagram illustrating a fourth stop display mode (or a reel lamp flashing pattern 3) informed by the player by the stop staging means in the game process of the slot machine according to the second embodiment;

FIG. 43 is a diagram illustrating a front half of a fifth stop display mode (or a reel lamp flashing pattern 4) informed by the player by the stop staging means in the game process of the slot machine according to the second embodiment;

FIG. 44 is a diagram illustrating a rear half of the fifth stop display mode (or the reel lamp flashing pattern 4) informed by the player by the stop staging means in the game process of the slot machine according to the second embodiment;

FIG. 45 is a diagram illustrating a sixth stop display mode (or a reel lamp flashing pattern 5) informed by the player by the stop staging means in the game process of the slot machine according to the second embodiment;

FIG. 46 is a diagram illustrating a seventh stop display mode (or a reel lamp flashing pattern 6) informed by the player by the stop staging means in the game process of the slot machine according to the second embodiment;

FIG. 47 is a diagram illustrating a front half of an eighth stop display mode (or a reel lamp flashing pattern 7) informed by the player by the stop staging means in the game process of the slot machine according to the second embodiment;

FIG. 48 is a diagram illustrating an intermediate half of the eighth stop display mode (or the reel lamp flashing pattern 7) informed by the player by the stop staging means in the game process of the slot machine according to the second embodiment;

FIG. 49 is a diagram illustrating a rear half of the eighth stop display mode (or the reel lamp flashing pattern 7) informed by the player by the stop staging means in the game process of the slot machine according to the second embodiment;

FIG. 50 is a diagram illustrating a ninth stop display mode (or a reel lamp flashing pattern 8) informed by the player by the stop staging means in the game process of the slot machine according to the second embodiment;

FIG. 51 is a diagram illustrating a front half of a tenth stop display mode (or a reel lamp flashing pattern 9) informed by the player by the stop staging means in the game process of the slot machine according to the second embodiment;

FIG. 52 is a diagram illustrating an intermediate half of the tenth stop display mode (or the reel lamp flashing pattern 9) informed by the player by the stop staging means in the game process of the slot machine according to the second embodiment;

FIG. 53 is a diagram illustrating a rear half of the tenth stop display mode (or the reel lamp flashing pattern 9) informed by the player by the stop staging means in the game process of the slot machine according to the second embodiment;

FIG. 54 is a diagram enumerating a demonstration lottery table selecting table used in the game process of the slot machine according to the second embodiment;

FIG. 55 is a diagram enumerating a first demonstration lottery table used in the game process of the slot machine according to the second embodiment;

FIG. 56 is a diagram enumerating a second demonstration lottery table used in the game process of the slot machine according to the second embodiment;

FIG. 57 is a diagram enumerating a third demonstration lottery table used in the game process of the slot machine according to the second embodiment;

FIG. 58A is a diagram enumerating a content of a game level status (GMLVSTS) storing region stored in the RAM of the slot machine according to the second embodiment, and FIG. 58B is a diagram enumerating a content of a flag counter (FLGCTR) storing region stored in the RAM;

FIG. 59 is a diagram enumerating a probability pattern in which the prediction information of the occurrence of a specific prize mode is done at a probability of 100% in the second embodiment;

FIGS. 64A to 64E are diagrams illustrating timing charts of lighting a notification lamp according to the second embodiment;

DESCRIPTION OF THE PREFERRED EMBODIMENTS

Next, an explanation will be given of a first embodiment in which a game machine according to the invention is applied to a slot machine.

Figure 1A:
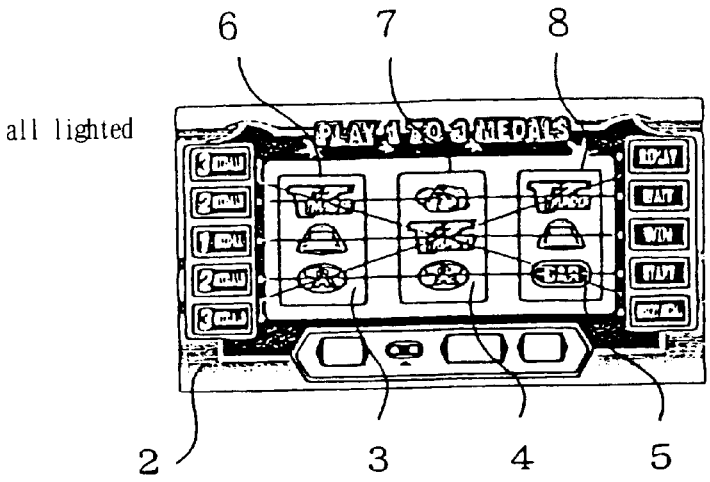
FIGS. 1A to 1C are views showing states of lighting individual reel back lamps in a conventional slot machine.
Figure 1B:
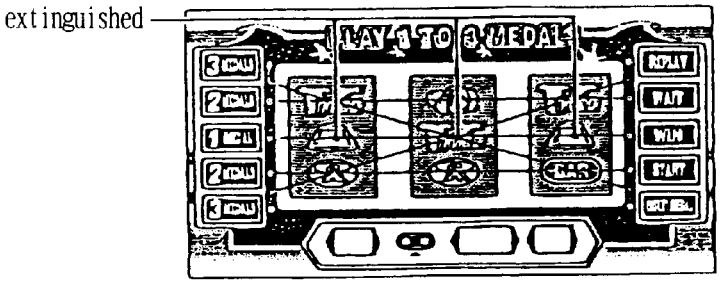
Figure 1C:
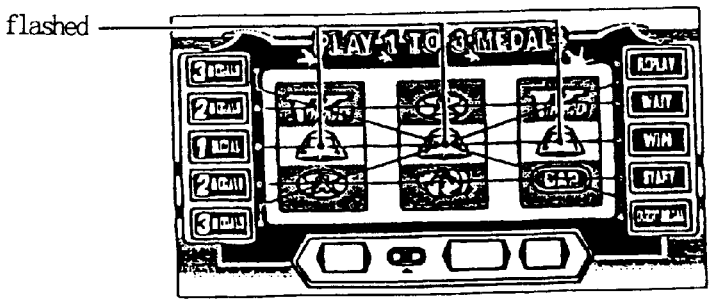
Figure 2:
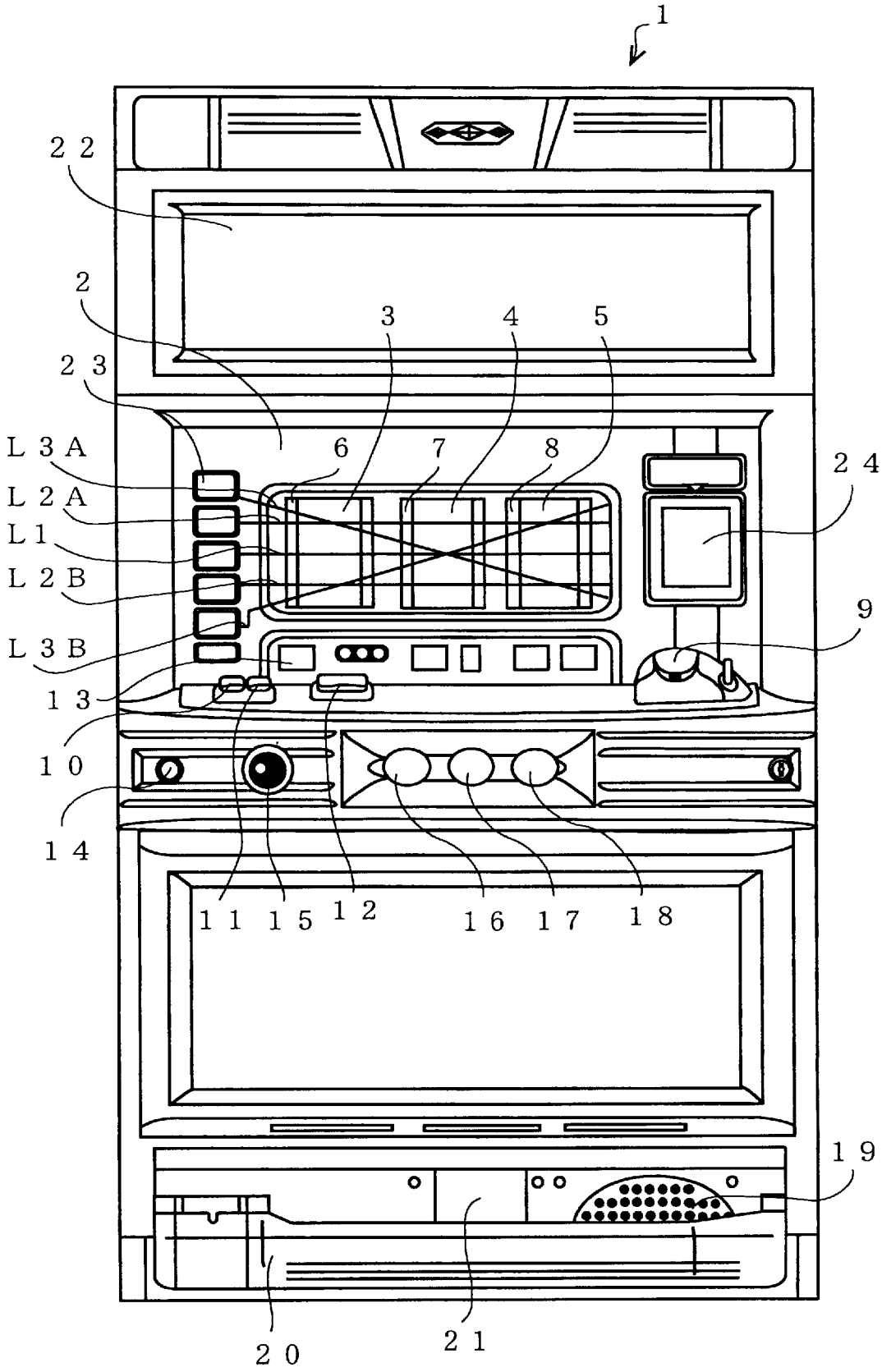
FIG. 2 is a front view showing an outlook of a slot machine according to a first embodiment of the invention.

FIG. 2 is a front view of a slot machine 1 according to this embodiment.

Three reels 3, 4 and 5 constituting a variable display device are rotatably installed on the rear side of a front panel 2 of the slot machine 1. Columns of symbols comprising plurality of kinds of patterns (hereinafter, referred to as the "symbols") are illustrated on the outer circumferences of the individual reels 3, 4 and 5. Three of the symbols are observed via each of display windows 6, 7 and 8 at the front face of the slot machine 1. Furthermore, a slot 9 into which a player inserts coins is installed on the lower right side of the display windows 6, 7 and 8.

Figure 3:
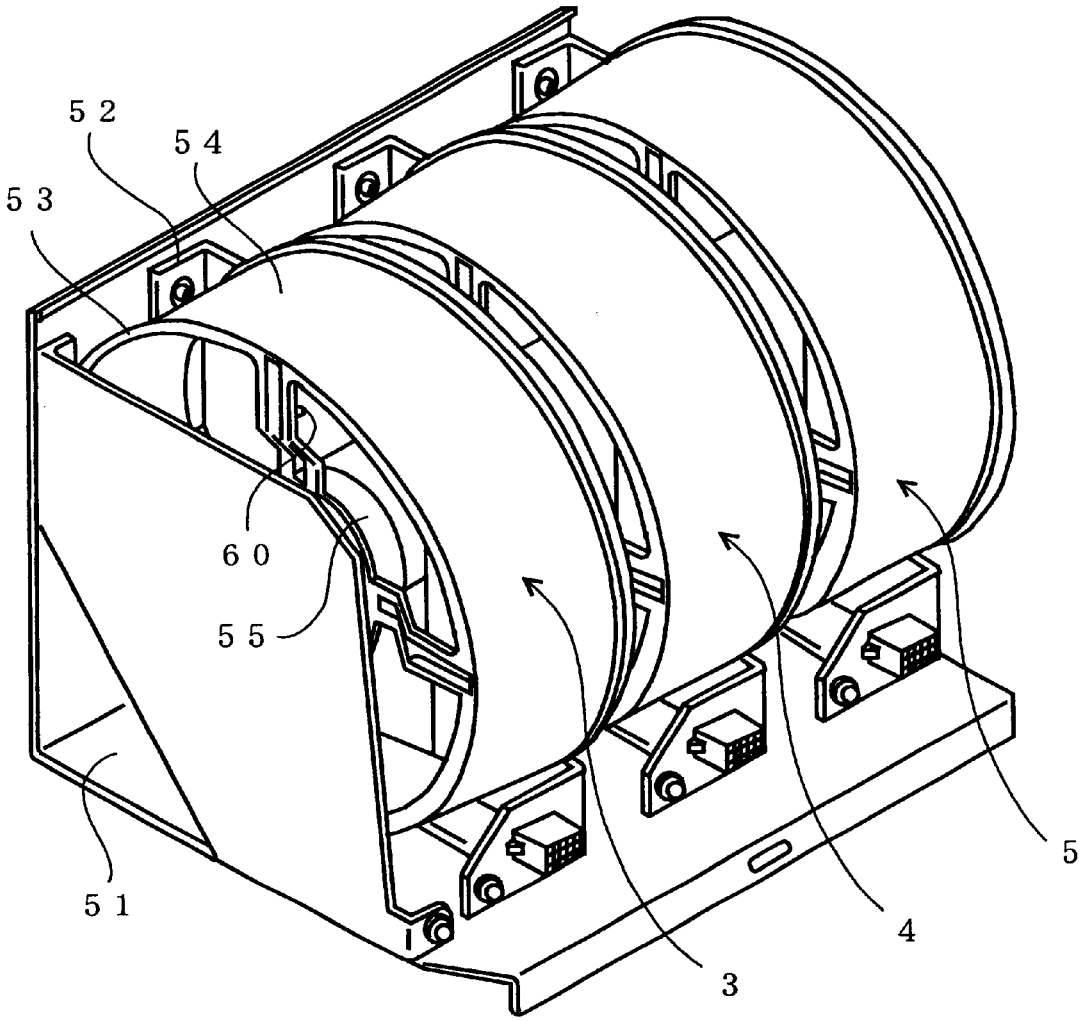
FIG. 3 is a perspective view showing a rotating reel unit of the slot machine shown in FIG. 2.

The individual reels 3 to 5 are constituted as a rotating reel unit shown in FIG. 3 and are attached to a frame 51 through brackets 52. Each of the reels 3 to 5 is constituted by pasting a reel band 54 on the outer circumference of a reel drum 53. The aforementioned symbol column on the outer circumference of the reel band 54. Furthermore, each of the brackets 52 is installed with a stepping motor 55, and the individual reels 3 to 5 are rotated by the drive of the motor 55.

Figure 4A:
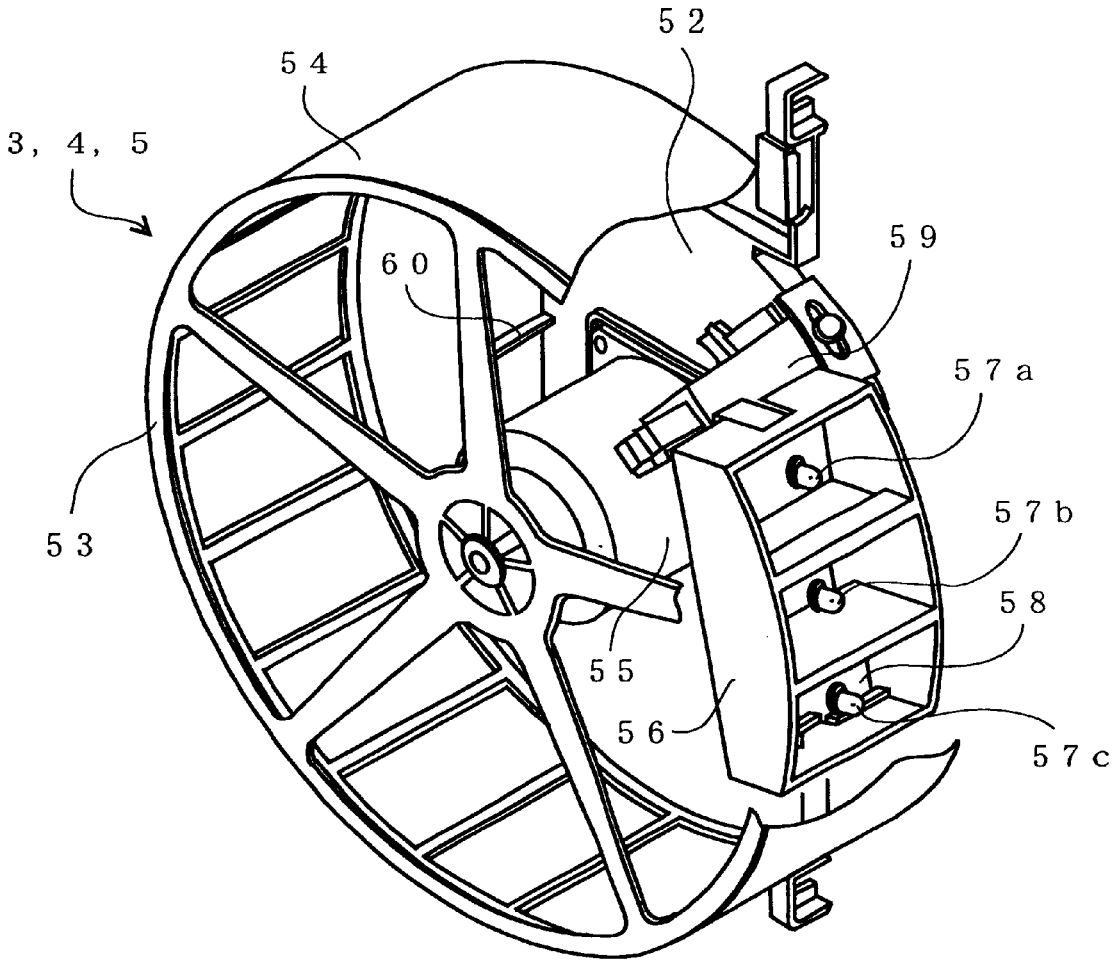
FIGS. 4A and 4B are perspective views showing a structure of a rotating reel constituting the rotating reel unit shown in FIG. 3.
Figure 4B:
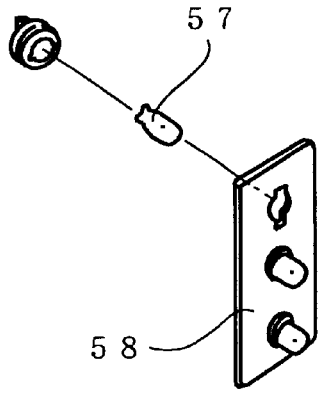

FIG. 4A shows the structure of each of the reels 3 to 5. Here, the same portions of FIG. 4A as those of FIG. 3 are designated by the same notations, and their explanation will be omitted. A lamp case 56 is installed inside of the reel drum 53 on the rear side of the reel band 54, and back lamps 57*a*, 57*b* and 57*c* are respectively attached to the three chambers of the lamp case 56. As shown in FIG. 4B, the back lamps 57*a*, 57*b* and 57*c* are mounted on a board 58, which is attached to the rear side of the lamp case 56. A photosensor 59 is attached to the bracket 52. The photosensor 59 detects a shield plate, as installed to the reel drum 53, to pass through the photosensor 59 as the reel drum 53 rotates.

The individual back lamps 57*a*, 57*b* and 57*c* are individually controlled and lighted by a later-described lamp drive circuit 48. By lighting the individual back lamps 57*a*, 57*b* and 57*c*, three symbols on the front side of the back lamps 57*a*, 57*b* and 57*c* are individually lighted from the rear side among symbols illustrated on the reel bands 54 so that they are projected on each of the display windows 6 to 8.

Figure 5A:
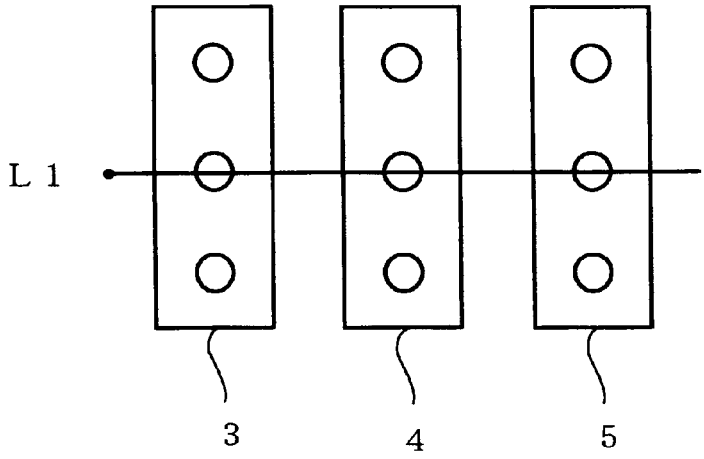
FIGS. 5A to 5C are views showing states in which prize lines described in display windows of the slot machine shown in FIG. 2 become successively effective.
Figure 5B:
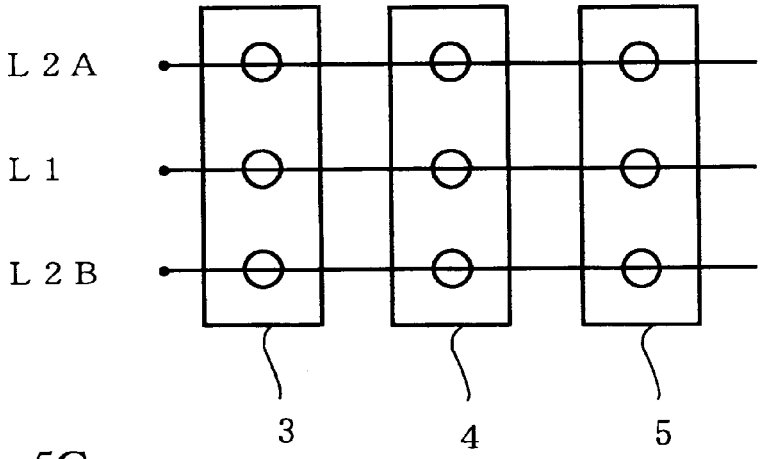

Furthermore, these display windows 6 to 8 shown in FIG. 2 are described with prize lines of horizontal three lines (including a central line L1, and upper and lower lines L2A and L2B) as well as two skew lines (including a skew right downward line L3A and a skew right upward line L3B). Before starting a game, when the player puts one coin into the coin slot 9, only the central prize line L1 of the individual reels 3 to 5 is made effective, as shown in FIG. 5A. When two coins are put into the slot 9, furthermore, the upper and lower prize lines L2A and L2B are added thereto so that the three horizontal lines of the prize lines L1, L2A and L2B are made effective, as shown in FIG. 5B. When three coins are put into the slot 9, furthermore, all the prize lines L1, L2A, L2B, L3A and L3B are made effective, as shown in FIG. 5C.

Figure 5C:
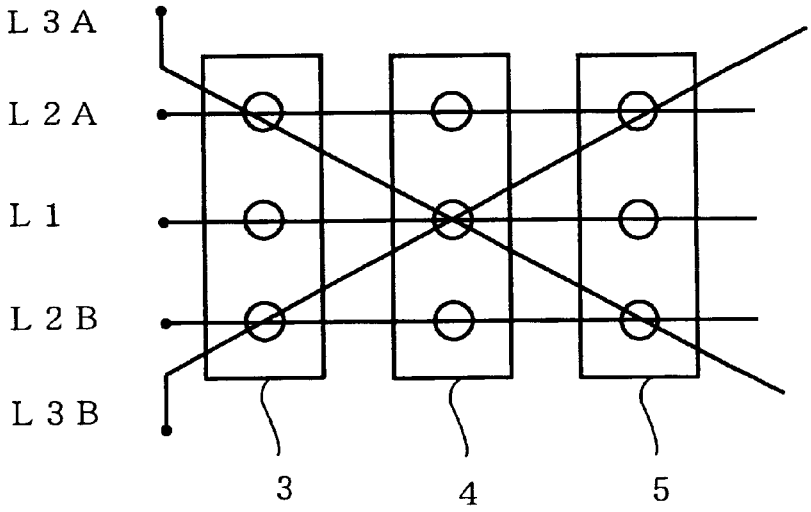

Here, circular marks in FIGS. 5A, 5B and 5C represent symbols illustrated on the respective reels 3 to 5. The effectiveness of the prize line is displayed to the player by lighting effective line display lamps 23 (as should be referred to FIG. 2) arranged at the end portions of the individual prize lines.

Furthermore, a 1BET switch 10, a 2BET switch 11 and a maxBET switch 12 are installed on the lower left side of the display windows 6 to 8. When coins are credited at a credit number display unit 13, instead of putting coins into the coin slot 9, by operating the individual push buttons of the 1BET switch 10, the 2BET switch 11 and the maxBET switch 12, one, two and three coins are individually bet in one game. The credit number display unit 13 is constructed by seven segments LEDs (Light Emitting Diodes) in accordance with the number of digits of a displayed numerical value, and displays the number of coins currently credited.

A credit/pay-out switch (C/P switch) 14 and a start lever 15 are installed on the lower side of the BET switches 10 to 12, and stop buttons 16, 17 and 18 are installed at a central portion of the device on the right side of the start lever 15. By operating the push button of the C/P switch 14, a play credit/pay-out can be switched.

The start lever 15 constitutes variable display starting means for starting the rotation display of the individual reels 3 to 5 so that the rotations of the reels 3, 4 and 5 are started altogether when the start lever 15 is operated. The stop buttons 16, 17 and 18 constitute variable display stopping means for stopping the rotation display of the individual reels 3, 4 and 5 for each column and are arranged to correspond to the reels 3, 4 and 5, respectively. When the rotation of the individual reels 3 to 5 reaches a constant speed, the operation of the individual stop buttons 16 to 18 is made effective to stop the rotation of the individual reels 3 to 5 in response to the pushing operation of the player.

Furthermore, a sound emitting hole 19 and a coin tray 20 are installed on the lower side of the front face of the slot machine 1. The sound emitting hole 19 is provided for emitting the sound, as generated from a speaker housed inside of the device, to the outside. The coin tray 20 is provided for storing the coins paid out from a coin outlet 21. Furthermore, a prize display portion 22 for indicating how many coins are to be paid out to each prize is installed on the upper side of the front face of the slot machine 1.

Furthermore, a liquid crystal display unit 24 is installed at the front panel 2 on the right side of the individual reels 3, 4 and 5. The liquid crystal display unit 24 is a display device for displaying the rotation of the individual reels 3, 4 and 5, displaying the history of a game or carrying out a representation in a bonus game.

Figure 6:
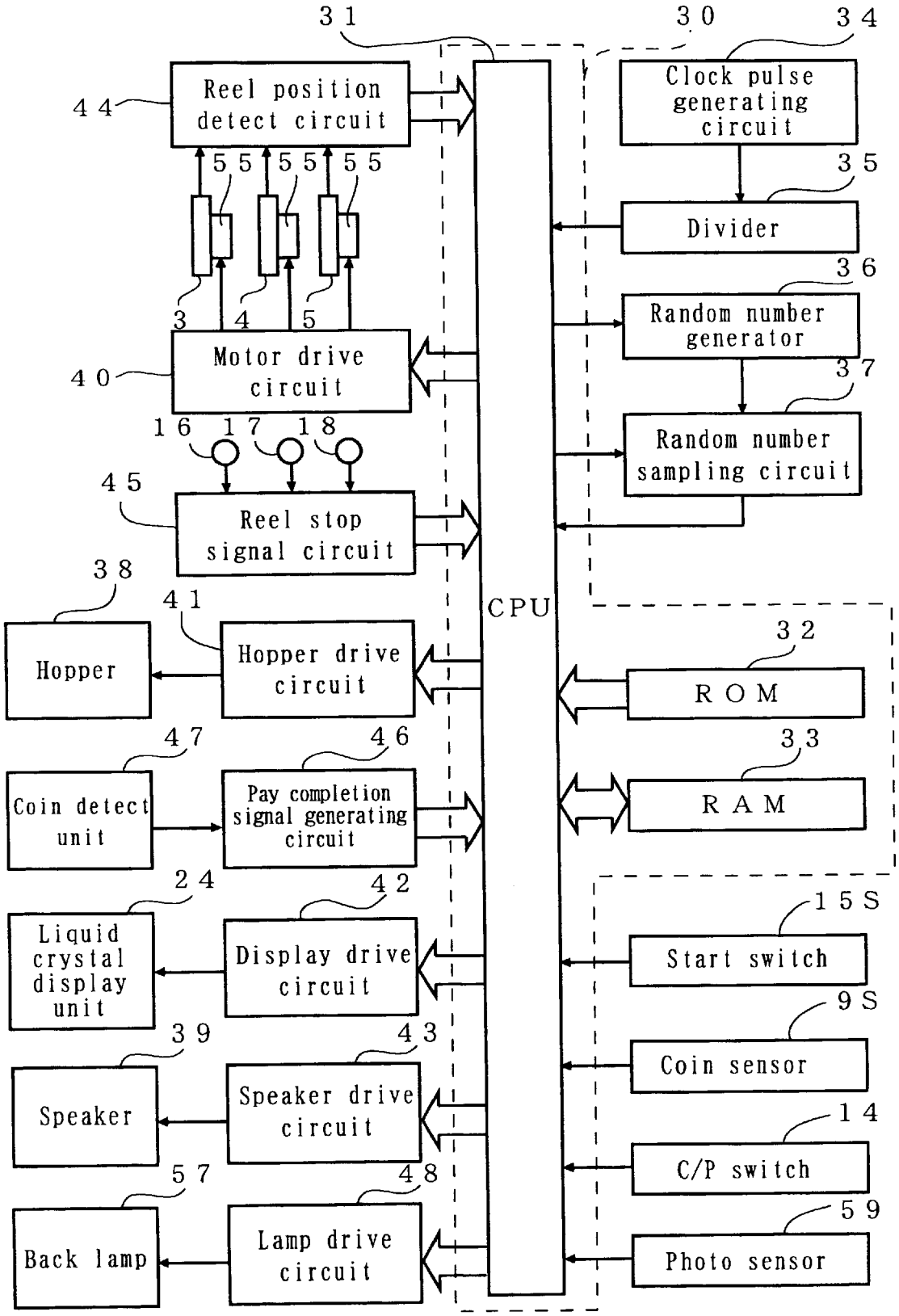
FIG. 6 is a block diagram showing a constitution of principal control circuits of the slot machine shown in FIG. 2.

FIG. 6 shows a circuit construction including a control unit for controlling the operation of a game process in the slot machine 1 of the embodiment, and peripheral devices (e.g., actuators) electrically connected with the control unit.

The control unit is constituted by a microcomputer (as will be referred to as the "micon") 30 as a major component, and additional circuits for random number sampling. The micon 30 is constituted to include a CPU 31, a ROM 32 and a RAM 33 as storage means. The CPU 31 is connected with a clock pulse generating circuit 34 and a divider 35 for generating reference clock pulses, a random number generator 36 acting as random number generating means for generating random numbers in a constant range, and a random number sampling circuit 37 acting as random number sampling means for sampling an arbitrary random number among the generated random numbers.

As major actuators to be operationally controlled with control signals coming from the micon 30, there are provided the stepping motor 55 for driving each of the reels 3, 4 and 5 to rotate, a hopper 38 for containing coins, the liquid crystal display unit 24, a speaker 39 and the back lamps 57*a*, 57*b* and 57*c*. These actuators are respectively driven by a motor drive circuit 40, a hopper drive circuit 41, a display drive circuit 42, a speaker drive circuit 43 and the lamp drive circuit 48. These drive circuits 40 to 43 and 48 are connected with the CPU 31 through an I/O port of the micon 30. The stepping motor 55 is excited in a 1 or 2 phase by the motor drive circuit 40 and is rotated by one turn when it is fed with a drive signal of 400 pulses.

As major input signal generating means for generating input signals necessary for forming the control signals by the micon 30, furthermore, there are provided a start switch 15S for detecting on operation of the start lever 15, a coin input sensor 9S for detecting a coin inserted through the coin inserting slot 9 and the aforementioned C/P switch 14. There are further provided the photosensor 59 and a reel position detecting circuit 44 for detecting the rotational positions of the individual reels 3, 4 and 5 in response to an output pulse signal coming from the photosensor 59.

The photosensor 59 detects the shield plate 60 at each rotation of the individual reels 3, 4 and 5 to generate a reset pulse. This preset pulse is transmitted to the CPU 31 through the reel position detecting circuit 44. The RAM 33 is stored with numerical values corresponding to the rotational positions in a range of one rotation in respect of the individual reels 3 to 5. In response to the reset pulse, the CPU 31 clears the numerical values, as established in the RAM 33, to "0". By this clearing action, a deviation, as caused between the display of movement of each symbol and the rotation of each stepping motor 55, is resolved at each rotation.

There are further provided a reel stop signal circuit 45 and a pay completion signal generating circuit 46 acting as the aforementioned input signal generating means. The reel stop signal circuit 45 generates signals for stopping the corresponding ones of the reels 3, 4 and 5 when the stop buttons 16, 17 and 18 are pushed. Furthermore, a coin detecting unit 47 counts the number of coins paid out from the hopper 38, and the pay completion signal generating circuit 46 outputs a signal for informing the completion of the pay-out of coins to the CPU 31 when the counted value of actually paid-out coins, as inputted from the coin detecting unit 47, reaches the data of a predetermined number of prizes.

The speaker 39, the speaker drive circuit 43 and the micon 30 constitute sound emitting means for generating either of two kinds of game starting sounds 1 and 2 as the effect sound when the rotation display of the individual reels 3 to 5 is started by the start lever 15. The kind of the game starting sound to be generated by the sound emitting means is selected according to the kind of the prize mode, as will be described hereinafter.

The timing at which each game starting sound 1 or 2 is emitted is illustrated in FIG. 7A, and this sound is outputted for a duration t1 just after the prize mode lottery timing illustrated in FIG. 7E. The start lever 15 has to be operated at a time interval of t2, e.g., 4.1 seconds so that the a reel rotation inhibit sound is outputted at a timing, as illustrated in FIG. 7B, from the speaker 39 when a next lever operation is carried out within the time period t2 from the previous start lever operation, as illustrated in FIG. 7D. FIG. 7C illustrates the rotational state of the reel which will stop finally in the previous game, and this reel rotates after lapse of the time period t2 from the start of rotation of the previous game. in this case, the game starting sound for the next game is also outputted after lapse of the time period t2, as illustrated in FIG. 7A.

Furthermore, the lamp drive circuit 48, the back lamps 57*a* to 57*c* and the micon 30 constitute connective staging means for staging the displays of the individual reels 3 to 5 successively in one of four kinds of display modes in connection with the stop of the rotational display of the individual reels 3 to 5 by the operation of the individual stop buttons 16 to 18. The display modes to be staged by this connective staging means are selected according to the kinds of the prize modes, as will be described hereinafter.

FIGS. 8, 9, 10 and 11 illustrate first, second, third and fourth display modes to be staged by the connective staging means. Here, the same portions of these Figures as those of FIG. 2 are designated by the same notations, and their description will be omitted.

Figure 8A:
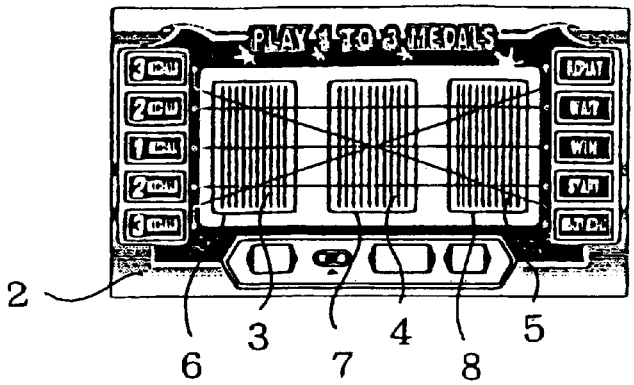
FIGS. 8A to 8D are diagrams showing a first interlocking display mode to be informed to the player by the connective staging means in the game process of the slot machines according to the first and second embodiments.
Figure 8B:
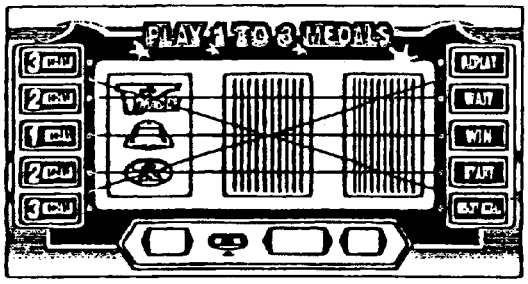
Figure 8C:
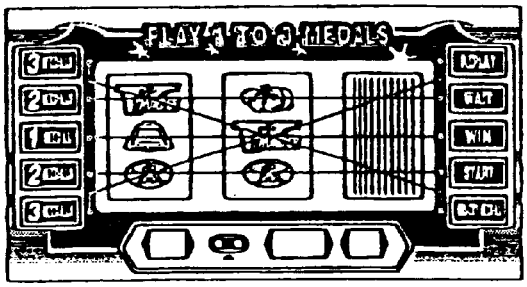
Figure 8D:
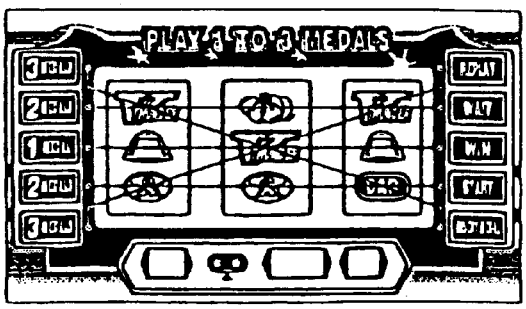

The first connective staging mode, as illustrated in FIGS. 8A to 8D, designates "no reel lamp extinguishment", in which the connective staging means lights all the back lamps 57*a* to 57*c* during the rotation of the individual reels 3 to 5, as illustrated in FIG. 8A. In case the first stop button 16 is operated to stop the rotation of the first reel 3, furthermore, the individual back lamps 57*a* to 57*c* of the first reel 3 are kept lighted, as illustrated in FIG. 8B. Likewise, in case the rotations of the second and third reels 4 and 5 are successively stopped by operating the second and third stop buttons 17 and 18, the individual back lamps 57*a* to 57*c* of the second and third reels 4 and 5 are also kept lighted, as illustrated in FIGS. 8C and 8D.

Figure 9A:
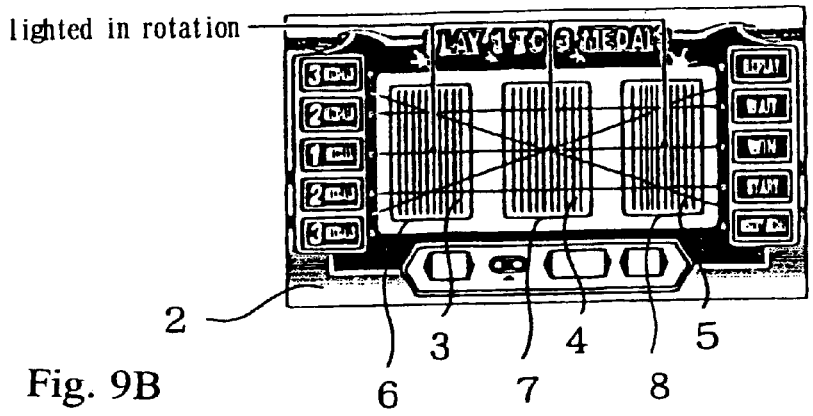
FIGS. 9A to 9D are diagrams showing a second interlocking display mode to be informed to the player by the connective staging means in the game process of the slot machines according to the first and second embodiments.
Figure 9B:
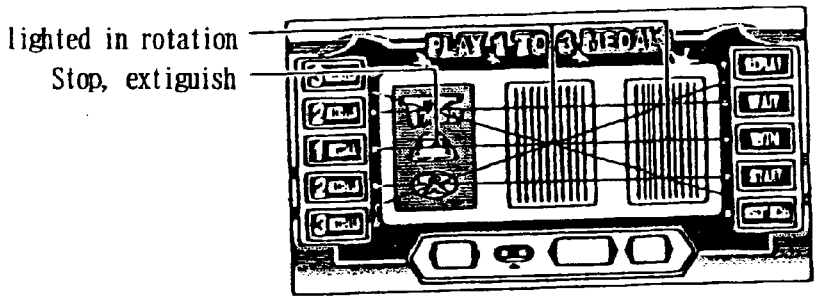
Figure 9C:
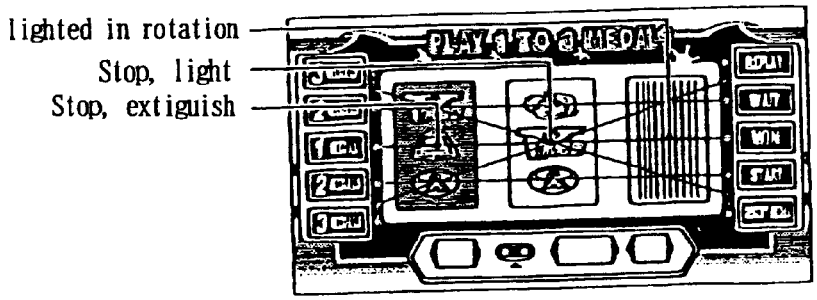
Figure 9D:
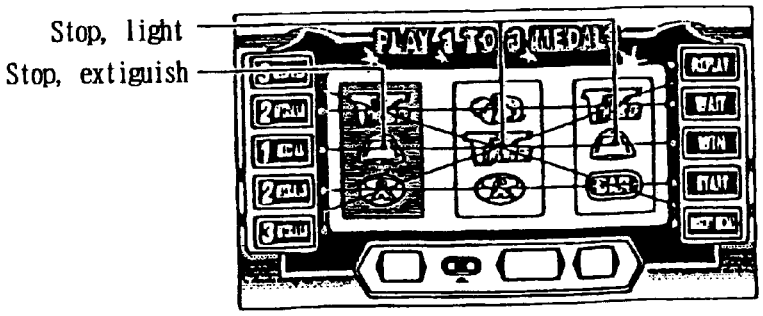

The second connective staging mode, as illustrated in FIGS. 9A to 9D, designates "reel lamp extinguishing pattern 1", in which the connective staging means lights all the back lamps 57*a* to 57*c* during the rotation of the individual reels 3 to 5, as illustrated in FIG. 9A. In case the first stop button 16 is operated to stop the rotation of the first reel 3, however, the individual back lamps 57*a* to 57*c* of the first reel 3 are extinguished, as illustrated in FIG. 9B. In case the rotations of the second and third reels 4 and 5 are successively stopped by operating the second and third stop buttons 17 and 18, furthermore, the individual back lamps 57*a* to 57*c* of the second and third reels 4 and 5 are also kept lighted, as illustrated in FIGS. 9C and 9D.

Figure 10A:
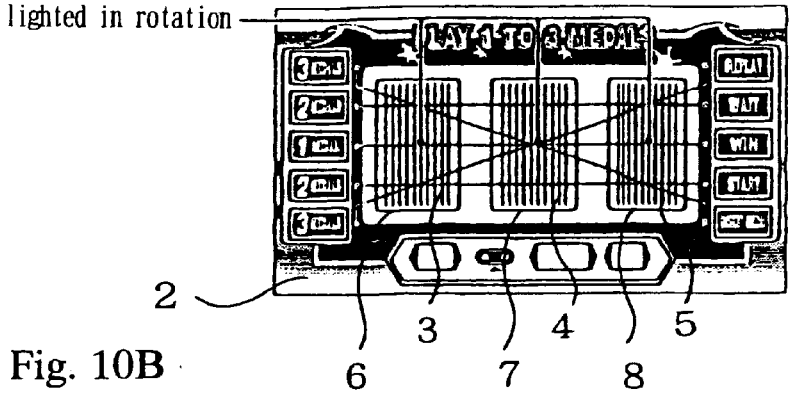
FIGS. 10A to 10D are diagrams showing a third interlocking display mode to be informed to the player by the connective staging means in the game process of the slot machines according to the first and second embodiments.
Figure 10B:
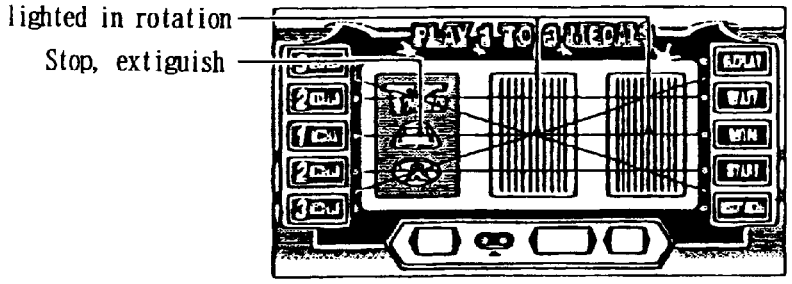
Figure 10C:
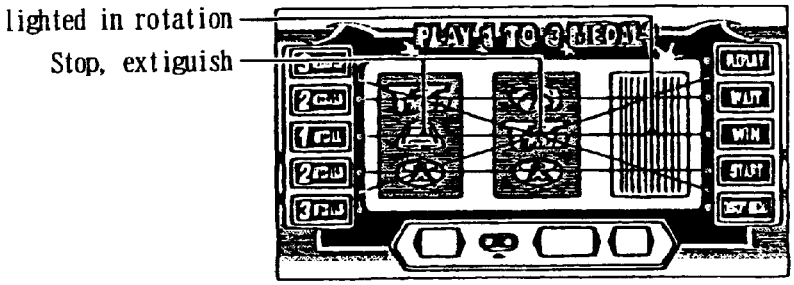
Figure 10D:
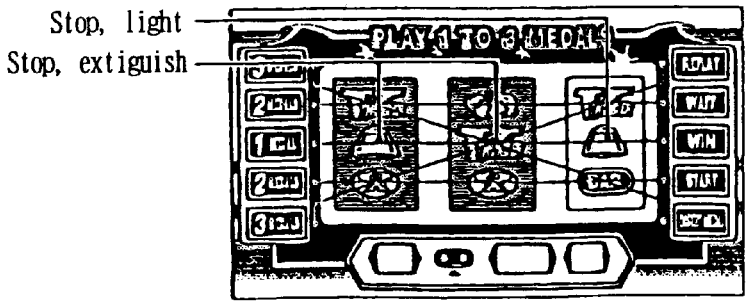

The third connective staging mode, as illustrated in FIGS. 10A to 10D, designates "reel lamp extinguishing pattern 2", in which the connective staging means lights all the back lamps 57*a* to 57*c* during the rotation of the individual reels 3 to 5, as illustrated in FIG. 10A. In case the first stop button 16 is operated to stop the rotation of the first reel 3, the individual back lamps 57*a* to 57*c* of the first reel 3 are extinguished, as illustrated in FIG. 10B. In case the rotation of the second reel 4 is stopped by operating the second stop button 17, the individual back lamps 57*a* to 57*c* of the second reel 4 are extinguished, as illustrated in FIGS. 10C. In case the rotation of the third reel 5 is stopped by operating the third stop button 18, furthermore, the individual back lamps 57*a* to 57*c* of the third reel 5 is are kept lighted, as illustrated in FIGS. 10D.

Figure 11A:
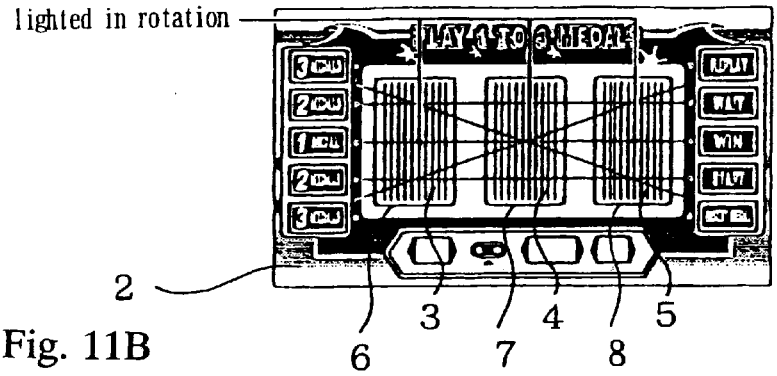
FIGS. 11A to 11D are diagrams showing a fourth interlocking display mode to be informed to the player by the connective staging means in the game process of the slot machines according to the first and second embodiments.
Figure 11B:
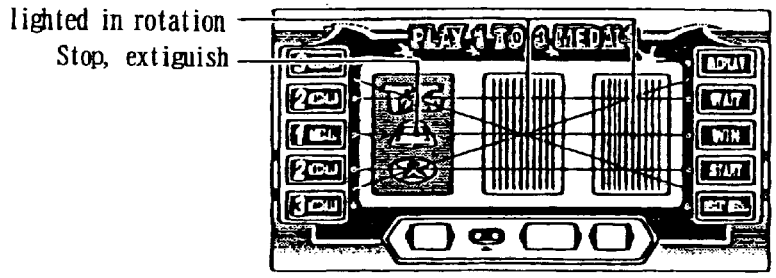
Figure 11C:
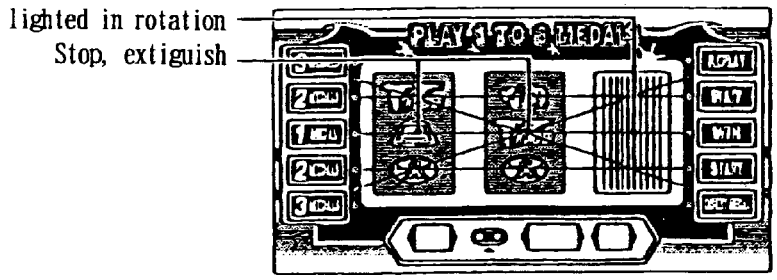
Figure 11D:
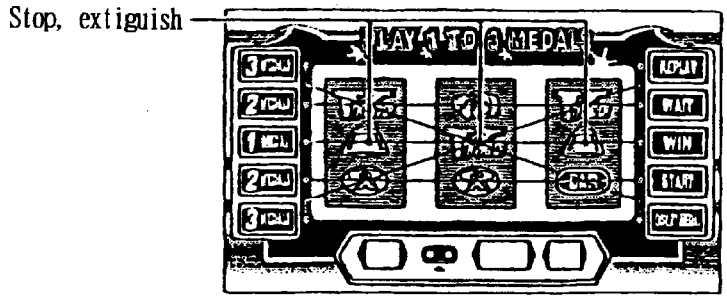

The fourth connective staging mode, as illustrated in FIGS. 11A to 11D, designates "reel lamp extinguishing pattern 3", in which the connective staging means lights all the back lamps 57*a* to 57*c* during the rotation of the individual reels 3 to 5, as illustrated in FIG. 11A. In case the first stop button 16 is operated to stop the rotation of the first reel 3, however, the individual back lamps 57*a* to 57*c* of the first reel 3 are extinguished, as illustrated in FIG. 11B. In case the rotations of the second and third reels 4 and 5 are successively stopped by operating the second and third stop buttons 17 and 18, furthermore, the individual back lamps 57*a* to 57*c* of the second and third reels 4 and 5 are individually extinguished, as illustrated in FIGS. 11C and 11D.

The timing charts illustrated in FIGS. 12A to 12K indicate the timings of the individual portions when the individual back lamps 57*a* to 57*c* are controlled to light according to the fourth connective staging mode. When the start lever 15 is operated at the timing illustrated in FIG. 12J, the later-described prize mode determining lottery operation is carried out at the timing illustrated in FIG. 12K, and the individual reels 3, 4 and 5 successively rotate altogether, as illustrated in FIGS. 12A, 12B and 12C. When the first reel stop button 16, the second reel stop button 17 and the third reel stop button 18 are operated in this order, as shown in FIGS. 12D, 12E and 12F, the first reel 3, the second reel 4 and the third reel 5 are stopped at the respective timings, as illustrated in FIGS. 12A, 12B and 12C, and the individual back lamps 57*a* to 57*c* of the first, second and third reels 3, 4 and 5 are extinguished at the timings illustrated in FIGS. 12G, 12H and 12I. As a result, the displays of the individual reels 3 to 5 are staged in the fourth connective staging modes, as illustrated in FIGS. 11A to 11D, in connection with the individual stop button operations of the individual reels 3 to 5.

Here, the reel stop control is conveniently explained in this embodiment in case the first reel stop button 16, the second reel stop button 17 and the third reel stop button 18 are operated in this order, as illustrated in FIGS. 12D, 12E and 12F, to stop the first reel 3, the second reel 4 and the third reel 5 in this order, as illustrated in FIGS. 12A, 12B and 12C. However, the order of stopping the individual reels 3 to 5 should not be limited thereto but may be exemplified in a random operating order in which the first reel stop button 16, the third reel stop button 18 and the second reel stop button 17 are stopped in the recited order.

Furthermore, the lamp drive circuit 48, the back lamps 57*a* to 57*c* and the micon 30 also constitute stop staging means for staging the displays of the individual reels 3 to 5 in one of the four kinds of display modes when all the rotational displays of the individual reels 3 to 5 are stopped. The display modes to be staged by this stop staging means are selected according to the kinds of the prize modes, as will be described hereinafter.

FIGS. 13, 14, 15 and 16 show first, second, third and fourth stop display modes to be staged by the stop staging means. Here in these Figures, the same portions as those of FIG. 2 are designated by the same notations, and their description will be omitted.

Figure 13:
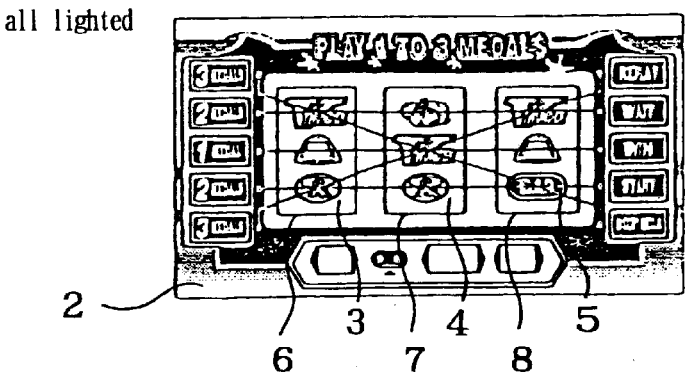
FIG. 13 is a diagram showing a first stop display mode to be informed to the player by stop staging means in the game process of the slot machine according to the first embodiment.

The first stop display mode, as shown in FIG. 13, is the "no reel lamp flashing" mode, in which the stop staging means keeps all the back lamps 57*a* to 57*c* of the individual reels 3 to 5 lighted without any flashing control.

Figure 14A:
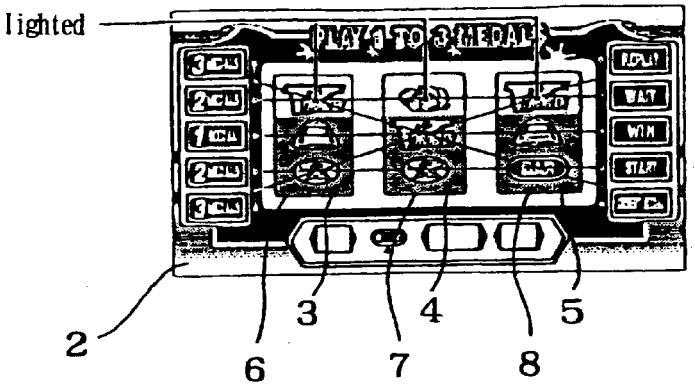
FIGS. 14A to 14C are diagrams showing a second stop display mode to be informed to the player by the stop staging means in the game process of the slot machine according to the first embodiment.
Figure 14B:
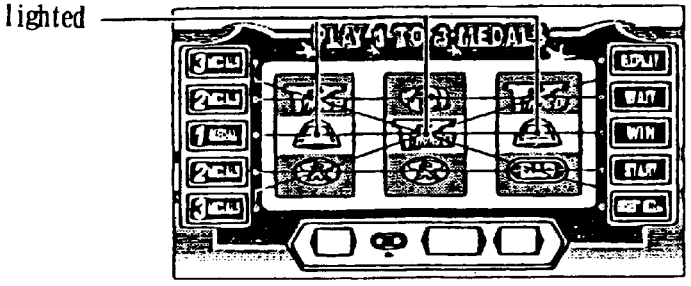
Figure 14C:
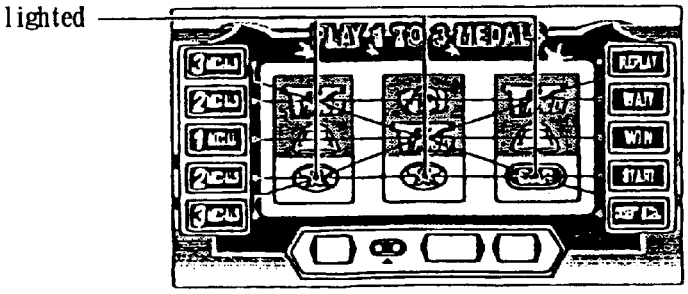

The second stop display mode, as shown in FIGS. 14A to 14C, is the "reel lamp flashing A" mode. When all the individual reels 3 to 5 are stopped, the stop staging means lights at first only the back lamps 57*a* of the upper stage of the individual reels 3 to 5, as shown in FIG. 14A, and then lights only the back lamps 57*b* of the medium stage of the individual reels 3 to 5, as shown in FIG. 14B. Finally, the stop staging means lights only the back lamps 57*c* of the lower stage of the individual reels 3 to 5, as shown in FIG. 14C. By a series of lighting controls shown in FIGS. 14A to 14C, the individual back lamps 57*a* to 57*c* are flashed in a stop display mode A.

Figure 15A:
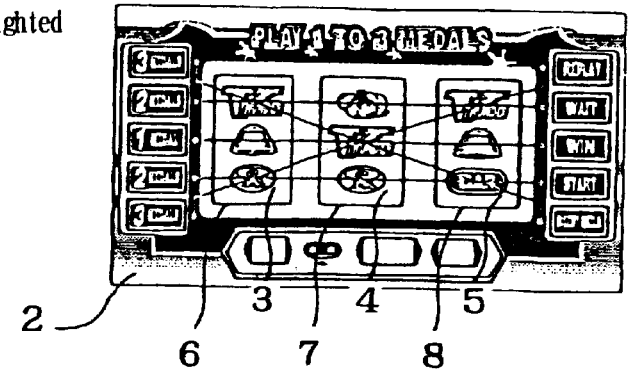
FIGS. 15A to 15E are diagrams showing a third stop display mode to be informed to the player by the stop staging means in the game process of the slot machine according to the first embodiment.
Figure 15B:
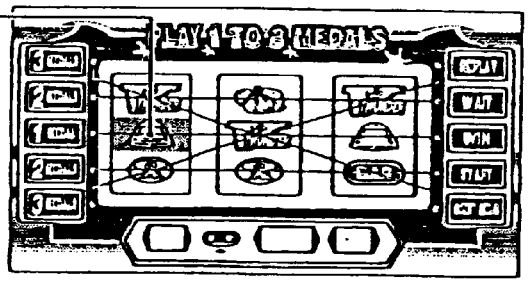
Figure 15C:
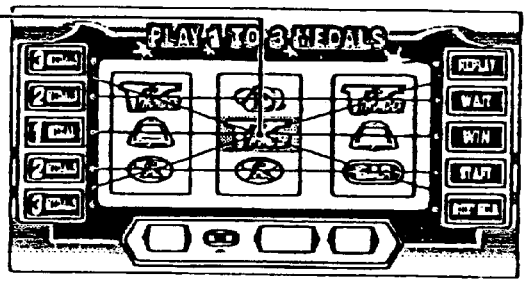
Figure 15D:
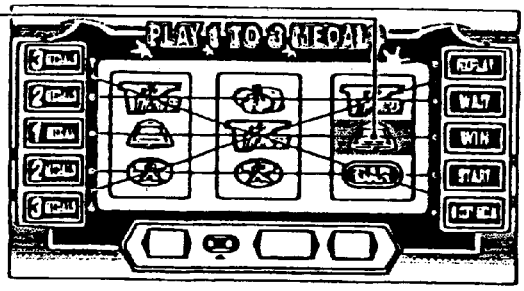
Figure 15E:
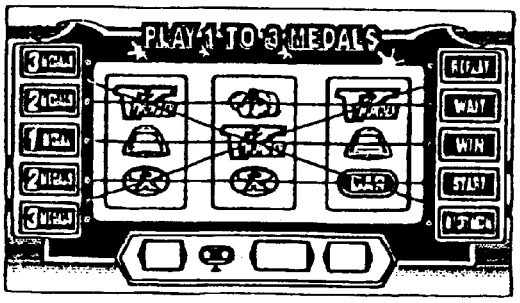

The third stop display mode, as shown in FIGS. 15A to 15E, is the "reel lamp flashing B" mode. When all the individual reels 3 to 5 are stopped, the stop staging means keeps at first all the back lamps 57*a* to 57*c* of the individual reels 3 to 5 lighted, as shown in FIG. 15A, and subsequently extinguishes only the back lamps 57*b* of the medium stage of the first reel 3, as shown in FIG. 15B. Successively, the stop staging means extinguishes only the back lamps 57*b* of the medium stage of the second reel 4, as shown in FIG. 15C, and then extinguishes only the back lamps 57*b* of the medium stage of the third reel 5, as shown in FIG. 15D. Finally, the stop staging means lights all the back lamps 57*c* of the individual reels 3 to 5, as shown in FIG. 15E. By a series of lighting controls shown in FIGS. 15A to 15E, the individual back lamps 57*a* to 57*c* are flashed in a stop display mode B.

Figure 16A:
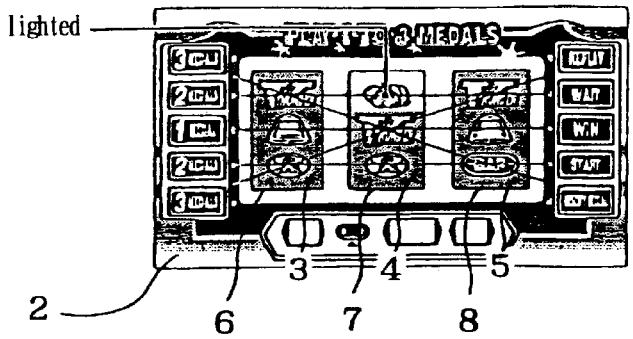
FIGS. 16A to 16F are diagrams showing a fourth stop display mode to be informed to the player by the stop staging means in the game process of the slot machine according to the first embodiment.
Figure 16B:
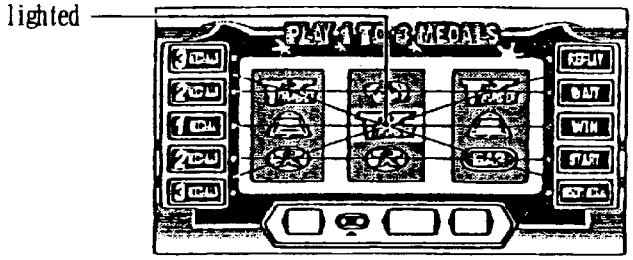
Figure 16C:
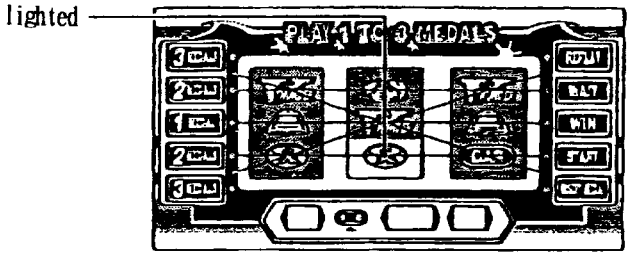
Figure 16D:
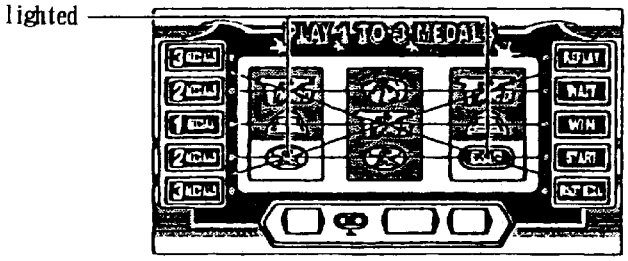
Figure 16E:
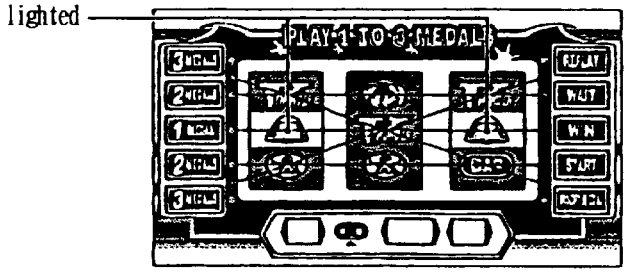
Figure 16F:
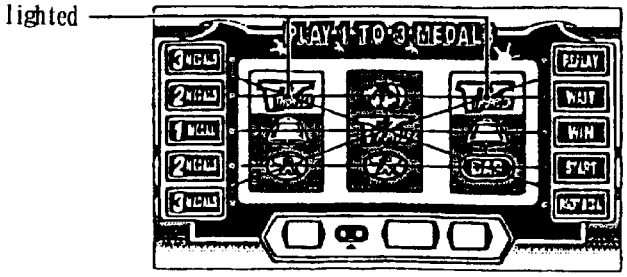

The fourth stop display mode, as shown in FIGS. 16A to 16F, is the "reel lamp flashing C" mode. When all the individual reels 3 to 5 are stopped, the stop staging means lights at first only the back lamps 57*a* of the upper stage of the second reel 4, as shown in FIG. 16A, and then lights only the back lamps 57*b* of the medium stage of the same second reel 4, as shown in FIG. 16B. Next, the stop staging means lights only the back lamps 57*c* of the lower stage of the second reel 4, as shown in FIG. 16C, and then lights the back lamps 57*c* of the individual lower stages of the first reel 3 and the third reel 5, as shown in FIG. 16D. Next, the stop staging means lights the back lamps 57*b* of the individual medium stages of the first reel 3 and the third reel 5, as shown in FIG. 16E. Finally, the stop staging means lights the back lamps 57*a* of the individual upper stages of the first reel 3 and the third reel 5, as shown in FIG. 16F. By a series of lighting controls, as shown in FIGS. 16A to 16F, the individual back lamps 57*a* to 57*c* are flashed in the stop display mode C.

As shown in FIG. 6, the ROM 32 is stored with a game processing procedure to be executed in the slot machine 1 as a sequence program, as well as a prize probability table, a symbol table, a prize symbol combination table, a prize mode informing selection lottery probability table and so on, which are individually classified from one another.

The prize probability table constitutes random number classifying means for classifying the random numbers, as sampled by the sampling circuit 37 into the individual prize modes, and stores the data for classifying the random numbers in constant ranges, as generated by the random number generator 36, into the individual prize modes. This prize probability table is constructed, as shown in FIG. 17. Notations a1 to a3, b1 to b3, c1 to c3, d1 to d3, e1 to e3, f1 to f3, and g1 to g3 in FIG. 17 designate the preset numerical value data which are used for classifying the random numbers, as sampled by the sampling circuit 37, into the individual prize modes. According to the data, there are used combinations of the individual numerical values of "a1 to g1" when the number of inputted coins is one, "a2 to g2" when the number is two, and "a3 to g3" when the number is three.

These numerical values are set under large or small relationship of "a<b<c<d<e<f<g". When the sampled random number value is less than a, a big hit prize (or shortly, big hit) is provided, and a "BB" hit flag is erected. When the sampled random number value is equal to or more than a and less than b, furthermore, a medium hit prize (or shortly, medium hit) is provided, and an "RB" hit flag is erected. When the sampled random number value is equal to or more than b and less than f, a small hit prize (or shortly, small hit) is provided. In this case: when the value is equal to or more than b and less than c, a "watermelon" hit flag is erected; when the value is equal to or more than c and less than d, a "bell" hit flag is erected; when the value is equal to or more than d and less than e, a "4 cherry" hit flag is erected; and when the value is equal to or more than e and less than f, a "2 cherry" hit flag is erected. When the sampled random number value is equal to or more than f and less than g, furthermore, a "replay" hit flag is erected, and when the value is equal to or more than g, a "blank" hit flag with no prize is erected.

That is, the prize mode is determined depending upon which numeral value range the sampled random number value belongs to, and is represented by a total of eight kinds of hit flags including "blank" and "replay". In this case, the random number generator 36, the sampling circuit 37, the prize probability table and the micon 30 constitute prize mode determining means. The various hits are made under probabilities according to the data setting in the prize probability table. Therefore, the various hits are not extremely controlled by the skill of the player, and a total coin pay rate in, for example, the business hours of one day is maintained substantially constant.

Furthermore, the symbol table is conceptionally illustrated in FIG. 18. The symbol table corresponds the rotational positions of the individual reels 3 to 5 to symbols, and represents the symbol columns by the notations. The symbol table is stored with symbol codes corresponding to the code numbers. These code numbers are successively provided at constant rotational pitches of the reels 3 to 5 with reference to the rotational position for generating the aforementioned reset pulse. The symbol codes designate the symbols which are provided to correspond to the individual code numbers.

Furthermore, the prize symbol combination table is stored with the symbol codes of the individual prize symbol combinations which are displayed on the prize display portion 22, the symbol codes of the symbol combinations constituting the "reach spot" indicating the player that the flags for causing a specific game are established, the prize determination codes representing the individual prizes, the number of coins for the prize, and so on. The prize symbol combination table is referred to, when the first reel 3, the second reel 4 and the third reel 5 are controlled to stop and when the prize is confirmed after stopping all the reels.

On the other hand, the prize mode informing section lottery probability table constitutes informing mode selecting means for selecting one of eight combinations, which are obtained by combining the kinds of play starting sounds, the kinds of connection display modes and the kinds of stop display modes in accordance with one of the eight prize modes determined by the prize mode determining means Furthermore, these informing mode selecting means, sound emitting means, connective staging means and stop staging means constitute information means for informing the player the prize modes at a predetermined probability through a series of flow of the slot machine game.

In this embodiment, eight kinds of combinations of the individual staging modes are allocated to eight kinds of individual prize modes, as enumerated in FIG. 19.

In the combination ①, the game starting sound 1 is generated at a game starting time, and the connective display mode of the "no reel lamp extinguishment" appears while the individual reels 3 to 5 are stopped whereas the stop display mode of the "no reel lamp flashing" appears after the stop of the individual reels 3 to 5. By the staging of the combination ① by the information means, it is informed to the player that the hit flag of the "blank" is erected by the lottery inside of the machine.

In the combination ②, the game starting sound 1 is generated at a game starting time, and the connective display mode of the "reel lamp extinguishing pattern 1" appears while the individual reels 3 to 5 are stopped whereas the stop display mode of the "reel lamp flashing A" appears after the stop of the individual reels 3 to 5. By the staging of the combination ② by the information means, it is informed to the player that the hit flag of the "replay" is erected by the lottery inside of the machine.

In the combination ③, the game starting sound 1 is generated at a game starting time, and the connective display mode of the "reel lamp extinguishing pattern 2" appears while the individual reels 3 to 5 are stopped whereas the stop display mode of the "reel lamp flashing B" appears after the stop of the individual reels 3 to 5. By the staging of the combination ③ by the information means, it is informed to the player that the hit flag of the "2 cherries" is erected by the lottery inside of the machine.

In the combination ④, the game starting sound 1 is generated at a game starting time, and the connective display mode of the "reel lamp extinguishing pattern 3" appears while the individual reels 3 to 5 are stopped whereas the stop display mode of the "reel lamp flashing C" appears after the stop of the individual reels 3 to 5. By the staging of the combination ④ by the information means, it is informed to the player that the hit flag of the "4 cherries" is erected by the lottery inside of the machine.

In the successive operations, by the individual stagings of combinations ⑤ to ⑧, it is likewise informed to the player that the individual hit flags are erected by the inner lottery. The combinations of the individual staging modes, as shown, are prepared on the basis of the following concepts.

The kinds of the game starting sounds are selected by the concept enumerated in FIG. 20A. Specifically, the sound 1 is emitted in a high frequency for the general play but in a low frequency at the time of a bonus flag erected game in which a bonus flag such as a hit flag of the "RB" or a hit flag of the "BB" is erected. On the other hand, the sound 2 is emitted in a low frequency for the general game and in a high frequency at the time of the bonus flag erected game. The player can be informed by the auditory effect listening to the game starting sound 2 of the fact that the bonus flag is possibly erected by the inner lottery, and is excited for the bonus game.

Furthermore, the kinds of the connective display modes are selected by the concept enumerated in FIG. 20B. Specifically, the connective display mode having less extinguished reels appears in a high frequency for the general game, but the connective display mode having more extinguished reels appears in a high frequency for the bonus flag erected game. The player can be informed, by grasping the event what reel the extinguishment of the reel back lamps 57*a* to 57*c* are extinguished to, by the visual sense, of whether or not the probability of erecting the bonus flag is high. The expectation for the bonus game is enhanced at every reel stops in the order of the "no reel lamp extinguishment", the reel lamp extinguishing pattern 1 (or first stop reel extinguishment)", the "reel lamp extinguishing pattern 2 (or first and second stop reel extinguishments)", and the "reel lamp extinguishing pattern 3 (or all stop reel extinguishments)".

Furthermore, the kinds of the stop display modes are selected by the concept enumerated in FIG. 20C. Specifically, the stop display mode, in which the reel lamp flashing time period is short and in which less lamps are extinguished, appears in a high frequency for the general game, but the stop display mode, in which the reel lamp flashing time period is long and in which more reels are extinguished, appears in a high frequency for the bonus flag erected game. The player can be informed by grasping the flashing states of the individual back lamps 57*a* to 57*c* of the individual reels 3 to 5 by the visual sense after the stop of all the reels, of whether or not the probability of erecting the bonus flag is high, and can feel whether the expect for the bonus game is high or not.

The probability of informing the player of the kinds of the hit flags by the combinations ① to ⑧ of the individual staging modes is predetermined according to the kinds of the hit flags, the game status and the number of inserted coins. When three coins are bet in the general game, for example, the information probability is illustrated by using the prize mode information selecting lottery probability table shown in FIG. 21. This information selecting lottery probability table is referred to when the determined prize mode is to be informed to the player in a predetermined probability, and the information selecting lottery operation is carried out at a timing successive to the prize mode probability lottery timing, as shown in FIG. 7E or FIG. 12K.

The information selecting lottery probability table enumerated in FIG. 21 corresponds to the 3-BET probability table in the prize mode table shown in FIG. 17. At the upper stage of the information selecting lottery probability table, more specifically, there are enumerated the individual values of numerical data a3 to g3 or the hit section data at the 3-BET time, as numerated in FIG. 17. On the lower stage, on the other hand, there are enumerated the individual values of the information section data for the 3-BET general game. Here, the random number generator 36 generates a random number in a range of 0 to 65535 ($=2^{16}$).

According to the table, when a random number in a range 0 to 200 is sampled by the sampling circuit 37 for determining the prize, the result of the inner lottery makes a big hit prize, and the "BB" hit flag is erected. When a random number in a range of 201 to 380 is sampled by the sampling circuit 37, the result of the inner lottery makes a medium hit prize, and the "RB" hit flag is erected. Likewise, when a random number in a range of 381 to 10,000 is sampled, either of small hit prize hit flags of the individual prizes is erected. When a random number in a range of 10,001 to 18,000 is sampled, the "replay" hit flag is erected. When a random number in a range of 18001 to 65,535 is sampled, the "blank" hit flag is erected.

When a random number in a range of 0 to 150 or 20,000 to 20,200 is sampled by the sampling circuit 37 for determining the prize, furthermore, the sound emitting means, the connection staging means and the stop staging means are individually controlled according to the staging mode combination ⑧ (as enumerated in FIG. 18) of the "BB" hit flag, so that the prize mode information of the "BB" hit flag is performed. That is, when a random number in a range of 0 to 150 is sampled so that the "BB" hit flag is erected, the prize mode of the "BB" hit flag is informed. When a random number in a range of 20,000 to 20,200 is sampled so that the "blank" hit flag is erected, furthermore, the prize mode of the "BB" hit flag is also informed. Even when a random number in a range of 151 to 200 is sampled so that the "BB" hit flag is erected, on the other hand, the random number in this range is outside of that of the information section data of the "BB" hit flag so that the prize mode of the "BB" hit flag is not informed.

That is, even when the prize mode of the "BB" hit flag is informed, the "BB" hit flag is not necessarily erected by the inner lottery. Even when the prize mode of the "BB" hit flag is not informed, furthermore, it is not necessarily established that the "BB" hit flag is not erected by the inner lottery. The prize mode of the "BB" hit flag is informed under a predetermined degree of reliability. In the case of the table shown in FIG. 20, the probability of informing the prize mode when the "BB" hit flag is erected is 151/352 or about 43% {(151 of 0 to 150)/a sum of 151 of 0 to 150 and 201 of 20000 to 20200)}. Furthermore, a probability of informing the prize mode when the "BB" hit flag is not erected is 201/352 or about 57%. As a result, the operation of informing the prize mode fails to hit at the probability of about 57%.

This prize mode information is carried out similarly in respect of the "RB" hit flag, the individual hit flags of the small hit prizes and the "replay" hit flag, too. However, the reliability of informing the prize mode needs not be made uniform for all the flags but may differ depending upon the number of inserted coins or the states of the game. According to the table shown in FIG. 21, for example, the probability of hitting the information of the "watermelon" hit flag is 390/810 or about 48%, and the probability of failing in the information is 420/810 or about 52%.

An appearance probability table in FIG. 22 enumerates the probabilities of informing the individual hit flags by the notification means through a series of flow of the game. These appearance probabilities differ depending upon the kinds of hit flags and the states of the game, and the probability of appearing the blank prize mode informing pattern is changed as P11 to P15 depending upon the states of the game.

In this case, as the kinds of states of the game, there are provided five kinds of the "RB operation", the "general game in the BB operation", the "general game", the "general game in the inner hit of RB", and the "general game in the inner hit of BB".

Notation RB signifies the aforementioned regular bonus game and in this RB game, a bonus game in which a plurality of times of high prize games constitute one set can be carried out once. The "RB operation" represents a state of game in the RB game, and either of blank or JAC hit is caused. Furthermore, notation BB signifies the aforementioned big bonus game, and in the BB game, sets of general games and the aforementioned bonus game can be carried out by a plurality of times. The "general game in the BB operation" signifies the general game in the BB game, and in the general game, a small hit prize is caused at a high probability. Furthermore, the "general game" is a state of game in which no prize is caused. The "general game in the inner hit of RB" and the "general game in the inner hit of BB" represent a general game state, in which although the RB hit flag or the BB hit flag is erected, a predetermined prize combination of symbols is neither stopped to display nor the game enters the RB game or the BB game yet.

Next, an explanation will be given of the operation of the game machine which is controlled by the micon 30 in the embodiment.

Figure 23:
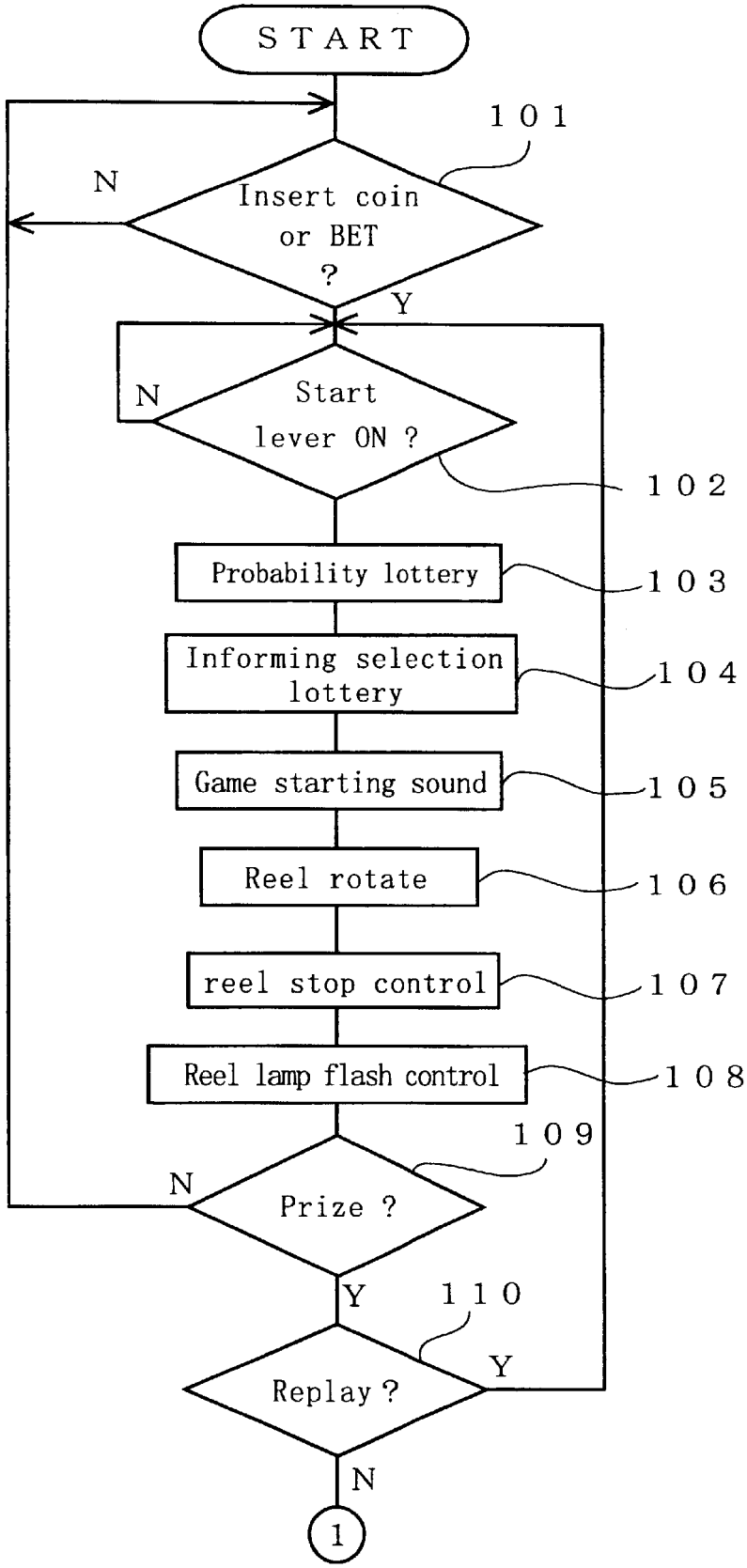
FIG. 23 is a first flowchart showing the game process of the slot machine according to the first embodiment.
Figure 24:
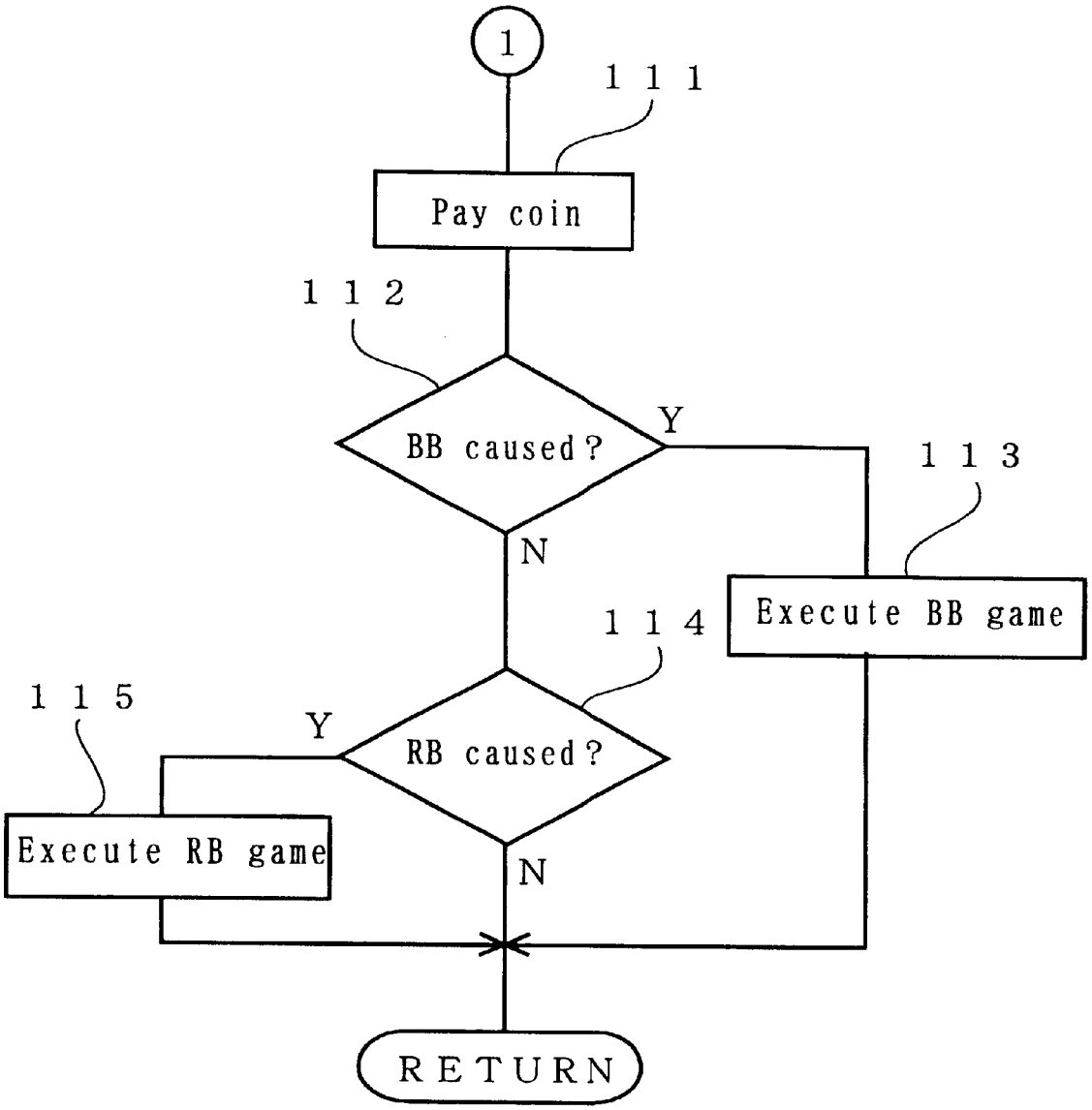
FIG. 24 is a second flowchart showing the game process of the slot machine according to the first and second embodiments.

FIGS. 23 and 24 are flowcharts showing an outline of the game process.

First of all, it is determined by the CPU 31 (as should be referred to Step 101 of FIG. 23) whether or not a coin BET has been carried out. The answer is "YES" when a coin is inserted into the coin slot 9 so that a detection signal is inputted from the coin sensor 9S or signals are inputted from the BET switches 10, 11 and 12. In this case, all the back lamps 57*a*, 57*b* and 57*c* built in the first reel 3, the second reel 4 and the third reel 5 are lighted by the control of the lamp drive circuit 48 by the CPU 31. Next, it is determined (at Step 102) whether or not a start signal has been inputted from the start switch 15S by operating the start lever 15.

When this answer is "YES", the determination of prize (or probability lottery operation) is carried out by the prize mode determining means (at Step 103). As described hereinbefore, the prize determination is made by determining which prize group in the prize probability table (as should be referred to FIG. 16) one random number generated in the random number generator 36 and specified by the sampling circuit 37 belongs to. The prize mode determined by this prize mode determining means is represented by the kind of the hit flag so that the hit flag any of the eight kinds of "blank", "replay", "2 cherries", "4 cherries", "bell", "watermelon", "RB" and "BB" is set in a predetermined region of the RAM 33.

Successive to this prize determination operation, the informing selection lottery operation of the prize mode is carried out (at Step 104). As described hereinbefore, this informing selection lottery operation of the prize mode is performed by using the informing selection lottery probability table, as shown in FIG. 21, by determining which group of the informing section data of the probability table one random number specified by the sampling circuit 37 belongs to. The result of this informing selection lottery is also written in a predetermined region of the RAM 33, and an informing flag is set at Step 104 when the prize mode is informed as a prediction. The set informing flag is to represent the kind of the informed prize mode, too.

Next, a game starting sound generation is carried out (at Step 105). This operation is carried out when the informing flag is set but otherwise not. When the informing flag is set, the speaker driving circuit 43 is controlled by the CPU 31 in accordance with the kind of the informing flag so that the game starting sound 1 or 2 is generated by the speaker 39. This game starting sound 1 or 2 is emitted from the sound emitting hole 19 formed in the lower portion of the front face of the device so that it is grasped by the auditory sense of the player.

When an informing flag of the kind of informing the hit flag of "2 cherries" is erected, for example, the game starting sound 1 is generated according to the staging mode combination ③, as enumerated in FIG. 19. When the informing flag of the kind of informing the hit flag "BB", on the other hand, the game starting sound 2 is generated according to the staging mode combination ⑧.

Figure 25:
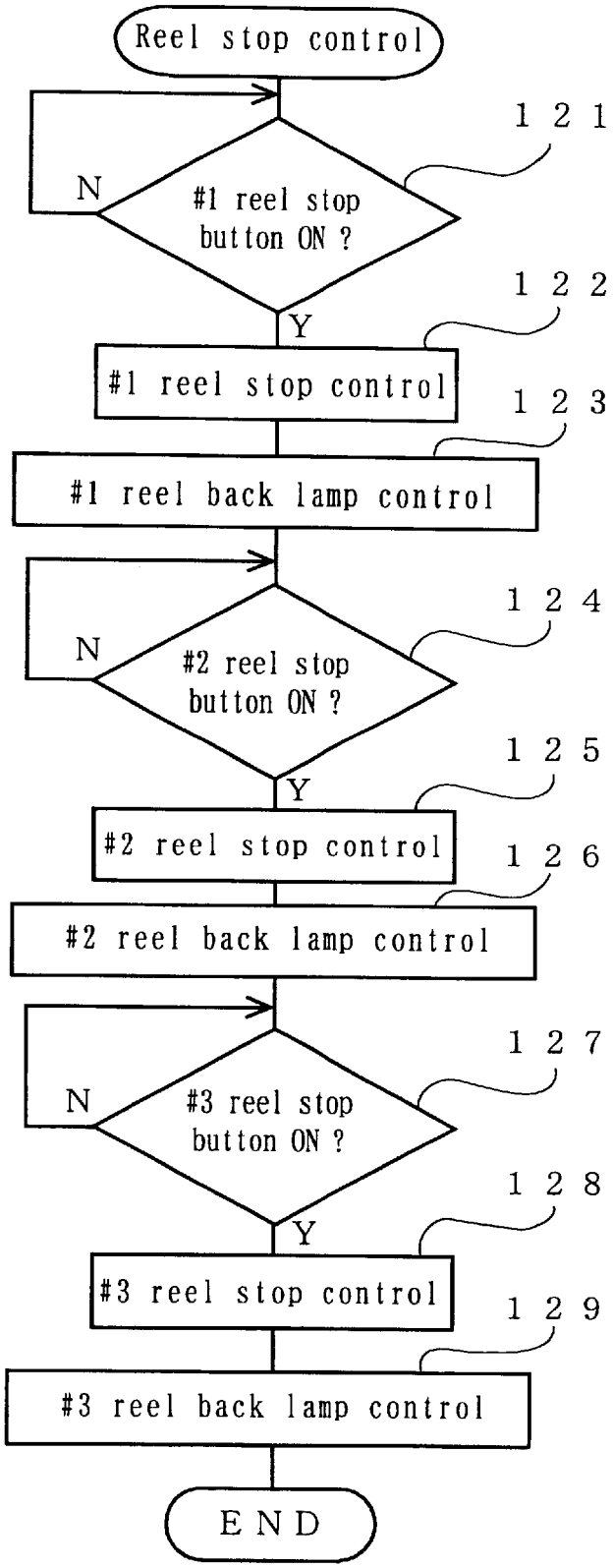
FIG. 25 is a flowchart showing the content of the routine of the reel stop control shown in FIG. 23.

Next, an operation of rotating the first reel 3, the second reel 4 and the third reel 5 is carried out (at Step 106) so that these reels 3, 4 and 5 are rotated altogether. Successive to this reel rotating operation, a control of stopping the individual reels 3, 4 and 5 is carried out (at Step 107). An outline of this reel stop control processing is shown in a flowchart of FIG. 25.

As mentioned hereinbefore, the operation of the individual stop buttons 16 to 18 by the player is detected by the CPU 31 through the reel stop signal circuit 45. When the ON operation of the first reel stop button 16 is detected at Step 121 of FIG. 25, the stop control operation of the first reel 3 is carried out (at Step 122). That is, at a time point at which the first reel stop button 16 is operated by the player, the number of drive pulses supplied to the stepping motor 55 of the first reel 3 is read from the RAM 33 and is made to correspond to the rotational position of the first reel 3. When the rotational position of the first reel 3 is known, three symbols appearing in the observation window 6 are grasped as symbol codes by referring to the symbol table (as should be referred to FIG. 18).

In this case, when the hit flag of the big hit is erected, it is checked whether or not there is the symbol constituting the big hit is present on the effective prize line of the observation window 6. Similarly, when the hit flag of the medium hit or the small hit is erected, it is checked whether or not there is the symbol constituting the medium hit or the small hit is present on the effective prize line of the observation window 6. When the symbol corresponding to the hit flag is present on the effective prize line, the CPU 31 immediately stops the first reel 3. Considering that the first reel 3 cannot be stopped instantaneously, furthermore, the processing may be carried out at several Steps before the rotational position of the reel.

When a symbol corresponding to the hit flag is not found on the effective prize line of the observation window 6 by the aforementioned check operation, it is checked what symbol appears when the first reel 3 is further rotated by four symbols. When a symbol corresponding to the hit flag is present on the effective prize line, the first reel 3 is rotated to the position of the symbol and is stopped there. This drawing control operation is also carried out in the individual stop control operations of the second reel 4 and the third reel 5, as will be described hereinafter.

Next, an operation of controlling the back lamps of the first reel is carried out (at Step 123). The control operation is carried out when the informing flag is set by the aforementioned informing selection lottery operation of Step 104. When the informing flag is set, the back lamps 57*a* to 57*c* built in the first reel 3 are controlled to light in accordance with the staging mode combinations ① to ⑧ corresponding to the kinds of informing flags.

In case an information flag of the kind for informing the hit flag of "2 cherries" is erected, for example, the back lamps 57*a* to 57*c* of the first reel 3 are controlled to extinguish, as shown in FIG. 10B, in accordance with the connective display mode of the staging mode combination ③. In case an information flag of the kind for informing the hit flag of the "BB" is erected, on the other hand, the back lamps 57*a* to 57*c* of the first reel 3 are controlled to extinguish, as shown in FIG. 11B, in accordance with the connective display mode of the staging mode combination ⑧. At this time, the second reel 4 and the third reel 5 are rotating so that the individual back lamps 57*a* to 57*c* of the individual reels 4 and 5 are lighted.

Next, it is detected (at Step 124) whether or not the stop button 17 of the second reel 4 is operated and when the ON operation of the stop button 17 is detected, the stop control operation of the second reel 4 is carried out (at Step 125). In this stop control operation, in a state of rotating the second reel 4, firstly, assuming that symbols of 21 ways having the code numbers of 0 to 20 are stopped on the prize line L1 at the center of the observation window 7, a combination with the symbol of the first reel 3 which has already been stopped on the effective prize line is read. Further, in respect of the third reel 5, a rotation code representing that the third reel 5 is rotating is read. Although the second reel 4 is also rotating, furthermore, its rotation code is not read because it is assumed that the second reel 4 is to be stopped by the aforementioned operation.

When a combination of symbol codes is read in this way, the aforementioned prize symbol combination table is referred to, in respect of the symbol determined by stopping the first reel 3, and what prize may be caused on the effective prize line when the second reel 4 is stopped at the 21 ways of rotational positions is successively determined. When the first reel 3 is topped, for example, as shown in FIG. 26A, the symbol combination pattern at this time is checked imagining the 21 ways of the stop positions of the second reel 4. When the second reel 4 is stopped at a code number "5", for example, as shown in FIG. 26B, the combination of symbols on the individual prize lines L1, L2A, L2B, L3A and L3B is as shown in FIG. 26C.

An arrow mark of the third reel 5 designates a rotation code indicating that the reel is rotating, and depending on the position of stopping the third reel, there are possibilities of causing a big hit prize of "A-A-A" on the prize line L1 and a small hit prize of "E-E-E" on the prize line L2B. In respect of the code number "5" of the second reel 4, as shown in FIG. 27, therefore, a prediction flag of the big hit and a prediction flag of the small hit are set. The presence or absence of the prediction flag is checked with respect to all the code numbers of the second reel 4, and these data are written in the RAM 33.

In this way, the prediction flag data written in the RAM 33 are referred to controlling to stop the second reel 4. That is, when the stop button 17 of the second reel 4 is operated, prediction flags corresponding to the code numbers of the second reel 4 are referred to. When a prediction of the big hit is caused, the control of stopping the second reel 4 is executed such that the symbol of the big hit is stopped on the effective prize line.

When the aforementioned reel stop control operation of Step 125 was finished, an operation of controlling the back lamps of the second reel is then carried out (at Step 126). This control operation is also carried out when the informing flag is set at the aforementioned informing selection lottery operation of Step 104. When the informing flag was set, the back lamps 57*a* to 57*c* built in the second reel 4 are controlled to light in accordance with the staging mode combinations ① to ⑧ corresponding to the kinds of the informing flags.

In case an information flag of the kind for informing the hit flag of "2 cherries" is erected, for example, the back lamps 57*a* to 57*c* of the second reel 4 are controlled to extinguish, as shown in FIG. 10C, in accordance with the connective display mode of the staging mode combination ③. As a result, the individual back lamps 57*a* to 57*c* of the first reel 3 and the second reel 4 are continuously controlled to extinguish. In case an information flag of the kind for informing the hit flag of the "BB" is erected, on the other hand, the back lamps 57*a* to 57*c* of the second reel 4 are controlled to extinguish, as shown in FIG. 11C, in accordance with the connective display mode of the staging mode combination ⑧. As a result, the individual back lamps 57*a* to 57*c* of the first reel 3 and the second reel 4 are also continuously controlled to extinguish. At this time, the third reel 5 is rotating so that the individual back lamps 57*a* to 57*c* of the third reel 5 are lighted.

Next, it is detected (at Step 127) whether or not the stop button 18 of the third reel 5 is turned ON. When the stop button 18 is turned ON, the operation of controlling to stop the third reel 5 is carried out (at Step 128). In this stop control operation, the first reel 3 and the second reel 4 have already been stopped, and a combination of symbols is specified. Therefore, a possibility of prize is determined with regard to the combination of symbols for each of the code numbers of the third reel 5, and a prize prediction flag is erected like the table shown in FIG. 27.

The prediction flag data are also referred to when the stop button 18 of the third reel 5 is operated. When a big hit prediction is established, the control of stopping the third reel 5 is executed such that the big hit symbol is stopped on the effective prize line. In the control to stop the third reel 5, the position of stopping the reel is controlled such that not only a prize according to the hit flag is obtained by a combination with the symbols of the first reel 3 and the second reel 4 already stopped but also a prize different from the hit flag is not obtained.

By the operation of controlling to stop the first reel at Step 122, by the operation of controlling to stop the second reel at Step 125 and by the operation of controlling to stop the third reel at Step 128, as described hereinbefore, when the hit flag is the "blank", the individual reels 3 to 5 are controlled to stop such that no prize combination of the symbols is not set on any of the effective prize lines.

When the hit flag is the "2 cherries", furthermore, the individual reels 3 to 5 are controlled to stop such that the combination of the symbols "cherry" is set on any of the effective prize lines. When the hit flag is the "4 cherries", on the other hand, the individual reels 3 to 5 are controlled to stop such that the combination of symbols "cherry" is set on any two of the individual prize lines. When the hit flag is the "bell" or "watermelon", on the other hand, the individual reels 3 to 5 are controlled to stop such that the combination of symbols "bell" or "watermelon" is set on any of the effective prize lines.

When the hit flag is the "RB" or "BB", on the other hand, the individual reels 3 to 5 are controlled to stop such that a set of symbols "7" or predetermined character symbols is made on any of the prize lines.

Next, when the operation of controlling to stop the reels was finished, the control operation of the back lamps of the third reel is carried out (at Step 129). This control operation is also executed when the informing flag is set in the aforementioned informing selection lottery operation at Step 104. When the informing flag is set, the back lamps 57*a* to 57*c* are controlled to light in accordance with the staging mode combinations ① to ⑧ corresponding to the kinds of the informing flags.

In case an information flag of the kind for informing the hit flag of the "2 cherries" is erected, the back lamps 57*a* to 57*c* of the third reel 5 are kept lighted, as shown in FIG. 10D, in accordance with the connective display mode of the staging mode combination ③. In connection with the operations of the individual stop buttons 16, 17 and 18, therefore, the individual back lamps 57*a* to 57*c* of the first reel 3, the second reel 4 and the third reel 5 are "extinguished, extinguished and lighted". In case an information flag of the kind for informing the hit flag of the "BB" is erected, the back lamps 57*a* to 57*c* of the third reel 5 are controlled to extinguish, as shown in FIG. 11D, in accordance with the connective display mode of the staging mode combination ⑧. In connection with the operations of the individual stop buttons 16, 17 and 18, therefore, the individual back lamps 57*a* to 57*c* of the first reel 3, the second reel 4 and the third reel 5 are "extinguished, extinguished and extinguished".

When the reel stop controlling operation of Step 107 of FIG. 22 is ended, a reel lamp flashing control is then carried out (at Step 108 of FIG. 23). This reel lamp flash controlling operation is also executed in case the information flag is set in the information selection lottery operation of Step 104. When the information flag is set, the individual back lamps 57*a* to 57*c* built in the first reel 3, the second reel 4 and the third reel 5 are controlled to light in accordance with any of the staging mode combinations ① to ⑧ corresponding to the kinds of the information flags.

In case an information flag of the kind for informing the hit prize of the "2 cherries" is erected, for example, the individual back lamps 57*a* to 57*c* of the individual reels 3 to 5 are controlled to light according to the stop display mode of the "reel lamp flashing B" in accordance with the stop display mode of the staging mode combination ③. After the stop of all the individual reels 3 to 5, as has been described hereinbefore, all the back lamps 57*a* to 57*c* of the individual reels 3 to 5 are lighted, as shown in FIG. 15A. Successively, the individual back lamps 57*b* of the medium stage of the first reel 3, the second reel 4 and the third reel 5 are sequentially extinguished, as shown in FIGS. 15B, 15C and 15D, and all the back lamps 57*a* to 57*c* are finally lighted, as shown in FIG. 15E.

In case an information flag of the kind for informing the hit flag of the "BB" is erected, on the other hand, the individual back lamps 57*a* to 57*c* of the individual reels 3 to 5 are controlled to light in the stop display mode of the "reel lamp flashing C" in accordance with the stop display mode of the staging mode combination ⑧. In this stop display mode, as has been described hereinbefore, the back lamps 57*a* to 57*c* of the middle second reel 4 are lighted one by one from the upper stage to the lower stage, as shown in FIGS. 16A, 16B and 16C. Next, the individual back lamps 57*a* to 57*c* of the first reel 3 and the third reel 5 on the two sides are lighted by every two from the lower stage to the upper stage, as shown in FIGS. 16D, 16E and 16F.

Next, it is determined with reference to the prize symbol combination table (FIG. 23, at Step 109) whether or not the display in stopping all the reels constitutes a predetermined prize combination of symbols. That is, the reel stop control is not carried out entirely by the machine, but the timings of operating the individual stop buttons 16 to 18 by the player matter. Even in case a prize hit flag is erected as a result of the inner lottery, therefore, the prize combination of symbols is not set on the effective prize line, and no prize is awarded, unless the stop buttons 16 to 18 are operated at predetermined timings. This is because the draw control is limited by the four symbols so that the expected combination of prize symbols cannot be achieved in case no prize symbol is present in the four symbols.

When the prize is not awarded, the answer of Step 109 is "NO", and the operation returns to the initial Step 101. In the case of a replay game (or play again) as a result of the determination of prize, the processing returns to that of waiting for the operation of the start lever 15 of Step 102 (at Step 110). In the case of a prize except that for a replay, the hopper drive circuit 41 is controlled by the CPU 31, and a predetermined number of coins are paid out to the coin tray 20 by the hopper 38(at Step 111 of FIG. 24).

For example, two coins are paid out in the case of the small hit prize of "2 cherries", and four coins are paid out in the case of the small hit prize of "4 cherries". Furthermore, six coins are paid out in the case of the small hit prize of "bell", and eight coins are paid out in the case of the small hit prize of "watermelon". In the case of the big hit prize of "BB" or "RB", furthermore, fifteen coins are paid out.

Next, it is determined (at Step 112) whether or not the BB game is caused. When this BB game is caused, it is carried out (at Step 113). When the BB game is not caused, it is then determined (at Step 114) whether or not the RB game is caused. When the RB game is caused, it is carried out (at Step 115). After this, the operations thus far described are repeated to carry out the game of the slot machine.

According to this embodiment, the prize mode determined by the inner lottery is informed to the player through a series of flow of the slot machine game. Specifically, the player is informed of the prize mode by the combination of the kinds of the game starting sounds which are generated by the sound emitting means when the rotation of the individual reels 3 to 5 is stated, the kinds of the display modes of the individual back lamps 57*a* to 57*c* which are successively staged by the connection staging means in connection with the stop of the individual reels 3 to 5, and the kinds of the display modes of the individual back lamps 57*a* to 57*c* which are staged by the stop staging means when all the individual reels 3 to 5 are stopped.

In the aforementioned staging display mode ③, for example, the player listens to the game starting sound 1 at the time of operating the start lever 15, visually grasps that the individual back lamps 57*a* to 57*c* are extinguished, extinguished and lighted in the midst of the individual operations of stopping the first reel 3, the second reel 4 and the third reel 5, and visually grasps that the individual back lamps 57*a* displays the stop in the mode of the reel lamp flashing B after all the reels 3 to 5 were stopped.

In this series of flow of the game, the player grasps, by the auditory effect of the game starting sound 1, that the blank or the small hit prize are caused at a high probability whereas the RB and BB flags are erected at a low probability, as shown in FIG. 28A. The player is informed, by the following visual effect of the fact that the individual reels 3, 4 and 5 are extinguished, extinguished and lighted, of the fact that a small hit prize flag of the "2 cherries" is erected. Moreover, the player confirms that the hit flag of the "2 cherries" is erected by the visual effect of the final reel lamp flashing B.

In the aforementioned staging display mode ⑧, on the other hand, the player listens to the game starting sound 2 at the time of operating the start lever 15, visually grasps that the individual back lamps 57*a* to 57*c* are extinguished, extinguished and extinguished in the midst of the individual operations of stopping the first reel 3, the second reel 4 and the third reel 5, and visually grasps that the individual back lamps 57*a* displays the stop in the mode of the reel lamp flashing C after all the reels 3 to 5 were stopped.

In this series of flow of the game, the player grasps, by the auditory effect of the game starting sound 2, that the prize mode is a blank or a small hit at a low probability whereas the RB and BB flags are erected at a high probability, as shown in FIG. 28B. Furthermore, the player is excited to expect the erection of the RB and BB flags. Next, the expectation for the BB flag erection is further enhanced by the visual effect that the back lamps 57*a* to 57*c* are extinguished at the stop of the first reel 3, and the expectation for the BB flag erection is then enhanced to the maximum by the visual effect that the back lamps 57*a* to 57*c* are extinguished at the stop of the second reel 4. Finally, it is informed by the visual effect of the extinguishment of the third reel 5 that the BB flag is erected by the inner lottery. By the final visual effect of the reel lamp flashing C, furthermore, the player confirms the erection of the BB flag to enjoy the flashing pattern of the reel lamp flashing C.

In this embodiment, the prize mode becomes clear as the game advances, as described hereinbefore. Specifically, the rotation of the individual reels 3 to 5 is started by operating the start lever 15 and is successively stopped by operating the individual stop buttons 16 to 18 so that the kind of the hit flag is successively informed to the player as the rotation of all the reels 3 to 5 is stopped. Therefore, the player is gradually informed of what prize mode is determined by the inner lottery, as the operations advance. Unlike the mere information of the inner lottery result, the player is excited by the prize mode which is made clearer as the operations go the farther. As a result, the operation of the start lever 15 and the operations of the individual stop buttons 16 to 18 become more and more pleasant.

Moreover, even a beginner of the game, who cannot not decide the erection of the BB hit flag or the RB hit flag by the hit of the reach spot, can make some decision by the aforementioned auditory effect and visual effect to reduce the resistance of a person who keeps himself away of the game of the reel type game machine while feeling its difficult.

On the other hand, the information of the prize mode is made not to all the inner lottery results but at a predetermined probability, as enumerated in the information selecting lottery probability table (as should be referred to FIG. 21). A prize mode different from that determined by the prize mode determining means may be informed at a predetermined probability. In case a blank prize mode is determined by the prize mode determining means so that the blank hit flag is erected, an prize mode of the BB hit flag may be informed. As a result, the prize mode may or may not be informed to the player. Thus, the information of the prize mode is expected by the player so that the pleasure is raised, if the prize mode is informed, and further raised in the stop button operation.

On the other hand, the information is made not only to the big hit prize mode but also to each prize mode so that the player can be informed of the inner lottery result other than the big hit prize. As a result, the operation of the stop button can be facilitated.

Here will be described a second embodiment in which the game machine of the invention is applied to a slot machine.

Figure 29:
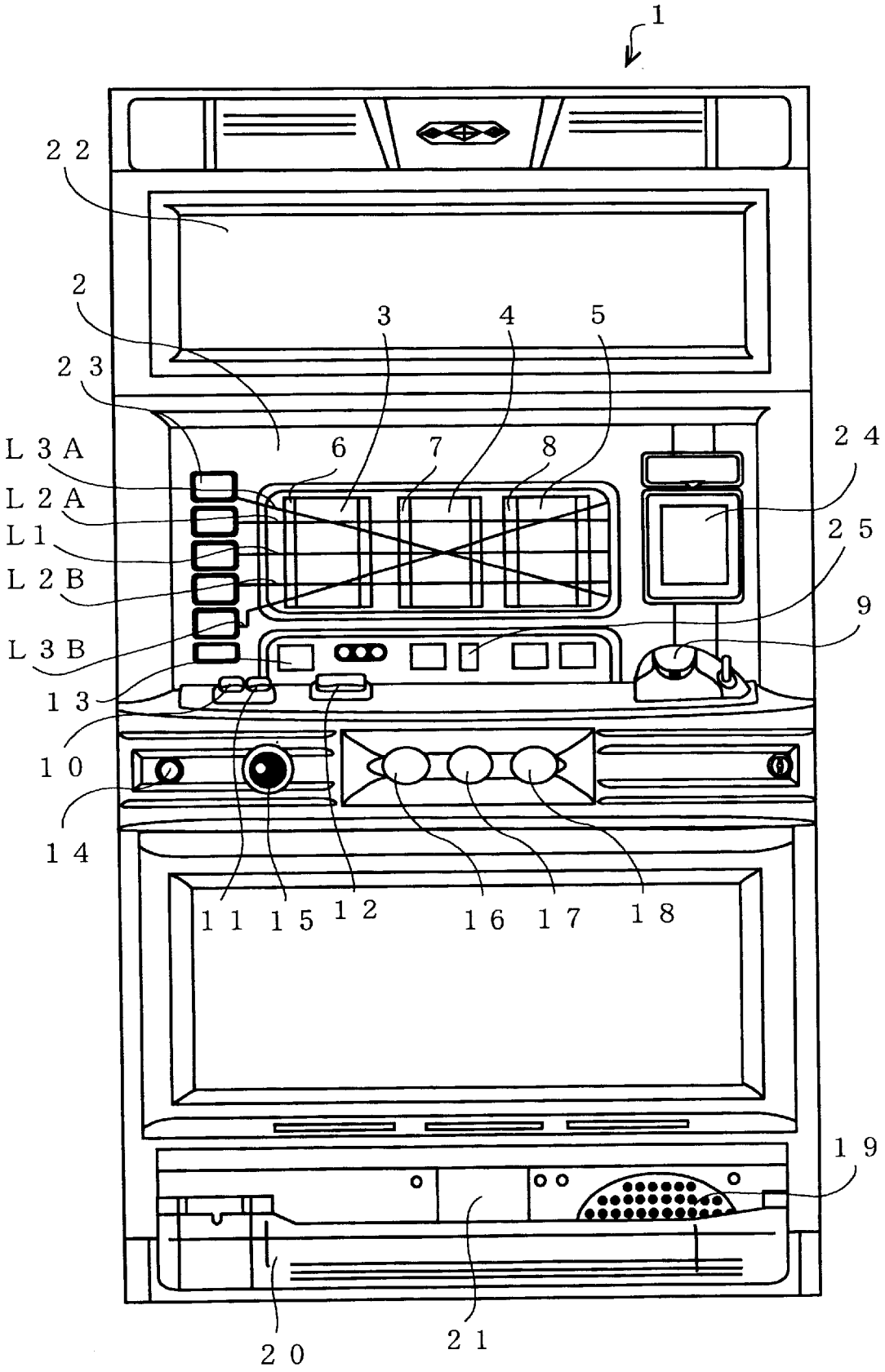
FIG. 29 is a front view showing an outlook of the slot machine according to the second embodiment of the invention.

FIG. 29 is front view of the slot machine 1 according to the second embodiment. In FIG. 29, furthermore, the same or corresponding portions as or to those in FIG. 2 are attached with the same notations, and their explanation will be omitted. The slot machine according to the second embodiment is installed with a notification lamp on the front panel 2 right under the individual reels 3, 4 and 5. The notification lamp 25 is lighted, when the inner hit flag of BB or RB game is erected so that a later-described predetermined condition is established, and notifies the player of the fact that the bonus game is hit by the lottery inside of the machine.

Figure 30:
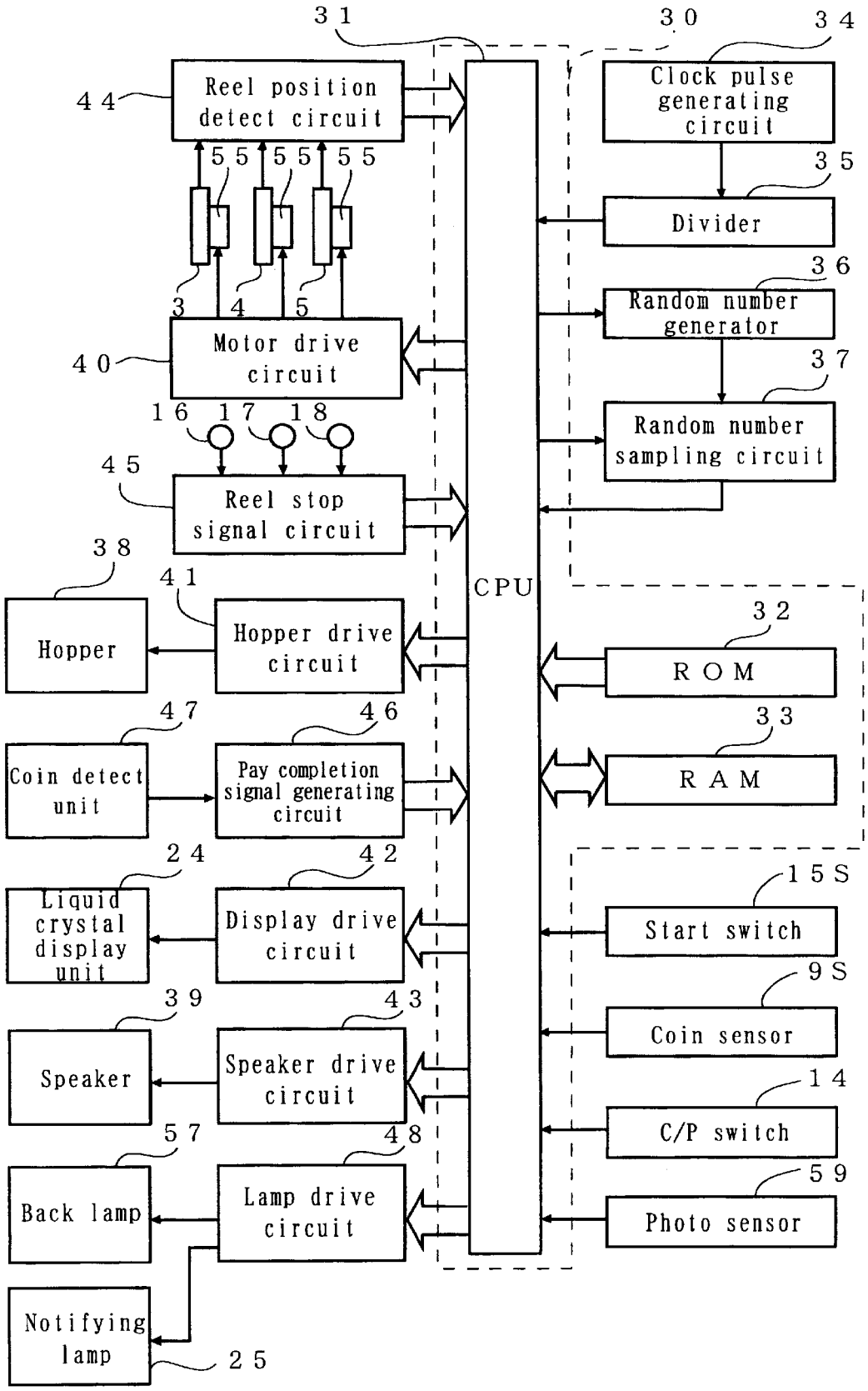
FIG. 30 is a block diagram showing a constitution of the principal control circuits of the slot machine shown in FIG. 29.

FIG. 30 shows a circuit construction including a control unit for controlling the operation of processing the game in the slot machine 1 according to the second embodiment, and peripheral devices (or actuators) electrically connected with the control unit. Here, the same or corresponding portions in FIG. 30 as or to those of FIG. 6 are attached with the same notations, and their explanation will be omitted. In the slot machine according to the second embodiment, the notification lamp 25 is connected with the lamp drive circuit 48 so that it is driven by the lamp drive circuit 48.

In this embodiment, too, the speaker 39, the speaker drive 43 and the micon 30 constitute the sound emitting means for generating either of two kinds of game starting sounds 1 and 2 as the effective sounds when the rotation display of the individual reels 3 to 5 is started by the start lever 15. The timings at which the individual game starting sounds 1 and 2 are emitted are illustrated in FIG. 7. The kinds of the game starting sounds to be generated by the sound emitting means are selected according to the kinds of the prize modes, as will be described hereinafter.

Furthermore, the lamp drive circuit 48, the back lamps 57*a* to 57*c* and the micon 30 constitute connective staging means for staging the displays of the individual reels 3 to 5 successively in one of four kinds of display modes in connection with the rotation displays of the individual reels 3 to 5 by operating the individual stop buttons 16 to 18. The display modes to be staged by this connective staging means are selected according to the kinds of the prize modes, as will be described hereinafter.

In this embodiment, too, the first, second, third and fourth connective display modes to be staged by the connective staging means are shown in FIGS. 8, 9, 10 and 11. Moreover, the aforementioned sound emitting means generates effective sounds of predetermined kinds and durations each time the displays of the reels 3 to 5 of the individual columns are staged by the connective staging means. For example, the sound emitting means emits reel stop sounds 1 to 4 having four kinds of durations in accordance with the reel stop sound selection table, as enumerated in FIG. 31.

That is, the reel stop sound 1 is selected in case the back lamps 57 of the reel requested to stop are requested to light when the operation of the first stop button is detected, and the reel stop sound 2 is selected when the back lamps are requested to extinguish. Furthermore, the reel stop sound 1 is selected in case the back lamps 57 of the reel requested to stop are requested to light when the operation of the second stop button is detected, and the reel stop sound 3 is selected when the back lamps are requested to extinguish. Furthermore, the reel stop sound 1 is selected in case the back lamps 57 of the reel requested to stop are requested to light when the operation of the third stop button is detected, and the reel stop sound 4 is selected when the back lamps are requested to extinguish.

FIGS. 32A to 32C show timing charts of emitting the reel stop sound 1. This reel stop sound 1 is a single sound having a duration of 327.60 (ms), as shown in FIG. 32B. The emission of the sound is timed to the instant when there is no request for extinguishing the back lamps 57 of any of the reels 3 to 5 that is requested to stop, as shown in FIG. 32A, at a timing of the detecting operation of any of the stop buttons 16 to 18 shown in FIG. 32C. Furthermore, the extinguishment of the reel stop sound is timed to the instant when a time period of 327.60 (ms) has elapsed from the sound emitting timing or when the operation of a successive one of the stop buttons is detected before lapse of the time period.

For example, when the operation of the second stop button is detected before lapse of the time period of 327.60 (ms) from the detection of the operation of the first stop button, as shown in FIG. 33D, the reel stop sound 1 shown in FIG. 33B is extinguished. FIG. 33C represents the reel stop sound which is successively selected and the duration of which is varied between 327.60 and 589.68 (ms) depending on the kind of the selected one of the reel stop sounds 1 to 4. Furthermore, FIG. 33A shows a state, in which the back lamps 57 of a reel requested to stop is lighted by operating the first stop button.

FIGS. 34A to 34C show timing charts of emitting the reel stop sound 2. As shown in FIG. 34B, the reel stop sound 2 is a single sound having a duration of 393.12 (ms). The emission of the sound is timed to the instant when the back lamps 57 of any of the reels 3 to 5 requested by the first stop request are requested to extinguish, as shown in FIG. 34A, at the timing of the detecting operation of the stop button shown in FIG. 34C. Furthermore, the extinguishment of the reel stop sound 2 is timed to the instant when a time period of 393.12 (ms) has elapsed from the sound emitting timing or when the operation of a successive one of the stop buttons is detected before lapse of the time period.

For example, when the operation of the second stop button is detected before lapse of the time period of 393.12 (ms) from the detection of the operation of the first stop button, as shown in FIG. 35D, the reel stop sound 2 shown in FIG. 35B is extinguished. FIG. 35C represents the reel stop sound which is successively selected and the duration of which is varied between 327.60 and 589.68 (ms) depending on the kind of the selected one of the reel stop sounds 1 to 4. Furthermore, FIG. 35A shows a state in which the back lamps 57 of the first stop reel requested to stop by operating the first stop button are lighted.

FIGS. 36A to 36C show timing charts of emitting the reel stop sound 3. As shown in FIG. 36B, the reel stop sound 3 is a single sound having a duration of 499.59 (ms). The emission of the sound is timed to the instant when the back lamps 57 of any of the reels 3 to 5 requested by the second stop request are requested to extinguish, as shown in FIG. 36A, at the timing of the detecting operation of the stop button shown in FIG. 36C. Furthermore, the extinguishment of the reel stop sound 3 is timed to the instant when a time period of 499.59 (ms) has elapsed from the sound emitting timing or when the operation of a successive one of the stop buttons is detected before lapse of the time period.

For example, when the operation of the second stop button is detected before lapse of the time period of 499.59 (ms) from the detection of the operation of the third stop button, as shown in FIG. 37D, the reel stop sound 3 shown in FIG. 37B is extinguished. FIG. 37C represents the reel stop sound which is successively selected and the duration of which is varied between 327.60 and 589.68 (ms) depending on the kind of the selected one of the reel stop sounds 1 to 4. Furthermore, FIG. 37A shows a state in which the back lamps 57 of the second stop reel requested to stop by operating the second stop button are lighted.

FIGS. 38A to 38C show timing charts of emitting the reel stop sound 4. As shown in FIG. 38B, the reel stop sound 4 is a single sound having a duration of 589.68 (ms). The emission of the sound is timed to the instant when the back lamps 57 of any of the reels 3 to 5 requested by the third stop request are requested to extinguish, as shown in FIG. 38A, at the timing of the detecting operation of the stop button shown in FIG. 38C. Furthermore, the extinguishment of the reel stop sound 3 is timed to the instant when a time period of 589.68 (ms) has elapsed from the sound emitting timing or when the operation of a successive one of the stop buttons is detected before lapse of the time period.

Furthermore, the sound emitting means may emit any of four kinds of reel stop sounds 1 to 4 at each time of staging the display of each column of the reels 3 to 5 by connective staging means in accordance with the reel stop selecting table shown in FIG. 39.

That is, in case the operation of the first stop button is detected, a sound scale "do" is selected as the reel stop sound 1 when the back lamps 57 of a reel requested to stop are requested to light, and a sound scale "re" is selected as the reel stop sound 2 when the back lamps 57 are requested to extinguish. Furthermore, in case the operation of the second stop button is detected, a sound scale "do" is selected as the reel stop sound 1 when the back lamps 57 of a reel requested to stop are requested to light, and a sound scale "mi" is selected as the reel stop sound 3 when the back lamps 57 are requested to extinguish. Furthermore, in case the operation of the third stop button is detected, a sound scale "do" is selected as the reel stop sound 1 when the back lamps 57 of a reel requested to stop are requested to light, and a sound scale "fa" is selected as the reel stop sound 4 when the back lamps 57 are requested to extinguish.

Furthermore, the lamp drive circuit 48, the back lamps 57*a* to 57*c* and the micon 30 also constitute stop staging means for staging the displays of the individual reels 3 to 5 in one of ten kinds of display modes when all the rotation displays of the individual reels 3 to 5 are stopped. The display modes to be staged by this stop staging means are selected according to the kinds of the prize modes, as will be described hereinafter.

FIGS. 40 to 53 show one example of ten kinds of stop display modes to be staged by the stop staging means according to this second embodiment. Notations (1), (2) and (3) in the column "flashing pattern" of those Figures designate the individual back lamps 57*a* of the reels 3, 4 and 5; notations (4), (5) and (6) the individual back lamps 57*b* of the reels 3, 4 and 5; and notations (7), (8) and (9) the back lamps 57*c* of the reels 3, 4 and 5. Furthermore, the hatched portions indicate a lamp lighted state, and the blank portions indicate the lamp extinguished state. Furthermore, the "stage" columns of the Figures indicate the elapsing stages of time so that the individual back lamps 57*a* to 57*c* are lighted or extinguished, as shown, at every stages.

The display mode of the "no reel lamp flashing" or the first stop display mode is not shown, but the stop staging means keeps all the back lamps 57*a* to 57*c* of the individual reels 3 to 5 lighted when all the reels 3 to 5 are stopped but does not control them to flash.

The second stop display mode shown in FIG. 40 is that of the "reel lamp flashing pattern 1", and the stop staging means extinguishes all the back lamps 57*a* of the individual reels 3 to 5, as shown at a stage 1 in FIG. 40, when all the reels 3 to 5 are stopped. Successively, as shown at a stage 2, the stop staging means lights the individual back lamps 57*a* to 57*c* of the first reel 3 and then lights the individual back lamps 57*a* to 57*c* of the second reel 4, as shown at a stage 3. After this, the stop staging means lights the individual back lamps 57*a* to 57*c* of the third reel 5 and then lights all the back lamps 57*a* to 57*c* of the individual reels 3 to 5, as shown at a stage 4.

The third stop display mode shown in FIG. 41 is that of the "reel lamp flashing pattern 2". The stop staging means extinguishes at first all the back lamps 57*a* of the individual reels 3 to 5, as shown at the stage 1 in FIG. 41, when all the reels 3 to 5 are stopped. Successively, the stop staging means lights the individual back lamps 57*b* of the first reel 3 and the third reel 5, as shown at the stage 2, and then lights the back lamps 57*a* of the first reel 3 and the back lamps 57*c* of the third reel 5, as shown at the stage 3. After this, the stop staging means lights the individual back lamps 57*a* and 57*c* of the second reel 4, as shown at the stage 4, and then lights the back lamps 57*c* of the first reel and the back lamps 57*a* of the third reel 5, as shown at a stage 5. Finally, the stop staging means lights the back lamps 57*b* of the first reel 3 and the back lamps 57*b* of the third reel 5, as shown at a stage 6.

The fourth stop display mode shown in FIG. 42 is that of the "reel lamp flashing pattern 3". The stop staging means extinguishes at first all the back lamps 57*a* of the individual reels 3 to 5, as shown at the stage 1 in FIG. 42, when all the reels 3 to 5 are stopped. Successively, the stop staging means lights the back lamps 57*b* of the first reel 3, as shown at the stage 2. and then lights the back lamps 57*a* of the second reel 4, as shown at the stage 3. After this, the stop staging means lights the back lamps 57*c* of the second reel 4, as shown at the stage 4, and then lights the back lamps 57*b* of the third reel 5, as shown at the stage 5. Finally, the stop staging means extinguishes all the back lamps 57*a* to 57*c* of the individual 5 reels 3 to 5, as shown at the stage 6.

The fifth stop display mode of the stages 1 to 13, as shown in FIGS. 43 and 44, are those of the "reel lamp flashing pattern 4", and the sixth stop display mode of the stages 1 to 11, as shown in FIG. 45, are those of the "reel lamp flashing pattern 5". The seventh stop display mode of the stages 1 to 6, as shown in FIG. 46, are those of the "reel lamp flashing pattern 6", and the eighth stop display mode of the stages 1 to 21, as shown in FIGS. 47, 48 and 49, are those of the "reel lamp flashing pattern 7". Furthermore, the ninth stop display mode of the stages 1 to 12, as shown in FIG. 50, are those of the "reel lamp flashing pattern 8", and the tenth stop display mode of the stages 1 to 28, as shown in FIGS. 51, 52 and 53, are those of the "reel lamp flashing pattern 9".

In the reel lamp flashing patterns of FIGS. 43 to 53, the individual back lamps 57*a* to 57*c* of the individual reels 3 to 5 are controlled to flash by the stop staging means in accordance with the reading method similar to that of the reel lamp flashing patterns of FIGS. 40 to 42.

The ROM 32, as shown in FIG. 30, is stored in its segments, as in the first embodiment, with not only the game processing routine to be executed in the slot machine 1 as a sequence program, but also the prize probability table, the symbol table, the prize symbol combination table, the demonstration lottery table selecting table, the demonstration lottery table and the aforementioned reel stop sound selecting table, as shown in FIG. 31 or 39.

The prize probability table constitutes, as in the first embodiment, random number classifying means for classifying the random number, as illustrated by the sampling circuit 37, into the individual prize modes, as shown in FIG. 17. Here, the random number generator 36, the sampling circuit 37, the prize probability table and the micon 30 also constitute prize mode determining means. Furthermore, the symbol table is conceptionally shown in FIG. 18 as in the first embodiment. Furthermore, the prize symbol combination table is constituted as in the first embodiment.

Furthermore, the demonstration lottery table selecting table and the demonstration lottery table constitute information mode selecting means for selecting the combination of the kinds of the game starting sounds, the kinds of the connective display modes and the kinds of the stop display modes in accordance with the prize mode which is determined by the aforementioned prize mode determining means. Furthermore, the information mode selecting means, the sound emitting means, the connective staging means and the stop staging means constitute information means for informing the player of a prize mode at a predetermined probability through a series of flow of the slot machine game. The selection lottery operation of the information mode by the information mode selecting means is timed successive to the prize mode probability lottery timing, as shown in FIG. 7E or 12K.

The demonstration lottery table selecting table shown in FIG. 54 is provided for selecting the demonstration lottery tables of No. 0 to No. 17 shown in FIGS. 55 to 57 from a game state and a hit flag. The game state becomes clear by referring to a storing region of the game level status (GMLVSTS) shown in FIG. 58A. The GMLVSTS storing region is stored as data of 1 byte in the RAM 33. The game state is stored at 0 to 4 bits, and the game state, as turned ON by setting the data to 1, is one of that time. As indicated by GMLVSTS, according to the kind of the game state, there are five kinds of the "RB operation", the "BB operation", the "general game", the "inner hit of RB" and the "inner hit of BB".

The hit flag becomes clear by referring to the storing region of the flag counter (FLGCTR) shown in FIG. 58B. This FLGCTR storing region is also stored as data of 1 byte in the RAM 33. The hit flag of that time is indicated by 1 byte data of 00 to 07 of hexadecimal digits.

For example, when data of 2 bits of the GMLVSTS is set to 1 (04H) and when data of the FLGCTR is 07H, the game state is the general game, and the hit flag is the BB. Accordingly, the demonstration lottery table at that time is No. 7 demonstration lottery table from the demonstration lottery table selecting table. The demonstration lottery table of No. 7 is shown in FIG. 56, and the kind of the game starting sound, the kind of the pattern of extinguishing the back lamps of the reels and the kind of the pattern of flashing the back lamps of the reels are selected by the later-described lottery, using the lottery values indicated by the table.

The kind of the pattern of extinguishing the reel lamps corresponds to that of the connective display mode, and the kind of the pattern of flashing the reel lamps correspond to that of the stop display mode. When the combination of the column of a lottery value 18 is selected from the No. 7 demonstration lottery table, for example, the game starting sound is 2, the reel lamp extinguishing pattern is the pattern 3, and the reel lamp flashing pattern is the pattern 9. By the combination of these individual staging modes, the player is informed as a prediction of the fact that the BB flag is hit during the general game.

When a combination of a column of a lottery value 55 is selected by the demonstration lottery table of No. 7 in the aforementioned case in which the game level status is the general game and in which the flag counter is the inner hit of BB, furthermore, the game starting sound is 1, the reel lamp extinguishing pattern is no extinguishment, and the reel lamp flashing pattern is no flash. When the data of 2 bits of the GMLVSTS is set to 1 and when the data of the FLGCTR is 00H, on the other hand, the game state is the general game, and the hit flag becomes a blank. The demonstration lottery table at that time becomes the demonstration lottery table of No. 0 from the demonstration lottery table selecting table.

The demonstration lottery table of No. 0 is shown in FIG. 55. When a column of a lottery value 100 is selected by lottery from the table, the staging mode combination at that time are also that the game starting sound is 1, that the reel lamp extinguishing pattern is no extinguishment, and that the reel lamp flashing pattern is no flash. That is, even in the game establishing different hit flags, depending on a value of a random number for determining a pattern for informing a prediction, the same prediction informing pattern may appear.

In this way, the kind of a hit flag is informed to the player in accordance with the combination of staging modes, which is determined by the game state at that time, and the reliability is not uniform. For example, even when the prediction informing operation of the BB flag hit in the general game is carried, as described hereinbefore, the BB flag is not necessarily hit at that time. That is, the probability of informing a prediction when the BB flag is hit in the general game is X (=0 to 100) %, and the probability of informing a prediction even when the BB flag is not hit in the general game is (100−X) %.

Furthermore, the probability of informing a prediction of the RB or BB flag hit in the inner hit of the RB or the inner hit of the BB is previously determined to a predetermined value in a range of 0 to 100%. FIG. 59 shows eleven kinds of determined patterns in which the informing operation of predicting the RB or BB flag hit is carried out at a probability of 100% in the inner hit of the RB or the inner hit of the BB. That is, the prediction information of the combination of the individual staging modes of the staging mode combination of the game starting sound, the reel lamp extinguishing pattern and the reel lamp flashing pattern appears in the inner hit of the RB or the inner hit of the BB, as shown in FIG. 59, only when the RB or BB flag is hit but not when the RB or BB flag is not hit.

The table of the pattern of the combination of the staging modes, as shown in FIG. 59, in which the RB or BB game is determined, is also previously stored in a predetermined region of the ROM 32.

Furthermore, the micon 30, the lamp drive circuit 48 and the notification lamp 25 constitute notification means for notifying the information to the player by the display of a displayed (or the notification lamp 25 in the embodiment) when the information corresponding to a specific prize mode (e.g., the inner hit of the RB or BB in the embodiment) determined by the prize mode determining means is informed to the player by the notification means at the probability of 100%.

Next, an explanation will be given of the operation of the game machine which is controlled by the micon 30 in accordance with the invention.

Figure 60:
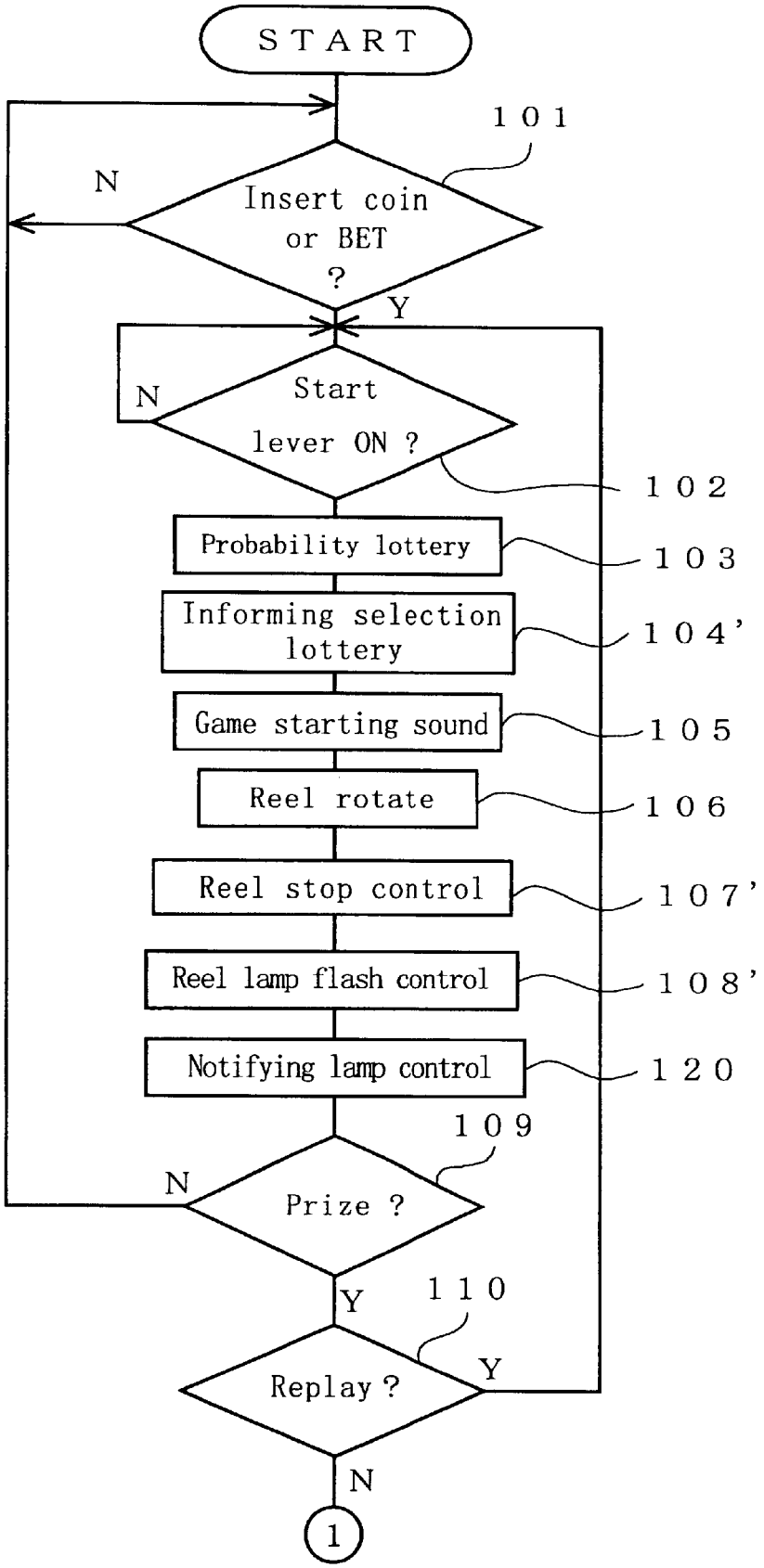
FIG. 60 is a first flowchart showing a game process of the slot machine according to the second embodiment.

FIG. 60 is a flowchart showing an outline of a former half of the game processing, and successive to this processing, a latter half of the aforementioned game processing shown in FIG. 24 is carried out. According to the game processing of the second embodiment, the informing selection lottery operation (at Step 104'), the reel stop operation (at Step 107') and the reel lamp flashing control operation (at Step 108') differ from those of the first embodiment, and a notification lamp control operation (at Step 120) is added after the reel lamp flashing control operation, as different from the first embodiment.

In the game processing, firstly, it is determined (at Step 101 of FIG. 60) by the CPU 31 whether or not the coin BET has been carried out. When coins are inserted or when the BET is carried out, it is then determined (at Step 102) whether or not a start signal is inputted from the start switch 15S by operating the start lever 15.

When the answer is "YES", the probability lottery operation is carried out by the prize mode determining means (at Step 103). In respect of the prize mode determined by the prize mode determining means, data of either one of eight kinds of the "blank", the "2 cherries", the "4 cherries", the "bell", the "watermelon", the "replay", the "RB" and the "BB" are written and temporarily latched in the aforementioned FLGCTR (as should be referred to FIG. 58B).

Successive to the prize determining operation, the informing selection lottery operation of the prize mode is carried out (at Step 104'). The informing selection lottery operation of the prize mode is carried out according to a flowchart shown in FIG. 61.

Figure 61:
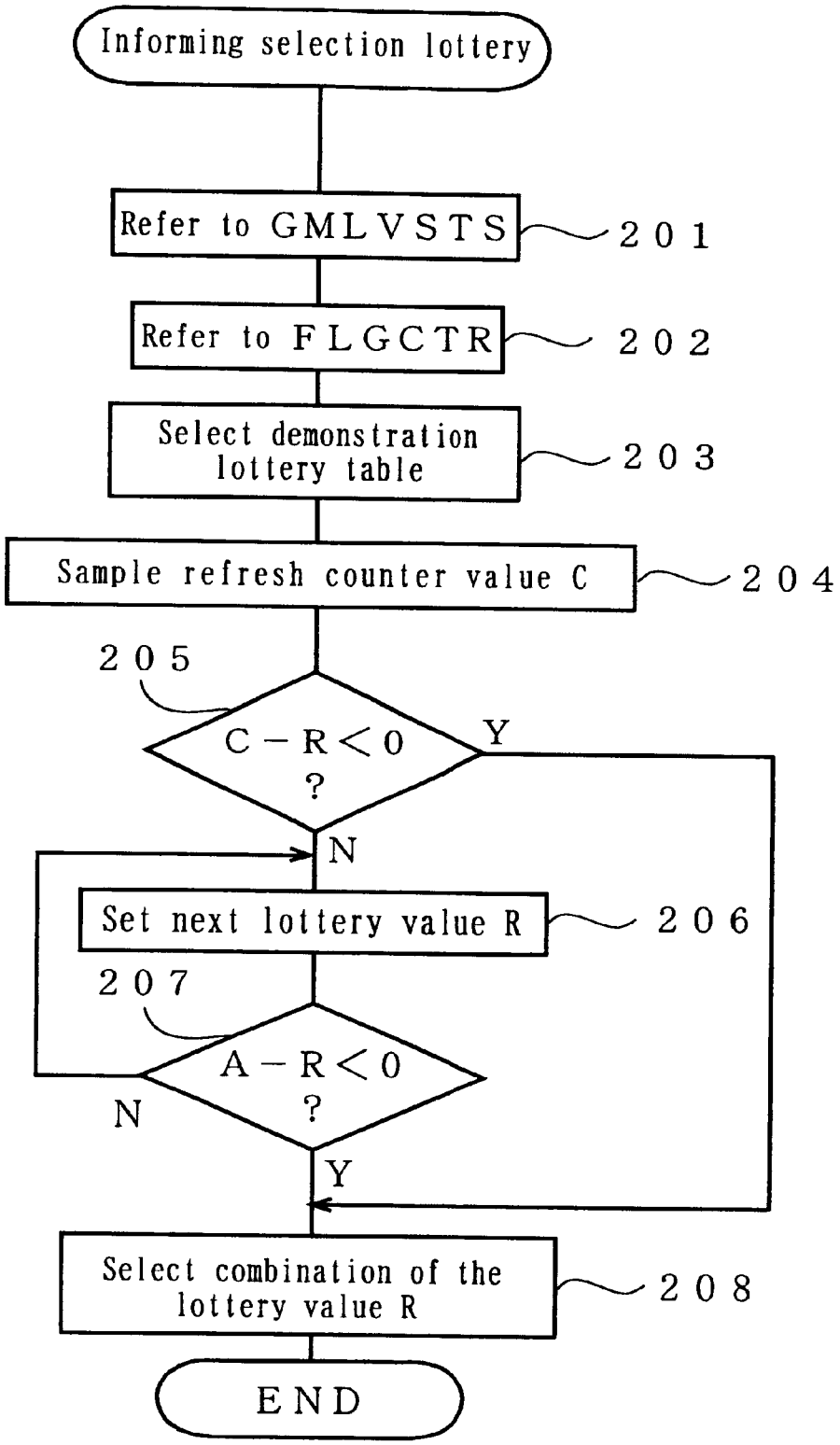
FIG. 61 is a flowchart showing a content of an information selecting lottery process shown in FIG. 60.

At first, the GMLVSTS region (as should be referred to FIG. 58A) stored in the RAM 33 is referred to, and the game state at that time is grasped (at Step 201 in FIG. 61). Next, the data latched in the FLGCTR are referred to, and the kind of the hit flag is grasped (at Step 201). Next, either one of the demonstration lottery tables of No. 0 to No. 17 is selected by referring to the demonstration lottery table selection table (as should be referred to FIG. 54) from the game state at that time and the kind of the hit flat (at Step 203). Next, a count value C is sampled at an arbitrary timing from a counter for refreshing the RAM 33 at constant time intervals (at Step 204).

The count value C is varied in a range of 0 to 127, and the random number lottery for selecting the informing mode is carried out by using the sampled count value C. That is, a lottery value R at the topmost column in the demonstration lottery table selected at Step 203 is subtracted from the count value C, and the positiveness or negativeness of the subtraction result A (=C−R) is determined (at Step 205). When the subtraction result A is not negative, a lottery value at a successive column of the table is set to the lottery value R (at Step 206). After this, a subtraction of A−R is then carried out so that the positiveness or negativeness of the result A (=A−R) is determined (at Step 207). The operation is carried out until the subtraction result A becomes negative. When the result becomes negative, a reel lamp extinguishing pattern of the column of the lottery value R is selected as a staging mode for informing a prediction (at Step 208).

For example, when the BB flag is hit in the general game, as described hereinbefore, the demonstration lottery table of No. 7 is selected, and the selection lottery operation of the staging mode at this time is carried out, as follows. At first, when a value 50 is sampled as the refresh counter value C at Step 204, in the subtraction of c−R at Step 205, a lottery value 55 at the topmost column is firstly set to the lottery value R, and the subtraction result is formed as A=50−55=−5. Since the subtraction result A is negative, the combination of the staging modes of the column of the lottery value 55, that is, the combination of the staging modes of the game starting sound 1, no reel lamp extinguishment and no reel lamp flashing is selected to the prediction informing mode.

When the "watermelon" is hit in the inner hit of the BB, a demonstration lottery table of No. 16 is selected (as should be referred to FIG. 54), and the selection lottery operation of the staging mode combination at this occasion is carried out, as follows. At first, when a value 61 is sampled as the refresh counter value C, in the subtraction of C−R, a lottery value 30 at the topmost column is firstly set to the lottery value R so that the subtraction result is formed as A=61−30=31. Since the subtraction result is positive, a lottery value 32 at a successive column of the table is set to the lottery value R so that the positiveness or negativeness of the subtraction result of A=31−32=−1 is determined.

Since the subtraction result A is negative, the combination of the staging modes of the column of the lottery value 32, that is, the combination of the staging modes of the game starting sound 1, the reel lamp extinguishing pattern 3 and the reel lamp flashing pattern 3 is selected as the prediction informing mode.

Next, a game starting sound emitting operation is carried out (at Step 105 of FIG. 60). This operation is carried out according to the staging mode combination which is selected by the aforementioned information selection lottery operation, and the speaker drive circuit 43 is controlled by the CPU 31 in accordance with the kind of the game starting sound so that one of the game starting sound 1 and 2 is outputted from the speaker 39. These game starting sounds 1 and 2 are emitted from the sound emitting hole 19 formed in the lower portion of the front face of the machine so that they can be grasped by the auditory sense of the player.

In case the BB flag is hit in the general game so that the staging mode combination of the column of the lottery value 55 of the demonstration lottery table No. 7 is selected, for example, the game starting sound is emitted. In case the watermelon is hit in the internal hit of the BB so that the staging mode combination of the column of the lottery value 32 of the demonstration lottery table No. 16 is selected, as described hereinbefore, the game starting sound is emitted.

Figure 62:
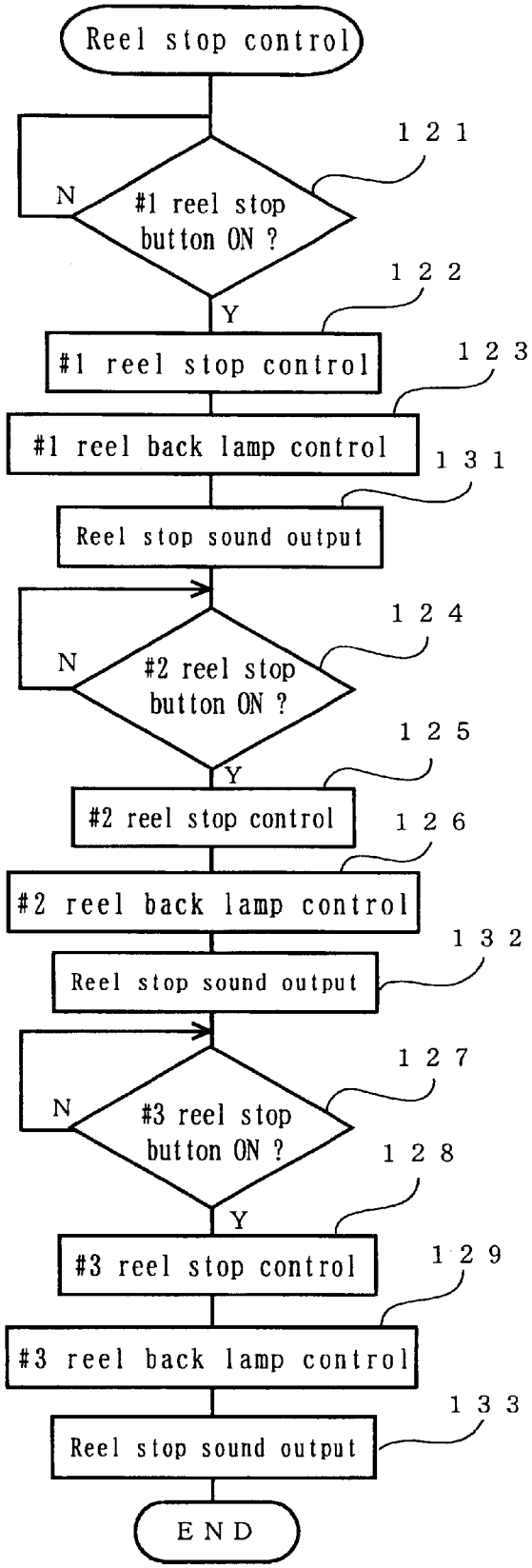
FIG. 62 is a flowchart showing a content of a reel stop control process shown in FIG. 60.

Next, the rotating operation of the first reel 3, the second reel 4 and the third reel 5 is carried out (at Step 106), the individual reels 3, 4 and 5 start rotating simultaneously. Successive to the reel rotating operation, the stop control of the individual reels 3, 4 and 5 is carried out (at Step 107'). An outline of the reel stop control operation is shown by a flowchart in FIG. 62.

In respect of the reel stop control explained here, furthermore, an explanation will be given of the case in which the first reel stop button 16, the second reel stop button 17 and the third reel stop button 18 are operated in this order so that the individual reels 3 to 5 are stopped in the order of the first, second and third reels 3, 4 and 5. However, the order of stopping the individual reels 3 to 5 is not limited thereto but, for example, they may be stopped by a random operational order as in, for example, the first reel stop button 16, the third reel stop button 18 and the second reel stop button 17.

The operation of the individual stop buttons 16 to 18 by the player is detected by the CPU 31 through the reel stop signal circuit 45, as described hereinbefore. When the ON operation of the first reel stop button 16 is detected at Step 121 of FIG. 62, the stop control operation of the first reel 3 is carried out, as described hereinbefore (at Step 122).

Next, the control operation of the back lamps of the first reel is carried out (at Step 123). The control operation is carried out in accordance with the combination of the staging modes on the demonstration lottery table selected by the aforementioned informing selection lottery operation at Step 104', and the back lamps 57*a* to 57*c* built in the first reel 3 are controlled to light in accordance with the selected reel lamp extinguishing pattern.

For example, in the aforementioned case in which the BB flag is hit in the general play and in which the combination of the staging modes of the column of the lottery value 55 of the demonstration lottery table No. 7 is selected as no reel lamp extinguishment, the individual back lamps 57*a* to 57*c* of the first reel 3 are not extinguished, as shown in FIG. 8B. Furthermore, in the aforementioned case in which the watermelon is hit in the inner hit of the BB and in which the combination of the staging modes of the column of the lottery value 32 of the demonstration lottery table No. 16 is selected as the reel lamp extinguishing pattern 3, the individual back lamps 57*a* to 57*c* of the first reel 3 are extinguished, as shown in FIG. 11B.

Next, the reel stop sound emitting operation (at Step 131) is carried out. As mentioned above, the kind of the reel stop sound emitted by the sound emitting means is selected according to the reel stop sound selection table.

For example, in the aforementioned case in which the BB flag is hit in the general game and in which the combination of the staging modes of the column of the lottery value 55 of the demonstration lottery table No. 7 is selected as no reel lamp extinguishment, the individual lamps 57*a* to 57*c* of the first stop reel 3 are not extinguished, as described hereinbefore, but are brought into a lighted state. When the table shown in FIG. 31 is used as the reel stop sound selection table, therefore, the reel stop sound 1 having the duration of 327.60 (ms) is selected, so that the sound is emitted, as shown in FIGS. 32A to 32C, when the timing of operating the first stop button 16 is detected. When the table shown in FIG. 39 is selected as the reel stop sound selection table, furthermore, the reel stop sound 1 having a sound level of "do" is selected and emitted at a similar timing.

Furthermore, in the aforementioned case in which the watermelon is hit in the inner hit of the BB and in which the combination of the staging modes of the column of the lottery value 32 of the demonstration lottery table No. 16 is selected as the reel lamp extinguishing pattern 3, the individual back lamps 57*a* to 57*c* of the first stop reel 3 are extinguished, as described hereinbefore. When the table shown in FIG. 31 is used as the reel stop sound selection table, the reel stop sound 2 having a duration of 393.12 (ms) is selected and is emitted, as shown in FIGS. 34A to 34C, at the detection of the timing of operating the first stop button 16. When the table shown in FIG. 39 is used as the reel stop sound selection table, furthermore, the reel stop sound 2 having the sound level of "re" is selected and emitted at a similar timing.

Next, it is detected (at Step 124) whether or not the stop button 17 of the second reel 4 is turned ON. When the ON operation of the stop button 17 is detected, the stop control operation of the second reels carried out(at Step 125),as described hereinbefore. Next, the control operation of the back lamps of the second reel is carried out (at Step 126). In the control operation, too, the back lamps 57*a* to 57*c* built in the second reel 4 are controlled to light according to the reel lamp extinguishing pattern of the combination of the staging modes selected by the aforementioned informing selection lottery operation at Step 104'.

For example, in the aforementioned case in which the BB flag is hit in the general game and in which the combination of the staging modes of the column of the lottery value 55 of the demonstration lottery table No. 7 is selected as no reel lamp extinguishment, as shown in FIG. 8C, the individual back lamps 57*a* to 57*c* of the second reel 4 are not extinguished. Furthermore, in the aforementioned case in which the watermelon is hit in the inner hit of the BB and in which the combination of the staging modes of the column of the lottery value 32 of the demonstration lottery table No. 16 is selected as the reel lamp extinguishing pattern 3, the individual back lamps 57*a* to 57*c* of the second reel 4 are extinguished, as shown in FIG. 11C.

Next, the reel stop sound emitting operation (at Step 132) is carried out. The kind of the reel stop sound is also selected according to the reel stop sound selection table.

For example in the aforementioned case in which the BB flag is hit in the general game and in which the combination of the staging modes of the column of the lottery value 55 of the demonstration lottery table No. 7 is selected as no reel lamp extinguishment, the individual back lamps 57*a* to 57*c* of the second stop reel 4 are not extinguished, as described hereinbefore, but are brought into a lighted state. When the table shown in FIG. 31 is used as the reel stop sound selection table, therefore, the reel stop sound 1 having a duration of 327.60 (ms) is selected and is emitted, as shown in FIGS. 32A to 32C, at the detection of the timing of operating the second stop button 17. When the table shown in FIG. 39 is used as the reel stop sound selection table, furthermore, the reel stop sound 1 having the sound level of "do" is selected and emitted at a similar timing.

Furthermore, in the aforementioned case in which the watermelon is hit in the inner hit of the BB and in which the combination of the staging modes of the column of the lottery value 32 of the demonstration lottery table No. 16 is selected as the reel lamp extinguishing pattern 3, the individual back lamps 57*a* to 57*c* of the second stop reel 4 are extinguished, as described hereinbefore. When the table shown in FIG. 31 is used as the reel stop sound selection table, therefore, the reel stop sound 3 having a duration of 499.59 (ms) is selected and is emitted, as shown in FIGS. 36A to 36C, at the detection of the timing of operating the second stop button 17. When the table shown in FIG. 39 is used as the reel stop sound selection table, furthermore, the reel stop sound 3 having the sound level of "mi" is selected and emitted at a similar timing.

Next, it is detected (at Step 127) whether or not the stop button 18 of the third reel 5 is turned ON. When the ON operation of the stop button 18 is detected, the stop control operation of the third reel 5 is carried (at Step 128), as described herein before. When the reel stop control operation was finished, the control operation of the back lamps of the third reel is carried out (at Step 129). In the control operation, too, the back lamps 57*a* to 57*c* built in the third reel 5 are controlled to light according to the reel lamp extinguishing pattern having the staging control combination selected by the aforementioned informing selection lottery operation at Step 104'.

For example, in the aforementioned case in which the BB flag is hit in the general game and in which the combination of the staging modes of the column of the lottery value 55 of the demonstration lottery table No. 7 is selected as no reel lamp extinguishment, the back lamps 57*a* to 57*c* of the third reel 5 are not extinguished, as shown in FIG. 8D. Therefore, the individual back lamps 57*a* to 57*c* of the first reel 3, the second reel 4 and the third reel 5 are not extinguished in connection with the operation of the individual stop buttons 16, 17 and 18 and are brought into a state where they remain "lighted, lighted and lighted".

Furthermore, in the aforementioned case in which the watermelon is hit in the inner hit of the BB and in which the combination of the staging modes of the column of the lottery value 32 of the demonstration lottery table No. 16 is selected as the reel lamp extinguishing pattern 3, as shown in FIG. 11D, the individual back lamps 57*a* to 57*c* of the third reel 5 are not extinguished. Accordingly, the individual back lamps 57*a* to 57*c* of the first reel 3, the second reel 4 and the third reel 5 are "extinguished, extinguished and extinguished" in this order in connection with the operation of the individual stop buttons 16, 17 and 18.

Next, the reel stop sound emitting operation (at Step 133) is carried out. The kind of the reel stop sound is also selected according to the aforementioned reel stop sound selection table.

For example, in the aforementioned case in which the BB flag is hit in the general game and in which the combination of the staging modes of the column of the lottery value 55 of the demonstration lottery table No. 7 is selected as no reel lamp extinguishment, the individual back lamps 57*a* to 57*c* of the third stop reel 5 are not extinguished, as described hereinbefore, and are brought into a lighted state.

When the table shown in FIG. 31 is used as the reel stop sound selection table, therefore, the reel stop sound 1 having a duration of 589.68 (ms) is selected and is emitted, as shown in FIGS. 32A to 32C, at the detection of the timing of operating the third stop button 18. As a result, in connection with the operation of the individual stop buttons 16, 17 and 18, the individual back lamps 57*a* to 57*c* of the first, second and third reels 3, 4 and 5 are successively lighted, as described hereinbefore, and a series of sounds having the same duration are emitted by three times as, for example, "beep, beep, beep".

When the table shown in FIG. 39 is used as the reel stop sound selection table, furthermore, the reel stop sound 1 having the sound level of "do" is selected and emitted. As a result, in connection with the operation of the individual stop buttons 16, 17 and 18, the individual back lamps 57*a* to 57*c* of the first, second and third reels 3, 4 and 5 are successively lighted, and a series of sounds having the same level are emitted by three times as, for example, "do, do and do".

Furthermore, in the aforementioned case in which the watermelon is hit in the inner hit of the RB and in which the combination of the staging modes of the column of the lottery value 32 of the demonstration lottery table No. 16 is selected as the reel lamp extinguishing pattern 3, the individual back lamps 57*a* to 57*c* of the third stop reel 5 are not extinguished, as described hereinbefore.

When the table shown in FIG. 31 is used as the reel stop sound selection table, therefore, the reel stop sound 1 having a duration of 327.60 (ms) is selected and is emitted, as shown in FIGS. 38A to 38C, at the detection of the timing of operating the third stop button 18. As a result, in connection with the operation of the individual stop buttons 16, 17 and 18, the individual back lamps 57*a* to 57*c* of the first, second and third reels 3, 4 and 5 are extinguished, extinguished and extinguished in this order, as described hereinbefore, and a series of sounds having different durations are emitted by three times as, for example, "beep, beep, beep".

When the table shown in FIG, 39 is used as the reel stop sound selection table, furthermore, the reel stop sound 4 having the sound level of "fa" is selected and emitted. As a result, in connection with the operation of the individual stop buttons 16, 17 and 18, the individual back lamps 57*a* to 57*c* of the first, second and third reels 3, 4 and 5 are extinguished, extinguished and extinguished in this order, and a series of sounds having different sound levels are emitted by three times as, for example, "re, mi and fa".

When the reel stop control operation of Step 107' of FIG. 60 was finished in this way, the reel lamp flashing control is carried out (at Step 108' of FIG. 60). In this reel lamp flashing control operation, too, in accordance with the reel lamp flashing pattern of the combination of the staging modes selected in the notifying selection lottery operation of Step 104', the individual back lamps 57*a* to 57*c* built in the first, second and third reels 3, 4 and 5 are controlled to flash.

For example, in the aforementioned case in which the BB flag is hit in the general game and in which the combination of the staging modes of the column of the lottery value 55 of the demonstration lottery table No. 7 is selected as no reel lamp flashing, the individual back lamps 57*a* to 57*c* of the first, second and third reels 3, 4 and 5 are not controlled to flash but are left lighted. In the aforementioned case in which the watermelon is hit in the inner hit of the BB and in which the combination of the staging modes of the lottery value 32 of the demonstration lottery table No. 16 is selected as the reel lamp flashing pattern 3, on the other hand, the individual back lamps 57*a*, 57*b* and 57*c* of the reels 3 to 5 are controlled to flash, as shown in FIG. 42.

Figure 63:
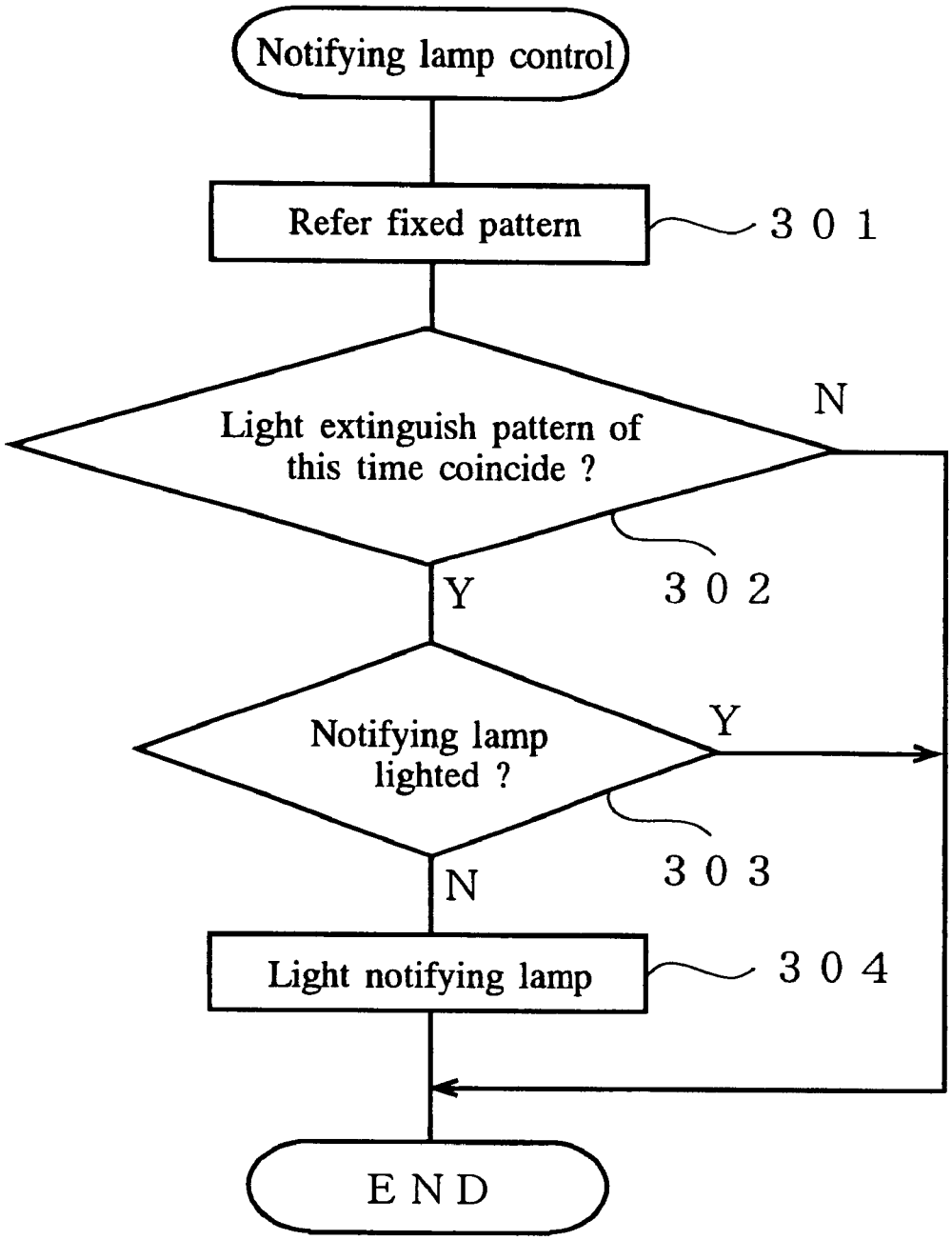
FIG. 63 is a flowchart showing a content of a notification lamp control process shown in FIG. 60.

Successively, the lighting control of the notification lamp 25 is carried out (at Step 120 of FIG. 60). This notification lamp control is carried out according to the flowchart of FIG. 63.

At first, eleven fixed patterns, as shown in FIG. 59, are referred to (at Step 301), and it is determined (at Step 302) what of the fixed patterns the pattern of the staging mode combination of the game starting sound in a series of flow of the game at this time, the reel lamp extinguishing pattern and the reel lamp flashing pattern coincides with. When no coincidence occurs, the routine is finished. When a coincidence occurs, it is then determined (at Step 303) whether or not the notification lamp 25 is being currently lighted. When the notification lamp 25 is not lighted, it is controlled to light by the lamp drive circuit 48 (at Step 304). When the notification lamp 25 is lighted, the routine is finished.

For example, in the aforementioned case in which the watermelon is hit in the inner hit of the BB and in which the combination of the staging modes of the column of the lottery value 32 of the demonstration lottery table No. 16 is selected, the game starting sound 1, the reel lamp extinguishing pattern 3 and the reel lamp flashing pattern 3 coincide with one of the fixed patterns 4 when they are staged in a series of flow of the game. In this case, therefore, the lamp drive circuit 48 is driven by the control of the micon 30 so that the notification lamp 25 is lighted.

In this case, the micon 30, the lamp drive circuit 48 and the notification lamp 25 constitute notification means for notifying the information to the player by the light display of the notification lamp 25, when the inner hit of the RB or BB determined by the prize mode determining means is informed to the player by the aforementioned staging at the probability of 100%.

FIGS. 64A to 64E are timing chart diagrams for lighting the notification lamp 25. This notification lamp 25 is lighted at a timing shown in FIG. 64A when the fixed pattern for fixing the BB or RB finished the display at a timing shown in FIG. 64B. When the inner hit flag of the BB or RB is turned ON, as shown in FIG. 64C and when a combination of symbols of the BB or RB is stopped and displayed at the stop of the individual reels 3 to 5 so that the BB or RB prize is caused at the timing shown in FIG. 64D, the notification lamp 25 is extinguished at the timing, as shown in FIG. 64E, to finish the pay-out of coins by the prize.

By thus lighting the notification lamp 25 on the condition of displaying the fixed pattern, the player can recognize that the informing prediction currently displayed is the prediction informing that the inner hit of the BB or RB is caused at the probability of 100%.

When the aforementioned notification lamp control was finished, the game processing determines whether or not the display after stopping all the reels constitutes a predetermined prize combination of symbols with reference to the prize symbol combination table (at Step 109 of FIG. 60). When the prize is not gained, the determination at Step 109 is "NO", and the routine returns to the initial Step 101. In the case of the replay game (or play again) as a result of the determination of prize, furthermore, the routine returns to the operation waiting for the operation of the start lever 15 of Step 102 (at Step 110).

In the case of the prize which is not the replay game, a predetermined number of coins are paid out to the coin tray 20 by the hopper 38 (at Step 111 of FIG. 24). It is then determined (at Step 112) whether or not the BB game is caused. When the BB game is caused, the BB game is executed (at Step 113). When the BB game is not caused, on the other hand, it is then determined (at Step 114) whether or not the RB game is caused. When the RB game is caused, the RB game is executed (at Step 115). After this, the aforementioned operations are repeated, and the slot machine game is carried out.

In the embodiment, too, the prize mode determined by the inner lottery is informed to the player through a series of flow of the slot machine game. Specifically, the player is informed of the prize mode by combining the kinds of the game starting sounds which are emitted by the sound emitting means when the rotation of the individual reels 3 to 5 is started, the kinds of the display modes (or the reel lamp extinguishing pattern) of the individual back lamps 57*a* to 57*c* which are successively staged by the connective staging means in connection with the stop of the individual reels 3 to 5, and the kinds of the display modes (or the reel lamp flashing pattern) of the individual back lamps 57*a* to 57*c* which are staged by the stop staging means when all the individual reels 3 to 5 are stopped.

For example, in the aforementioned case in which the watermelon is hit in the inner hit of the BB and in which the combination of the staging modes of the column of the lottery value 32 of the demonstration lottery table No. 16 is selected, in the midst of the operation to stop the first reel 3, the second reel 4 and the third reel 5. the player listens to the game starting sound 1 at the time of operating the start lever 15 to recognize that the individual back lamps 57*a* to 57*c* are extinguished, extinguished and extinguished in this order by the visual sense and looks at a series of sounds having, for example, increasing durations of "beep, beep and beep" to recognize that the individual back lamps 57*a* to 57*c* stop the display in the mode of the reel lamp flashing pattern 3 after all the reels 3 to 5 were stopped, by the auditory sense.

In this embodiment, too, the prize mode becomes clear as the game advances, as described hereinbefore. Specifically, the rotation of the individual reels 3 to 5 is started by operating the start lever 15 and is successively stopped for each column by operating the individual stop buttons 16 to 18. As the rotation of all the reels 3 to 5 is stopped, the player is informed of the kinds of the hit flags which are determined by the inner lottery. Although conventionally, therefore, the result of the lottery determined by the random number lottery inside of the machine has not been known at all in respect of the prize mode other than the big hit prize until the patterns are actually stopped and displayed at the individual windows, according to the embodiment, so that the player can predict the prize mode to some degree.

Furthermore, the player is gradually informed of what prize mode is determined by the inner lottery, as the operations advance. Unlike the mere notification of the inner lottery result, the player is excited by the prize mode which becomes the clearer as the operations advance the more.

According to the embodiment, furthermore, when the inner hit of the BB or RB is informed at the probability of 100%, the player is informed of the fact that the inner hit of the BB or RB is caused by the light display of the notification lamp 25. When the inner hit of the BB or RB is informed at a probability smaller than 100%, that is, in the case in which even when the inner hit of the BB or RB is caused by the inner lottery, the inner hit is not necessarily informed, the result of the inner lottery is not notified by the light display of the notification lamp 25. Even when the result of the inner lottery of causing the inner hit of the BB or RB is not displayed at the notification lamp 25, therefore, the player can be informed of a result of the inner lottery of causing the inner hit of the BB or RB by the pattern of the staging mode combination which is informed through a series of flow of the game.

Unlike the conventional game machine in which a result of the inner lottery for causing a big hit prize is mechanically informed to the player, therefore, according to the game machine of the embodiment, the player can feed the pleasure of searching the result of the inner lottery as in searching, for example, the "reach spot".

In the explanation of the aforementioned embodiments, furthermore, at each time of staging the display of each reel 3 to 50 by the connective staging means, the sound generating means emits a reel stop sound having a previously determined kind or duration. However, the structure of the individual stop buttons 16 to 18 may be constituted by a tactile sense type button structure which vibrates in operation by using solenoids or the like and in place of the aforementioned sound emitting means, or along with the aforementioned sound emitting means, the individual stop buttons 16 to 18 may vibrate in a previously determined mode at each time of staging display of the connective staging means.

Although in the explanation of the aforementioned embodiments, an explanation has been given of the case in which the notification lamp 25 constituting the notification means is installed on the front panel of the machine exclusive for the notification, furthermore, the establishment of a flag of a specified prize mode may be notified by using an existing display device. For example, the establishment of a specified flag may be notified by emitting a special sound from the speaker 39. Alternatively,the establishment of a specified flag may be notified by vibrating the individual reels 3 to 5.

Furthermore, the notification means may be realized by information means for informing the prediction of establishment of flags of the individual prize modes. For example, the establishment of a specified flag may be notified by displaying a mode of flashing the individual back lamps 57*a* to 57*c* of the individual reels 3 to 5 by a specified information mode after the end of the reel lamp flashing display which is effected by the stop staging means at the stop time of the individual reels.

Furthermore, the liquid crystal display unit 24 may be used as the information means for informing the prediction of establishing flags of the individual prize modes and may also be used as the notification means. That is, instead of informing a prediction by a staging combination of a display mode of the reel back lamps or the like, the prediction may be informed by making a character or the like enter the liquid crystal display unit 24 and by combining changes in the display of the character, or the prediction may be informed by combining the changes in the display of a background image. Furthermore, the notification by the notification means may be carried out by displaying the liquid crystal display unit 24 in a specified mode different from that of informing the prediction.

In the second embodiment and the foregoing first embodiment, for example, in connection with the operations of the individual stop buttons 16 to 18, the connective staging means predicted and reported the individual reel back lamps 57 by staging the four kinds of connective display modes of no reel lamp extinguishment, the extinguishing pattern 1, the extinguishing pattern 2 and the extinguishing pattern 3, as shown in FIGS. 8, 9, 10 and 11. In place of these individual extinguishing patterns, however, the four kinds of connective display modes may be staged for the prediction and report with the four kinds of operation patterns 1 to 4, as presented in the liquid crystal display unit 24 shown in FIGS. 65 to 67.

Figure 65A:
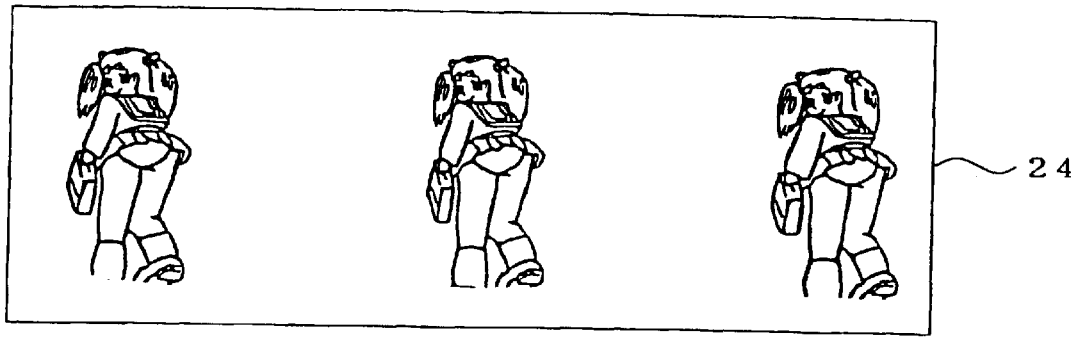
FIGS. 65A to 65D are views showing a first interlocking display mode to be informed to the player by the connective staging means in the game process of the slot machine according to a first modification of the first and second embodiments.

FIGS. 65A to 65D show the operation pattern 1 for staging the first connective display mode corresponding to the aforementioned no reel lamp extinguishment (as should be referred to FIGS. 8A to 8D). In the liquid crystal display unit 24, there are always displayed three bodies of a girl character "Kumichan", and all the three bodies, as located at the left, center and right, are in the basic positions, as shown in FIG. 65A, when the individual stop buttons 16 to 18 are not operated.

Figure 65B:
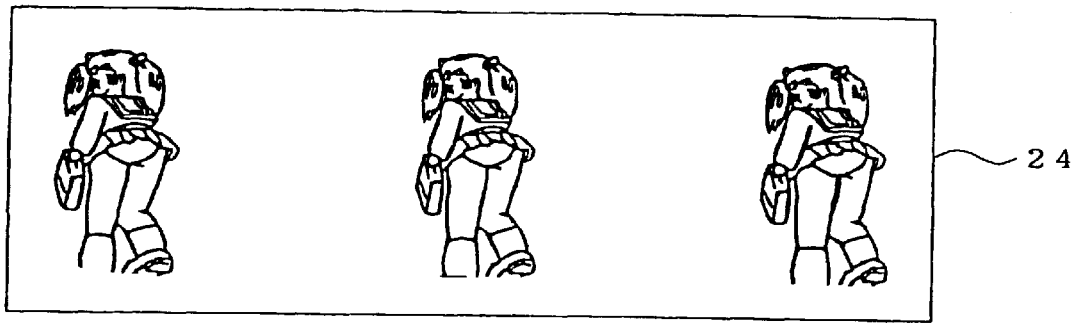
Figure 65C:
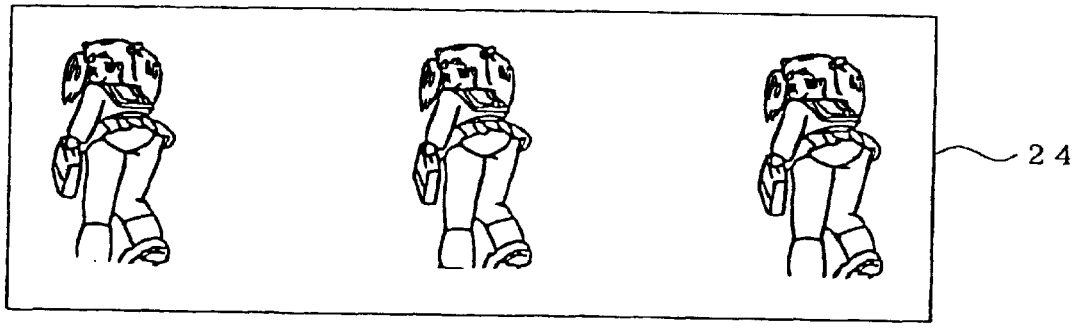
Figure 65D:
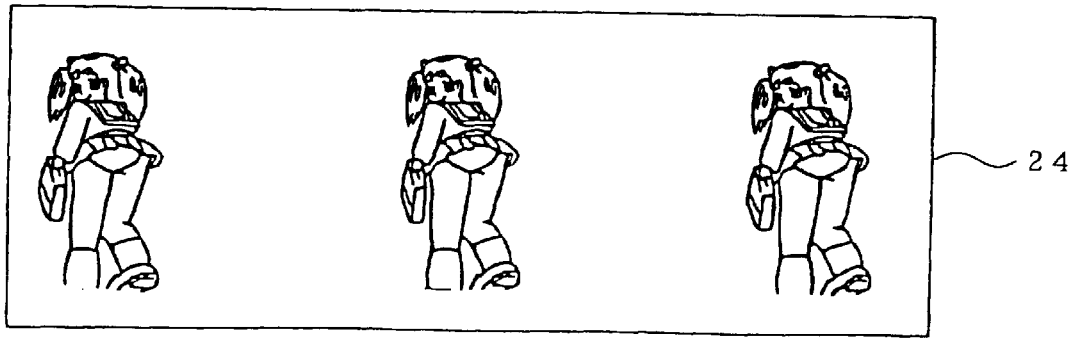

In the first embodiment, the staging mode combination ① or ⑤ is selected by the information selecting lottery operation (at Step 104 of FIG. 23) using the prize mode information selecting lottery probability table (as should be referred to FIG. 19). In the second embodiment, the reel lamp extinguishing pattern is selected as the "no extinguishment", when the first reel stop button 16 is selected, by the information selecting lottery operation (as should be referred to Step 104' of FIG. 60) using the demonstration lottery table (as should be referred to FIGS. 55 to 57). When the first stops button 16 is operated, the character of the liquid crystal display unit 24 takes the position, as shown in FIG. 65B, so that no change occurs in the individual basic positions of the three bodies. When the second reel stop button 17 is operated, the character then takes the position, as shown in FIG. 65C, so that no change occurs in the individual basic positions of the three bodies. When the third reel stop button 18 is operated, furthermore, the character takes the position, as shown in FIG. 65D, so that no change occurs in the individual basic positions of the three bodies.

Figure 66A:
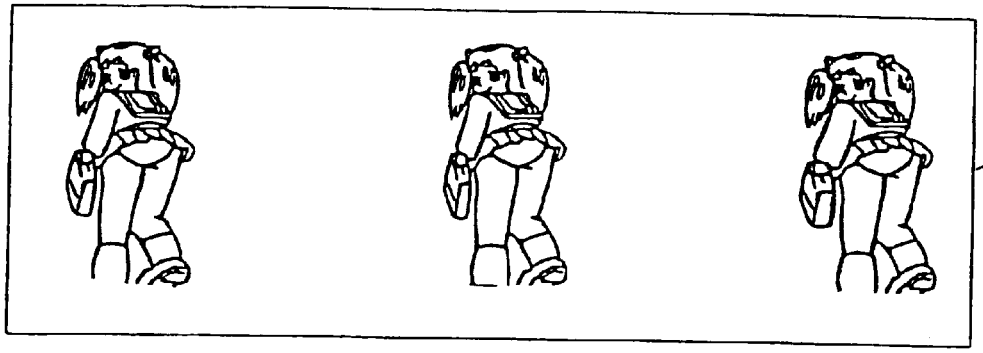
FIGS. 66A to 66D are views showing a second interlocking display mode to be informed to the player by the connective staging means in the game process of the slot machine according to the first modification of the first and second embodiments.

FIGS. 66A to 66D show the operation pattern 2 for staging the second connective display mode corresponding to the aforementioned reel lamp extinguishing pattern 1 (as should be referred to FIGS. 9A to 9D). In this pattern, too, all the three bodies, as displayed in the liquid crystal display device 24. are in the basic positions, as shown in FIG. 66A, when the individual stop buttons 16 to 18 are not operated.

Figure 66B:
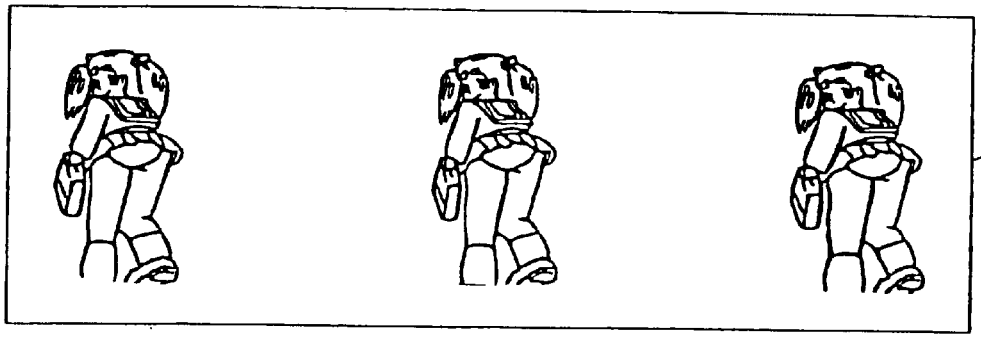
Figure 66C:
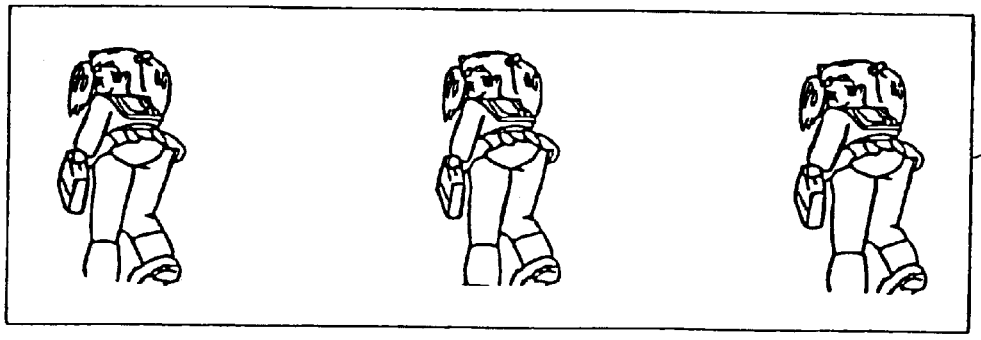
Figure 66D:
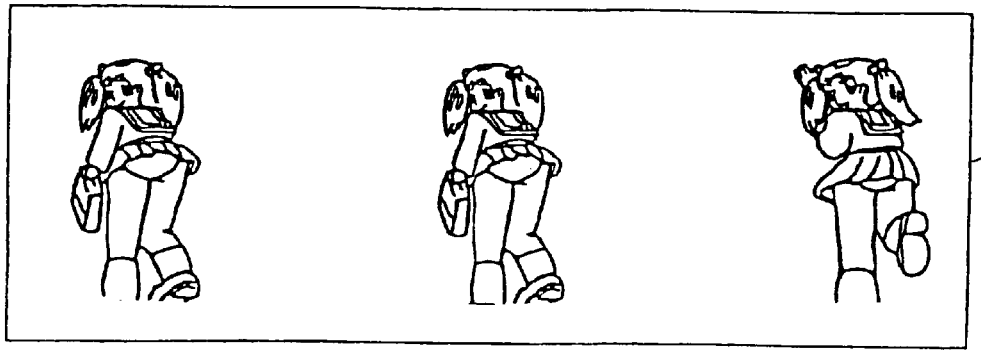

In the first embodiment, the staging mode combination ② or ⑥ is selected by the information selecting lottery operation using the prize mode information selecting lottery probability table. In the second embodiment, the reel lamp extinguishing pattern is selected as the "extinguishing pattern 1", when the first reel stop button 16 is selected, by the information selecting lottery operation using the demonstration lottery table. When the first stop button 16 is operated, the character of the liquid crystal display unit 24 takes the position, as shown in FIG. 66B. so that no change occurs in the individual basic positions of the three bodies. When the second reel stop button 17 is operated, the character then takes the position, as shown in FIG. 66C, so that no change occurs in the individual basic positions of the three bodies. When the third reel stop button 18 is operated, furthermore, the character takes the position, as shown in FIG. 66D, so that the right leg of the character, as located on the right, slightly rises back.

Figure 67A:
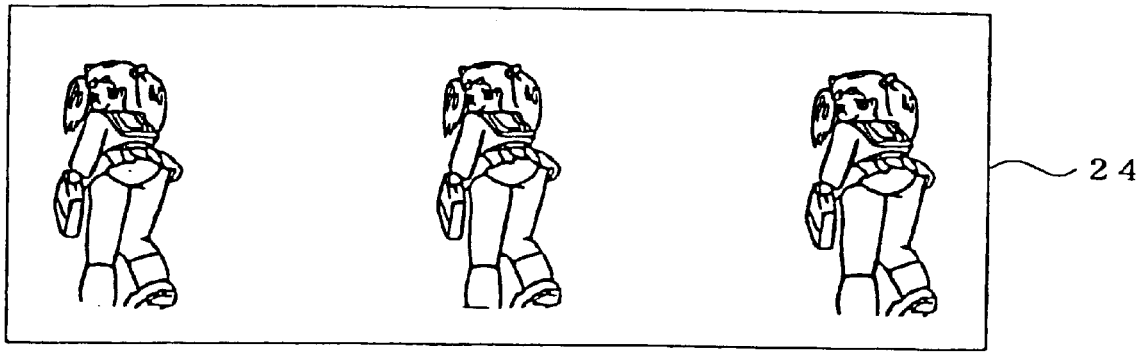
FIGS. 67A to 67D are views showing a third interlocking display mode to be informed to the player by the connective staging means in the game process of the slot machine according to the first modification of the first and second embodiments.

FIGS. 67A to 67D show the operation pattern 3 for staging the second connective display mode corresponding to the aforementioned reel lamp extinguishing pattern 2 (as should be referred to FIGS. 10A to 10D). In this pattern, too, all the three bodies, as displayed in the liquid crystal display device 24, are in the basic positions, as shown in FIG. 67A, when the individual stop buttons 16 to 18 are not operated.

Figure 67B:
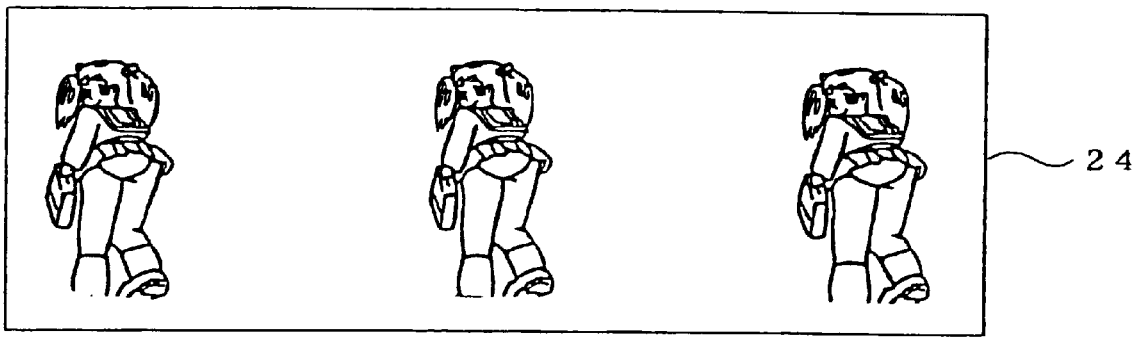
Figure 67C:
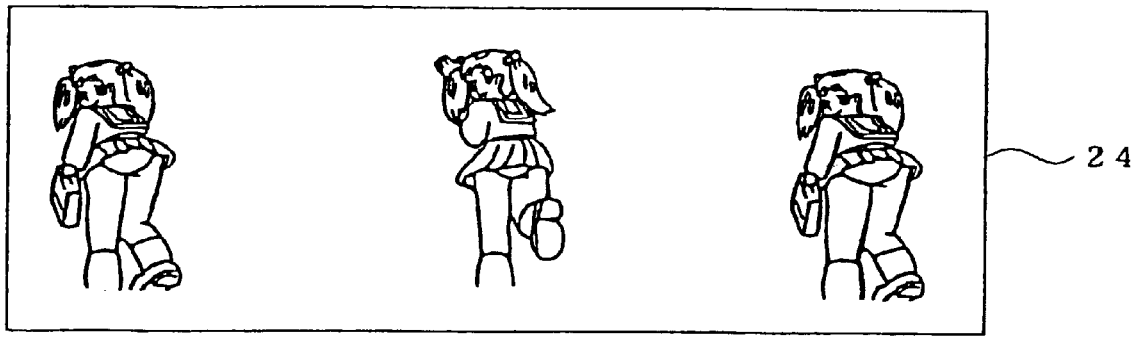
Figure 67D:
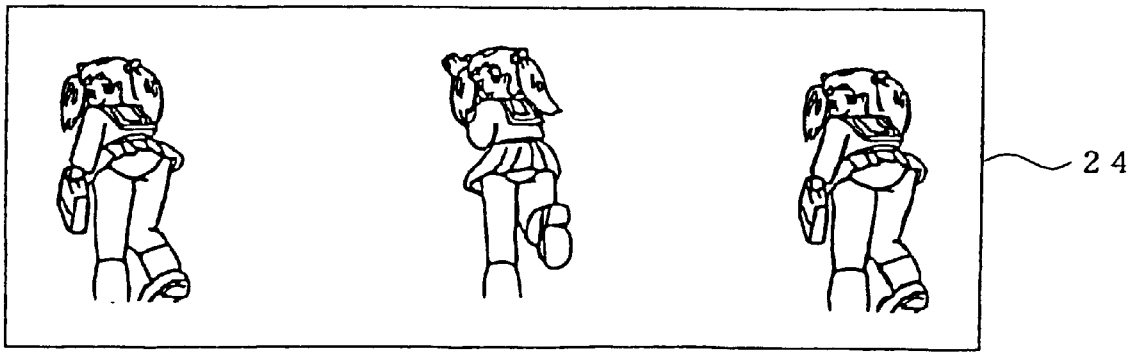

In the first embodiment, the staging mode combination ③ or ⑦ is selected by the information selecting lottery operation using the prize mode information selecting lottery probability table. In the second embodiment, the reel lamp extinguishing pattern is selected as the "extinguishing pattern 2", when the first reel stop button 16 is selected, by the information selecting lottery operation using the demonstration lottery table. When the first stop button 16 is operated, the character of the liquid crystal display unit 24 takes the position, as shown in FIG. 67B, so that no change occurs in the individual basic positions of the three bodies. When the second reel stop button 17 is operated, the character then takes the position, as shown in FIG. 67C, so that the right leg of the character, as located at the center, slightly rises up. When the third reel stop button 18 is operated, furthermore, the character takes the position, as shown in FIG. 67D, so that no change occurs in the individual positions.

Figure 68A:
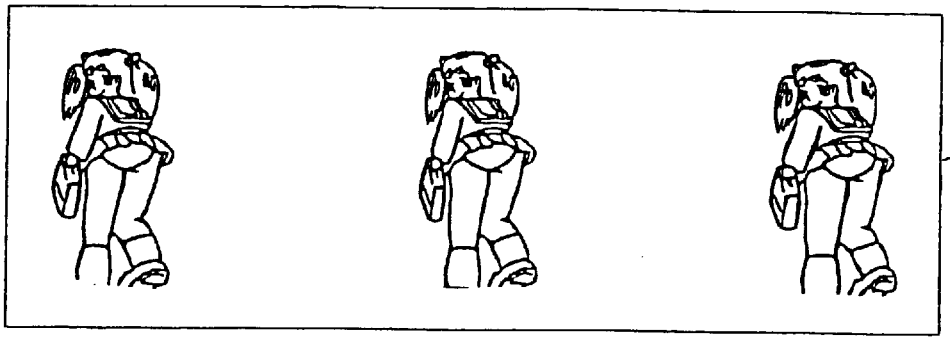
FIGS. 68A to 68D are views showing a fourth interlocking display mode to be informed to the player by the connective staging means in the game process of the slot machine according to the first modification of the first and second embodiments.

FIGS. 68A to 68D show the operation pattern 4 for staging the second connective display mode corresponding to the aforementioned reel lamp extinguishing pattern 3 (as should be referred to FIGS. 11A to 11D). In this pattern, too, all the three bodies, as displayed in the liquid crystal display device 24, are in the basic positions, as shown in FIG. 68A, when the individual stop buttons 16 to 18 are not operated.

Figure 68B:
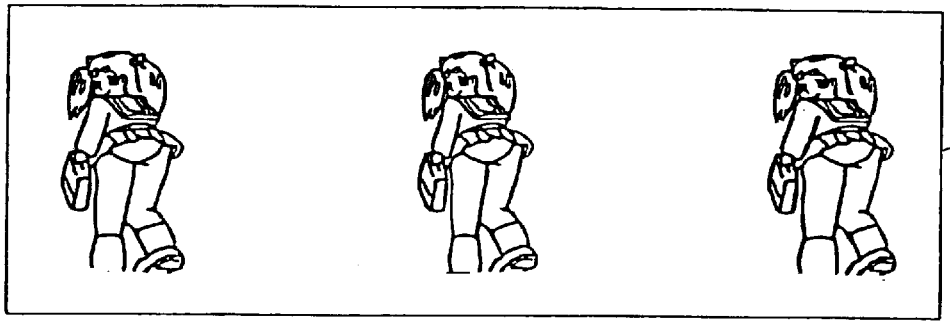
Figure 68C:
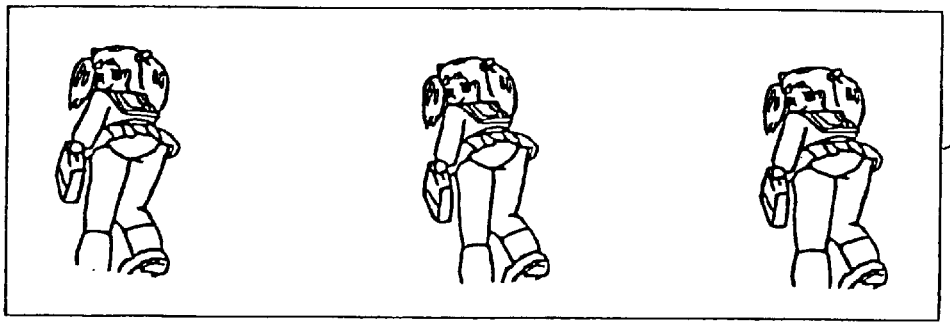
Figure 68D:
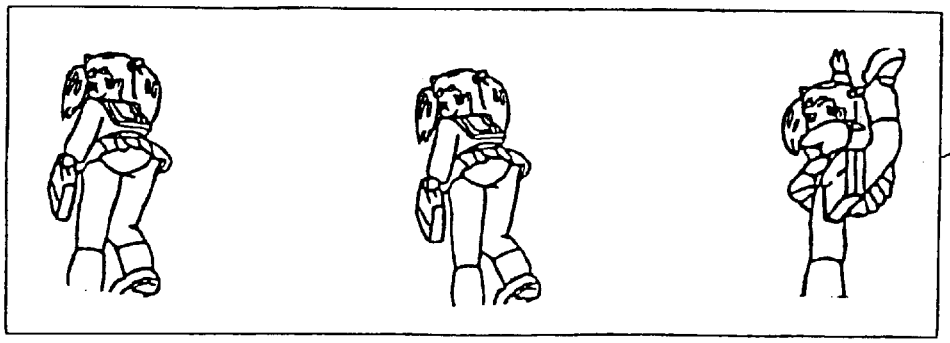

In the first embodiment, the staging mode combination ④ or ⑧ is selected by the information selecting lottery operation using the prize mode information selecting lottery probability table. In the second embodiment, the reel lamp extinguishing pattern is selected as the "extinguishing pattern 3", when the first reel stop button 16 is selected, by the information selecting lottery operation using the demonstration lottery table. When the first stop button 16 is operated, the character of the liquid crystal display unit 24 takes the position, as shown in FIG. 68B, so that no change occurs in the individual basic positions of the three bodies. When the second reel stop button 17 is operated, the character then takes the position, as shown in FIG. 68C, so that no change occurs in the individual basic positions. When the third reel stop button 18 is operated, furthermore, the character takes the position, as shown in FIG. 68D, so that the right leg of the character, as located on the right side, largely rises back.

In place of four kinds of individual extinguishing patterns shown in FIGS. 8, 9, 10 and 11, furthermore, the four kinds of connective display modes may be staged for the prediction and report with the four kinds of operation patterns 1 to 4, as presented in the liquid crystal display unit 24 shown in FIGS. 69 to 72.

Figure 69A:
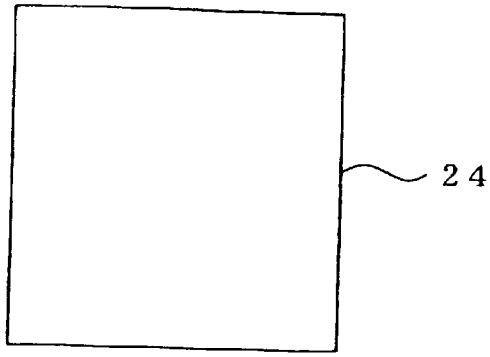
FIGS. 69A to 69D are views showing a first interlocking display mode to be informed to the player by the connective staging means in the game process of the slot machine according to a second modification of the first and second embodiments.

FIGS. 69A to 69D show the operation pattern 1 for staging the first connective display mode corresponding to the aforementioned no reel lamp extinguishment (as should be referred to FIGS. 8A to 8D). When the individual stop buttons 16 to 18 are not operated, there is no display in the liquid crystal display unit 24, as shown in FIG. 69A.

Figure 69B:
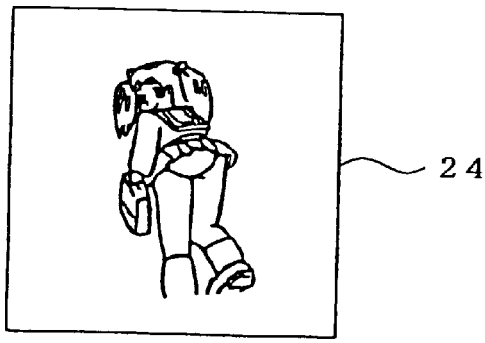
Figure 69C:
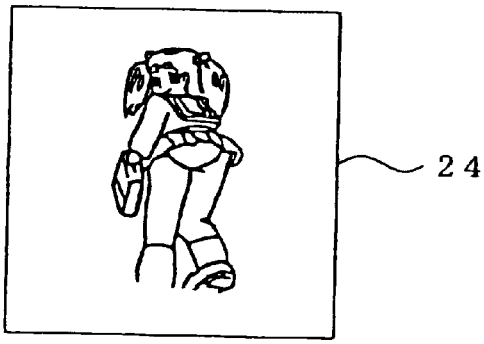
Figure 69D:
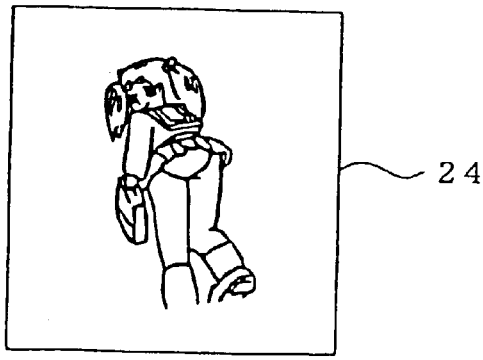

In the first embodiment, the staging mode combination ① or ⑤ is selected by the information selecting lottery operation using the prize mode information selecting lottery probability table. In the second embodiment, the reel lamp extinguishing pattern is selected as the "no extinguishment", when the first reel stop button 16 is selected, by the information selecting lottery operation using the demonstration lottery table. When the first stop button 16 is operated, the girl character "Kumichan" of the liquid crystal display unit 24 takes the basic position in one body, as shown in FIG. 69B. When the second reel stop button 17 is operated, the character then takes the position, as shown in FIG. 69C, so that no change occurs in the position. When the third reel stop button 18 is operated, furthermore, the character takes the position, as shown in FIG. 69D, so that no change occurs in the position.

Figure 70A:
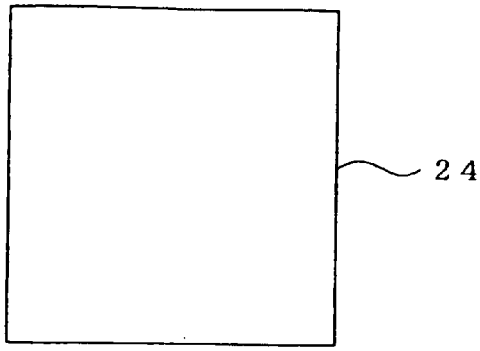
FIGS. 70A to 70D are views showing a second interlocking display mode to be informed to the player by the connective staging means in the game process of the slot machine according to the second modification of the first and second embodiments.

FIGS. 70A to 70D show the operation pattern 2 for staging the second connective display mode corresponding to the aforementioned reel lamp extinguishing pattern 1 (as should be referred to FIGS. 9A to 9D). In this pattern, too, nothing is displayed in the liquid crystal display device 24, as shown in FIG. 70A, when the individual stop buttons 16 to 18 are not operated.

Figure 70B:
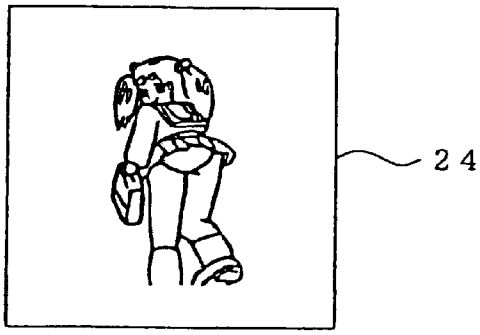
Figure 70C:
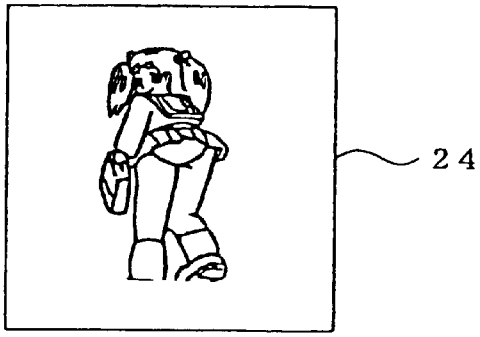
Figure 70D:
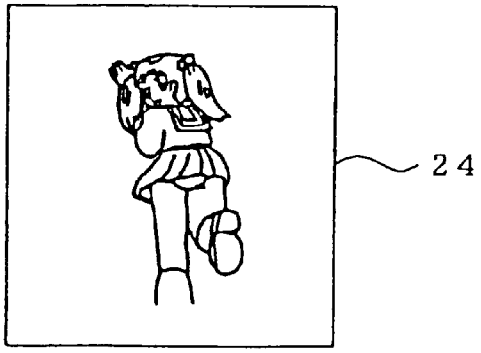

In the first embodiment, the staging mode combination ② or ⑥ is selected by the information selecting lottery operation using the prize mode information selecting lottery probability table. In the second embodiment, the reel lamp extinguishing pattern is selected as the "extinguishing pattern 1", when the first reel stop button 16 is selected, by the information selecting lottery operation using the demonstration lottery table. When the first stop button 16 is operated, the basic position of the character is displayed, as shown in FIG. 70B. When the second reel stop button 17 is operated, the character then takes the position, as shown in FIG. 70C, so that no change occurs in the position. When the third reel stop button 18 is operated, furthermore, the character takes the position, as shown in FIG. 70D, so that the right leg of the character slightly rises back.

Figure 71A:
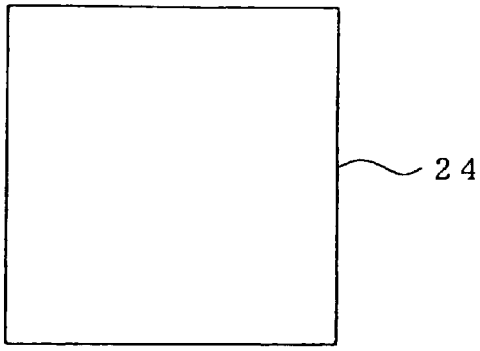
FIGS. 71A to 71D are views showing a third interlocking display mode to be informed to the player by the connective staging means in the game process of the slot machine according to the second modification of the first and second embodiments.

FIGS. 71A to 71D show the operation pattern 3 for staging the second connective display mode corresponding to the aforementioned reel lamp extinguishing pattern 2 (as should be referred to FIGS. 10A to 10D). In this pattern, too, there is no display in the liquid crystal display device 24, as shown in FIG. 71A, when the individual stop buttons 16 to 18 are not operated.

Figure 71B:
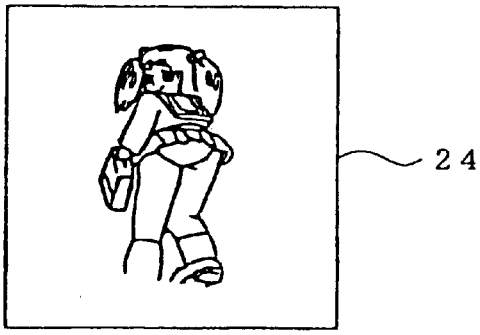
Figure 71C:
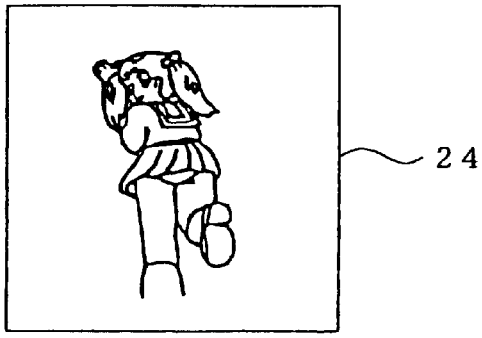
Figure 71D:
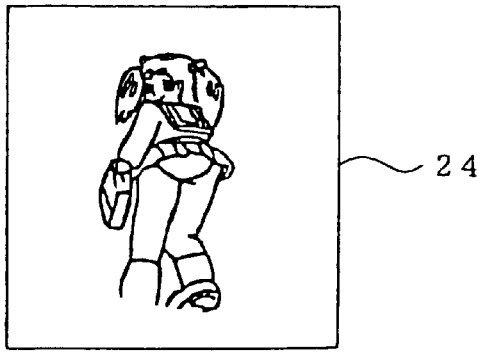

In the first embodiment, the staging mode combination ③ or ⑦ is selected by the information selecting lottery operation using the prize mode information selecting lottery probability table. In the second embodiment, the reel lamp extinguishing pattern is selected as the "extinguishing pattern 2", when the first reel stop button 16 is selected, by the information selecting lottery operation using the demonstration lottery table. When the first stop button 16 is operated, the basic position of the character is shown in the liquid crystal display unit 24, as shown in FIG. 71B. When the second reel stop button 17 is operated, the character then takes the position, as shown in FIG. 71C, so that the right leg of the character slightly rises up. When the third reel stop button 18 is operated, furthermore, the character restores the basis position, as shown in FIG. 71D.

Figure 72A:
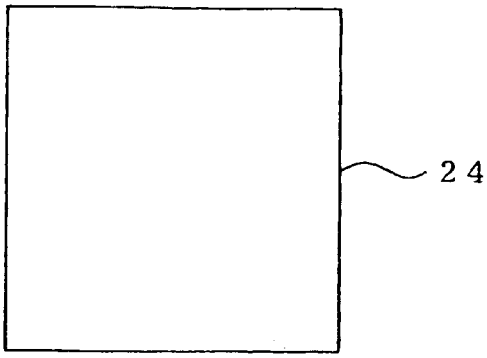
FIGS. 72A to 72D are views showing a fourth interlocking display mode to be informed to the player by the connective staging means in the game process of the slot machine according to the second modification of the first and second embodiments.

FIGS. 72A to 72D show the operation pattern 4 for staging the fourth connective display mode corresponding to the aforementioned reel lamp extinguishing pattern 3 (as should be referred to FIGS. 11A to 11D). In this pattern, too, nothing is displayed in the liquid crystal display device 24, as shown in FIG. 72A, when the individual stop buttons 16 to 18 are not operated.

Figure 72B:
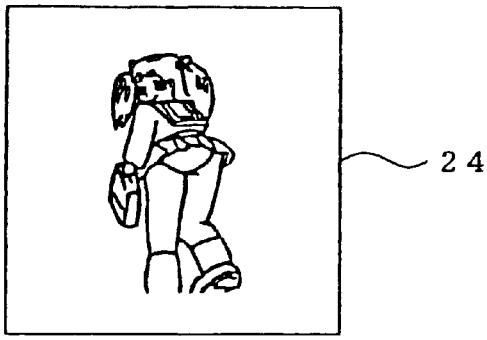
Figure 72C:
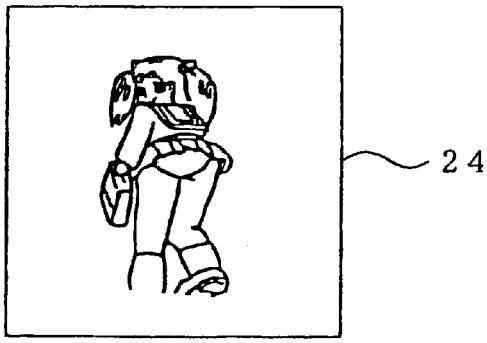
Figure 72D:
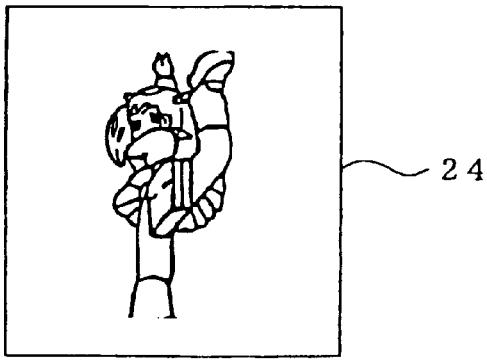

In the first embodiment, the staging mode combination ④ or ⑧ is selected by the information selecting lottery operation using the prize mode information selecting lottery probability table. In the second embodiment, the reel lamp extinguishing pattern is selected as the "extinguishing pattern 3", when the first reel stop button 16 is selected, by the information selecting lottery operation using the demonstration lottery table. When the first stop button 16 is operated, the basic position of the character is displayed in the liquid crystal display unit 24, as shown in FIG. 72B. When the second reel stop button 17 is operated, no change occurs in the position, as shown in FIG. 72C. When the third reel stop button 18 is operated, furthermore, the character takes the position, as shown in FIG. 72D, so that the right leg of the character largely rises back.

In the second embodiment thus far described, furthermore, when all the individual reels 3 to 5 were stopped, the individual reel back lamps 57 staged to predict and inform the ten kinds of stop display modes of the reel lamp flashing pattern 1 to the reel lamp flashing pattern 9, as shown in FIGS. 40 to 53, and the not-shown no reel lamp flashing. In place of these individual reel lamp flashing pattern, however, ten kinds of stop display modes may be staged with the ten kinds of operation patterns 1 to 10 of the character appearing in the liquid crystal display unit 24, as shown in FIGS. 73 to 82, and may be predicted and informed.

FIGS. 73A to 73D show the operation pattern 1 for staging the first stop display mode corresponding to the aforementioned no reel lamp flashing.

Figure 73A:
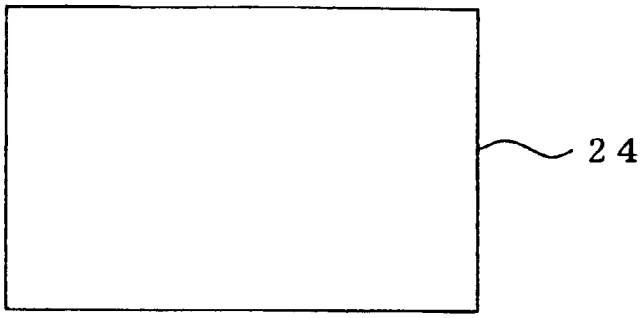
FIGS. 73A to 73D are views showing a first interlocking display mode to be informed to the player by the connective staging means in the game process of the slot machine according to a first modification of the second embodiment.
Figure 73B:
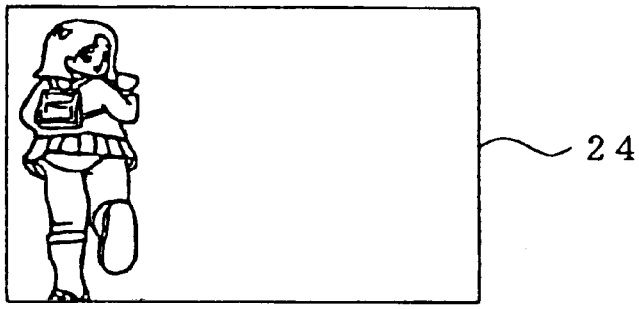
Figure 73C:
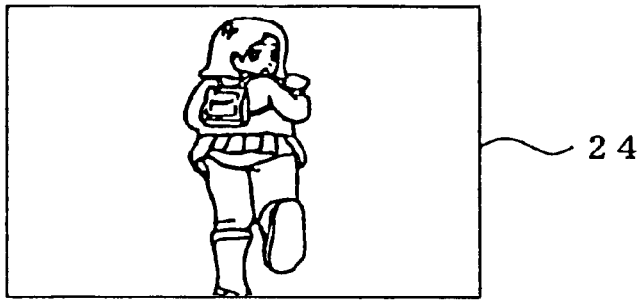
Figure 73D:
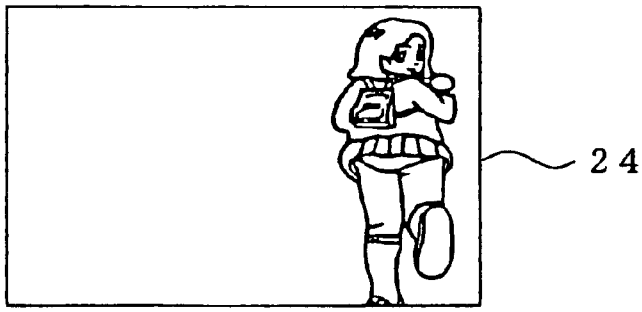

In the second embodiment, in case the reel lamp flashing pattern is selected as the "no flashing" by the information selecting lottery operation (at Step 104' of FIG. 60) using the demonstration lottery table (as should be referred to FIGS. 55 to 57), the stop staging means display nothing in the liquid crystal display unit 24. as shown in FIG. 73A, when all the individual reels 3 to 5 are stopped. Successively, on the left of the liquid crystal display unit 24, as shown in FIG. 73B, there is displayed the basic position in which a first character "Amichan" raises a right leg slightly to show its back. Next, the same basic position of the character "Amichan" is displayed at the center of the liquid crystal display unit 24, as shown in FIG. 73C. Finally, the same basic position of the character "Amichan" is displayed on the right of the liquid crystal display unit 24, as shown in FIG. 73D.

FIGS. 74A to 74D show the operation pattern 2 for staging the second stop display mode corresponding to the aforementioned reel lamp flashing pattern 1.

Figure 74A:
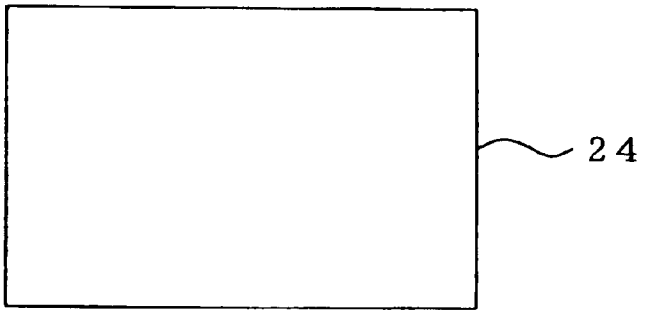
FIGS. 74A to 74D are views showing a second interlocking display mode to be informed to the player by the connective staging means in the game process of the slot machine according to the first modification of the second embodiment.
Figure 74B:
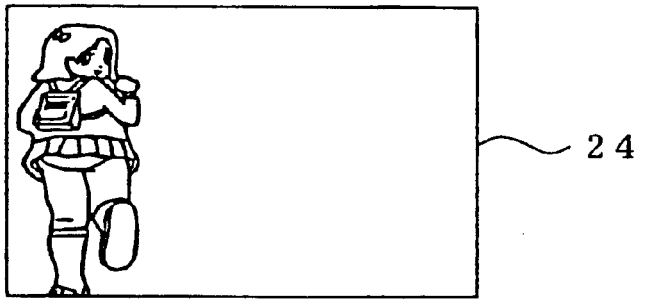
Figure 74C:
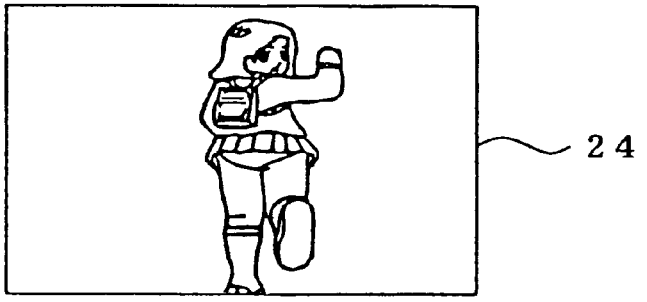
Figure 74D:
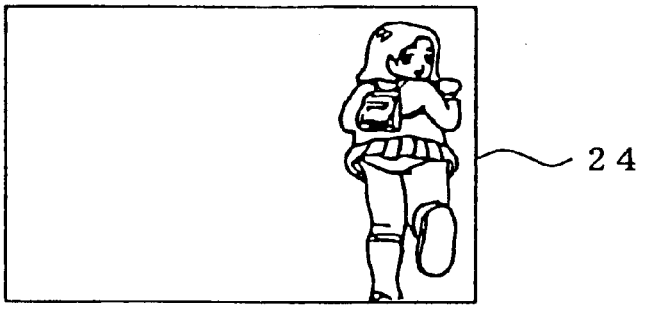

In case the reel lamp flashing pattern is selected as the "flashing pattern 1" by the information selecting lottery operation using the demonstration lottery table, the stop staging means display nothing in the liquid crystal display unit 24, as shown in FIG. 74A, when all the individual reels 3 to 5 are stopped. Successively, on the left of the liquid crystal display unit 24, as shown in FIG. 74B, there is displayed the basic position of the character "Amichan". Next, the position of the character "Amichan" having a raised right hand is displayed at the center of the liquid crystal display unit 24, as shown in FIG. 74C. Finally, the basic position of the character "Amichan" is displayed on the right of the liquid crystal display unit 24, as shown in FIG. 74D.

FIGS. 75A to 75D show the operation pattern 3 for staging the third stop display mode corresponding to the aforementioned reel lamp flashing pattern 2.

Figure 75A:
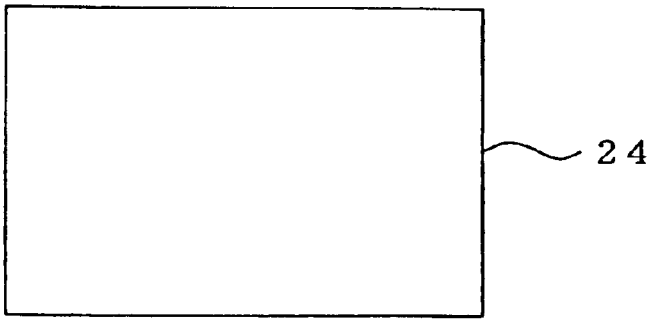
FIGS. 75A to 75D are views showing a third interlocking display mode to be informed to the player by the connective staging means in the game process of the slot machine according to the first modification of the second embodiment.
Figure 75B:
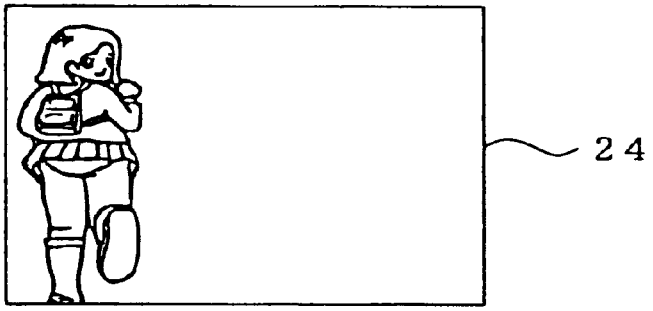
Figure 75C:
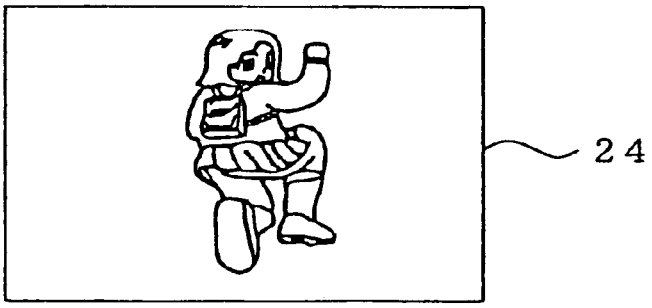
Figure 75D:
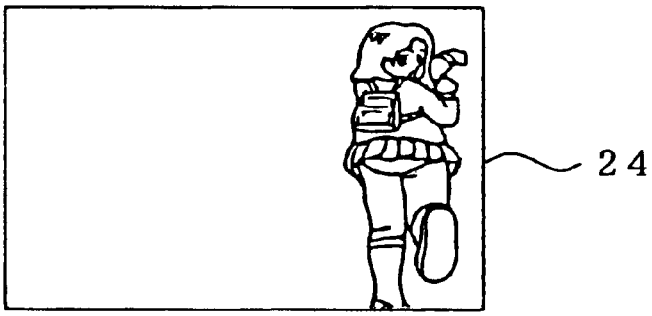

In case the reel lamp flashing pattern is selected as the "flashing pattern 2" by the information selecting lottery operation using the demonstration lottery table, the stop staging means display nothing in the liquid crystal display unit 24, as shown in FIG. 75A, when all the individual reels 3 to 5 are stopped. Successively, on the left of the liquid crystal display unit 24, as shown in FIG. 75B, there is displayed the basic position of the character "Amichan". Next, the position of the character "Amichan" jumping with a raised right hand is displayed at the center of the liquid crystal display unit 24, as shown in FIG. 75C. Finally, the position of the character "Amichan" having a returned right hand and a protruded left hand is displayed on the right of the liquid crystal display unit 24, as shown in FIG. 75D.

FIGS. 76A to 76D show the operation pattern 4 for staging the fourth stop display mode corresponding to the aforementioned reel lamp flashing pattern 3.

Figure 76A:
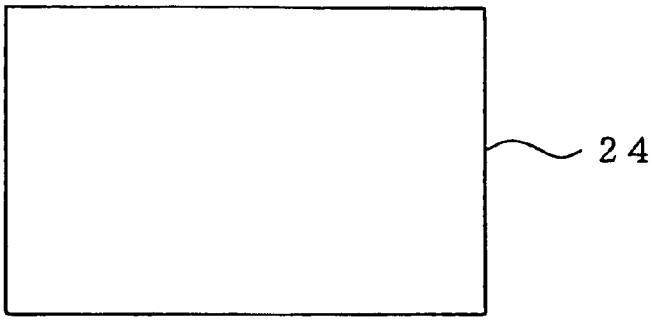
FIGS. 76A to 76D are views showing a fourth interlocking display mode to be informed to the player by the connective staging means in the game process of the slot machine according to the first modification of the second embodiment.
Figure 76B:
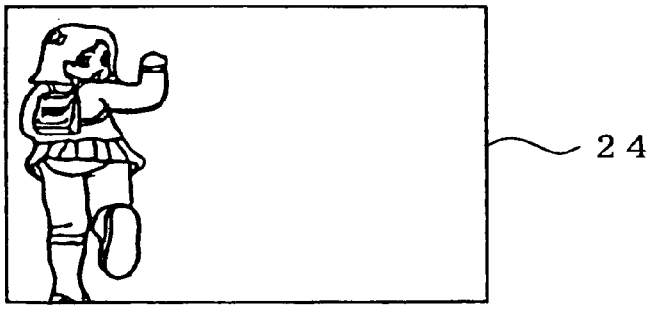
Figure 76C:
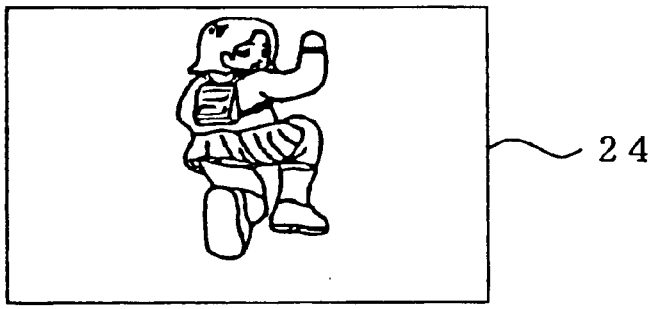
Figure 76D:
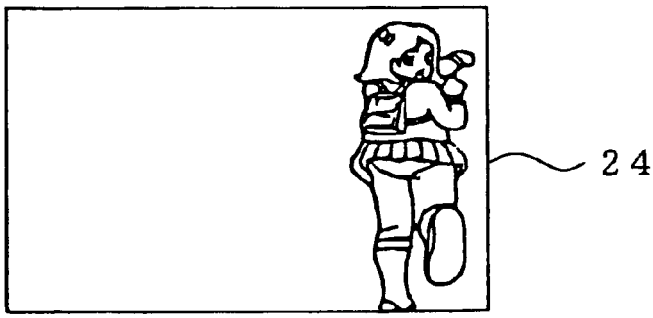

In case the reel lamp flashing pattern is selected as the "flashing pattern 3" by the information selecting lottery operation using the demonstration lottery table, the stop staging means display nothing in the liquid crystal display unit 24, as shown in FIG. 76A, when all the individual reels 3 to 5 are stopped. Successively, on the left of the liquid crystal display unit 24, as shown in FIG. 76B, there is displayed the basic position of the character "Amichan" having a raised right hand. Next, the position of the character "Amichan" jumping with a raised right hand is displayed at the center of the liquid crystal display unit 24, as shown in FIG. 76C. Finally, the position of the character "Amichan" having a returned right hand and a protruded left hand is displayed on the right of the liquid crystal display unit 24, as shown in FIG. 76D.

FIGS. 77A to 77D show the operation pattern 5 for staging the fifth stop display mode corresponding to the aforementioned reel lamp flashing pattern 4.

Figure 77A:
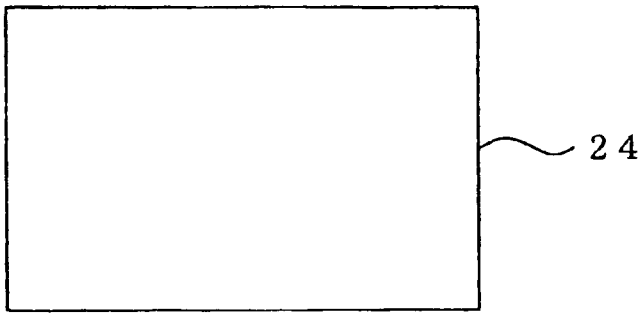
FIGS. 77A to 77D are views showing a fifth interlocking display mode to be informed to the player by the connective staging means in the game process of the slot machine according to the first modification of the second embodiment.
Figure 77B:
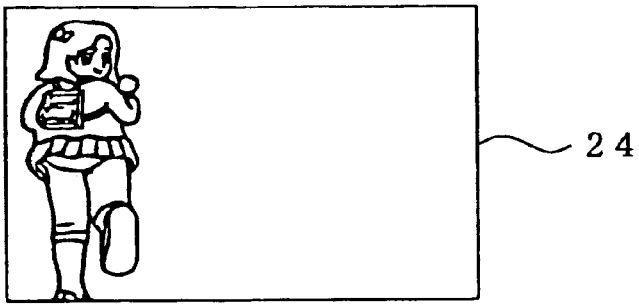
Figure 77C:
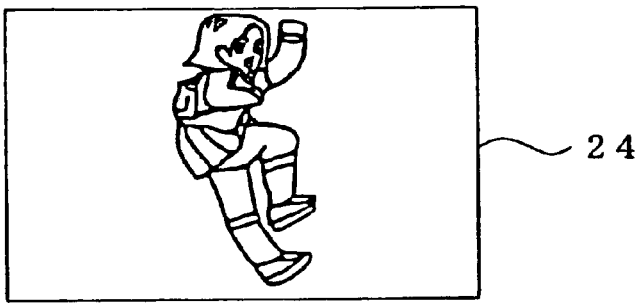
Figure 77D:
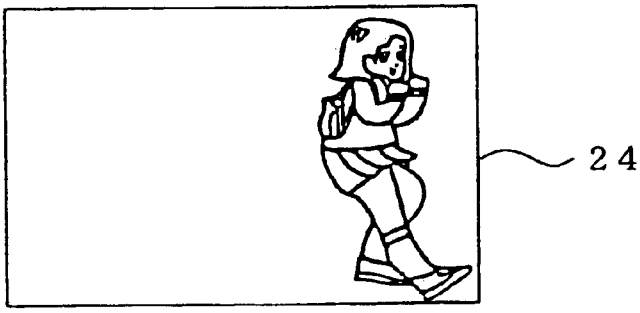

In case the reel lamp flashing pattern is selected as the "flashing pattern 4" by the information selecting lottery operation using the demonstration lottery table, the stop staging means display nothing in the liquid crystal display unit 24, as shown in FIG. 77A, when all the individual reels 3 to 5 are stopped. Successively, on the left of the liquid crystal display unit 24, as shown in FIG. 77B, there is displayed the basic position of the character "Amichan". Next, the position of the character "Amichan" skipping with a raised upper half is displayed at the center of the liquid crystal display unit 24, as shown in FIG. 77C. Finally, the position of the character "Amichan" having a right heel grounded while two gripped hands approaching the face is displayed on the right of the liquid crystal display unit 24, as shown in FIG. 77D.

FIGS. 78A to 78D show the operation pattern 6 for staging the sixth stop display mode corresponding to the aforementioned reel lamp flashing pattern 5.

Figure 78A:
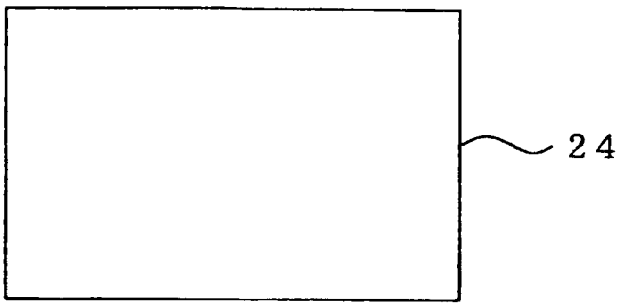
FIGS. 78A to 78D are views showing a sixth interlocking display mode to be informed to the player by the connective staging means in the game process of the slot machine according to the first modification of the second embodiment.
Figure 78B:
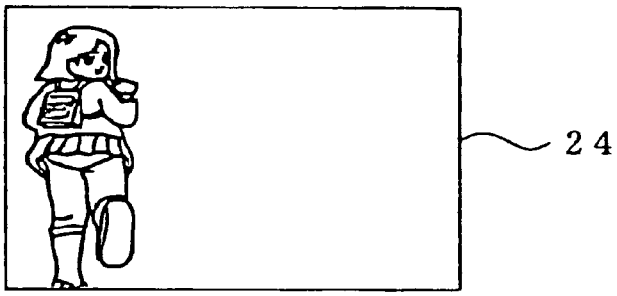
Figure 78C:
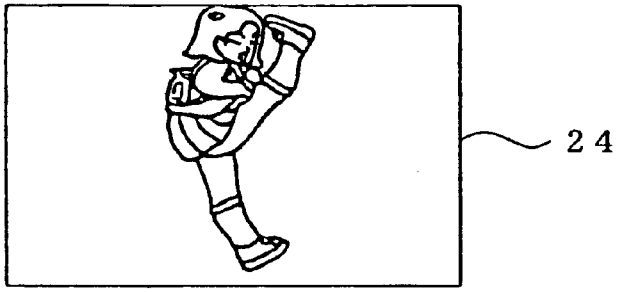
Figure 78D:
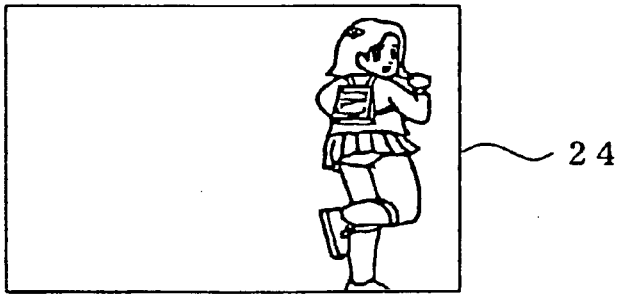

In case the reel lamp flashing pattern is selected as the "flashing pattern 5" by the information selecting lottery operation using the demonstration lottery table, the stop staging means display nothing in the liquid crystal display unit 24, as shown in FIG. 78A, when all the individual reels 3 to 5 are stopped. Successively, on the left of the liquid crystal display unit 24, as shown in FIG. 78B, there is displayed the basic position of the character "Amichan". Next, the position of the character "Amichan" floating slightly with a highly raised right leg is displayed at the center of the liquid crystal display unit 24, as shown in FIG. 78C. Finally, the position of the character "Amichan" having a right leg slightly raised back while having a left foot grounded is displayed on the right of the liquid crystal display unit 24, as shown in FIG. 78D.

FIGS. 79A to 79D show the operation pattern 7 for staging the seventh stop display mode corresponding to the aforementioned reel lamp flashing pattern 6.

Figure 79A:
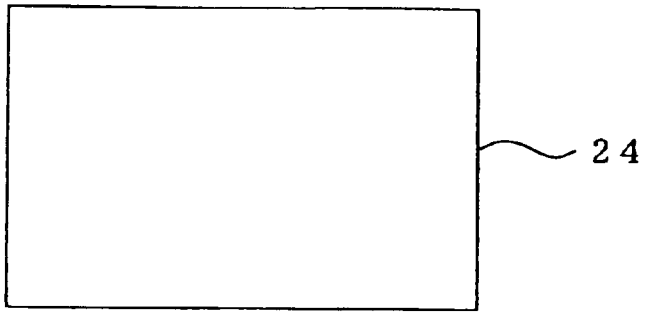
FIGS. 79A to 79D are views showing a seventh interlocking display mode to be informed to the player by the connective staging means in the game process of the slot machine according to the first modification of the second embodiment.
Figure 79B:
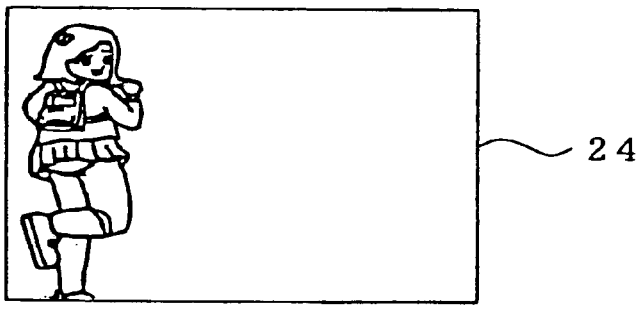
Figure 79C:
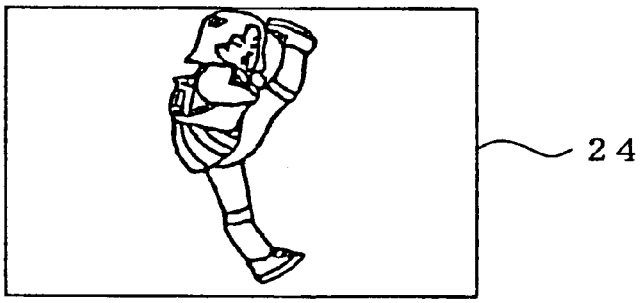
Figure 79D:
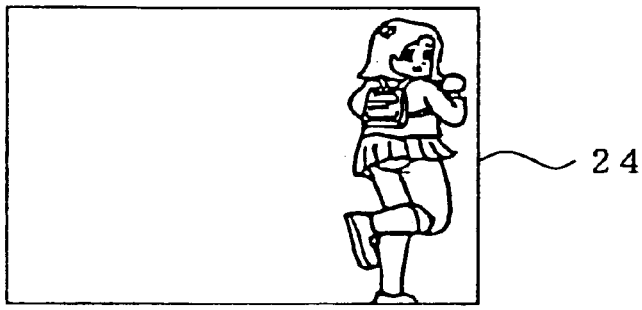

In case the reel lamp flashing pattern is selected as the "flashing pattern 6" by the information selecting lottery operation using the demonstration lottery table, the stop staging means display nothing in the liquid crystal display unit 24, as shown in FIG. 79A, when all the individual reels 3 to 5 are stopped. Successively, on the left of the liquid crystal display unit 24, as shown in FIG. 79B, there is displayed the position of the character "Amichan" having a right leg slightly raised back and a grounded left foot. Next, the position of the character "Amichan" floating slightly with a highly raised right leg is displayed at the center of the liquid crystal display unit 24, as shown in FIG. 79C. Finally, the position of the character "Amichan" having a right leg slightly raised back while having a left foot grounded is displayed on the right of the liquid crystal display unit 24, as shown in FIG. 79D.

FIGS. 80A to 80D show the operation pattern 8 for staging the eighth stop display mode corresponding to the aforementioned reel lamp flashing pattern 7.

Figure 80A:
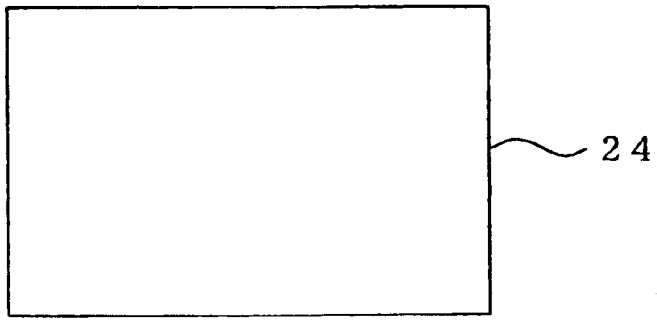
FIGS. 80A to 80D are views showing an eighth interlocking display mode to be informed to the player by the connective staging means in the game process of the slot machine according to the first modification of the second embodiment.
Figure 80B:
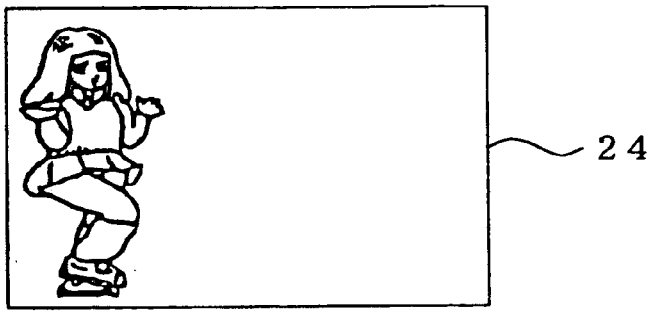
Figure 80C:
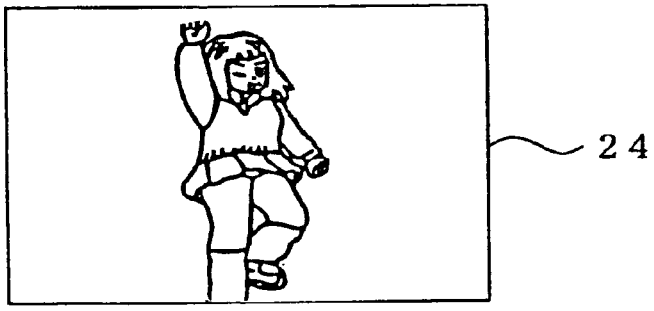
Figure 80D:
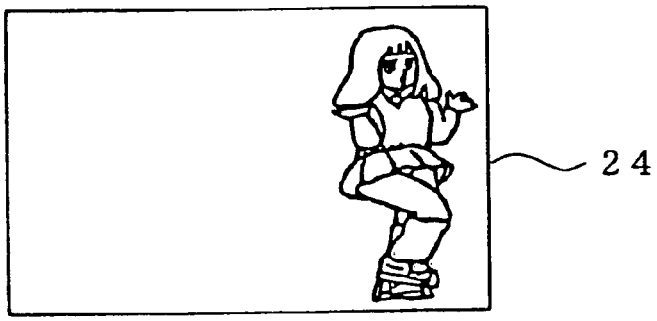

In case the reel lamp flashing pattern is selected as the "flashing pattern 7" by the information selecting lottery operation using the demonstration lottery table, the stop staging means display nothing in the liquid crystal display unit 24, as shown in FIG. 80A, when all the individual reels 3 to 5 are stopped. Successively, on the left of the liquid crystal display unit 24, as shown in FIG. 80B, there is displayed the position of a second character "Yumichan" having a right leg slightly raised while having two palms directed upward. Next, the position of the character "Yumichan" having a slightly raised left leg and a right hand raised highly while leaving a left hand down is displayed at the center of the liquid crystal display unit 24, as shown in FIG. 80C. Finally, the position of the character "Yumichan" having a right leg slightly raised and two palms directed upward is displayed on the right of the liquid crystal display unit 24, as shown in FIG. 80D.

FIGS. 81A to 81E show the operation pattern 9 for staging the ninth stop display mode corresponding to the aforementioned reel lamp flashing pattern 8.

Figure 81A:
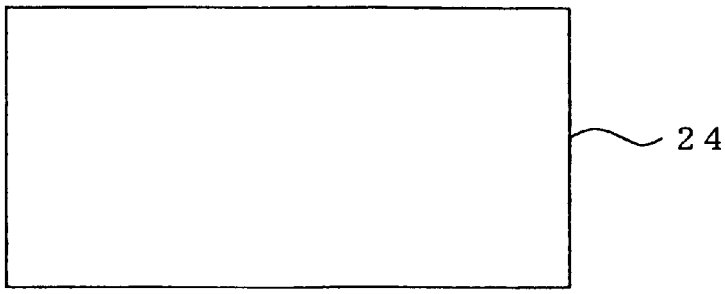
FIGS. 81A to 81E are views showing a ninth interlocking display mode to be informed to the player by the connective staging means in the game process of the slot machine according to the first modification of the second embodiment.
Figure 81B:
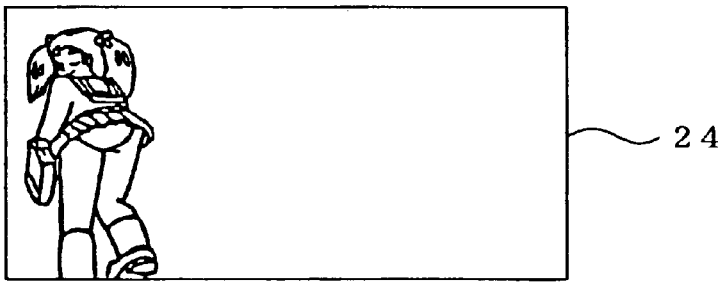
Figure 81C:
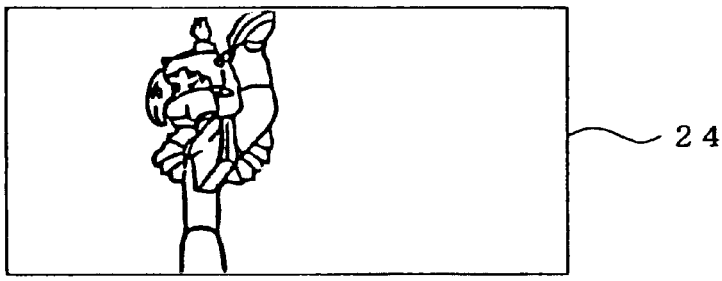
Figure 81D:
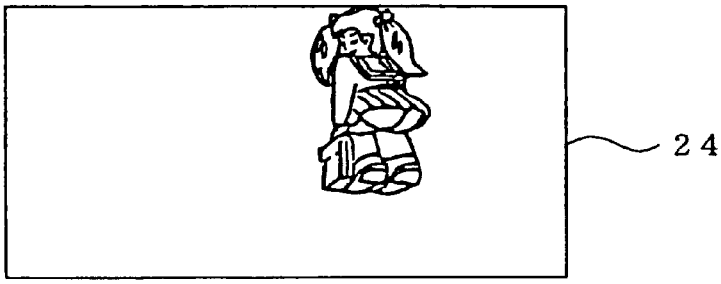
Figure 81E:
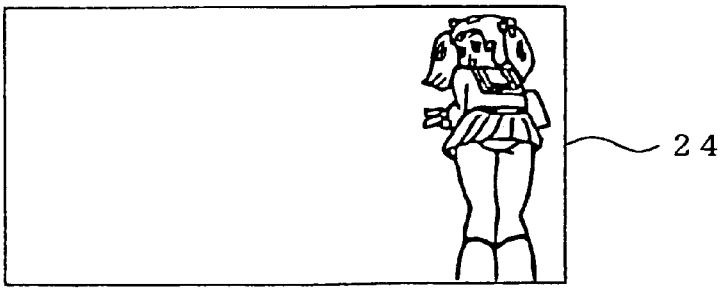

In case the reel lamp flashing pattern is selected as the "flashing pattern 8" by the information selecting lottery operation using the demonstration lottery table, the stop staging means display nothing in the liquid crystal display unit 24, as shown in FIG. 81A, when all the individual reels 3 to 5 are stopped. Successively, on the left of the liquid crystal display unit 24, as shown in FIG. 581B, there is displayed the position of a third character "Kumichan" having hair hanging down the back while having a right leg slightly bent and a bag at her left hand. Next, the position of the character "Kumichan" having a right leg raised back highly and a right hand raised highly forward is displayed at the left-hand center of the liquid crystal display unit 24, as shown in FIG. 81C. Next, the position of the character "Kumichan" jumping while holding her two legs is displayed at right-hand center of the liquid crystal display unit 24, as shown in FIG. 81D. Finally, the position of the character "Kumichan" directed back while holding a bag on her right is displayed on the right of the liquid crystal display unit 24, as shown in FIG. 81E.

FIGS. 82A to 82E show the operation pattern 10 for staging the tenth stop display mode corresponding to the aforementioned reel lamp flashing pattern 9.

Figure 82A:
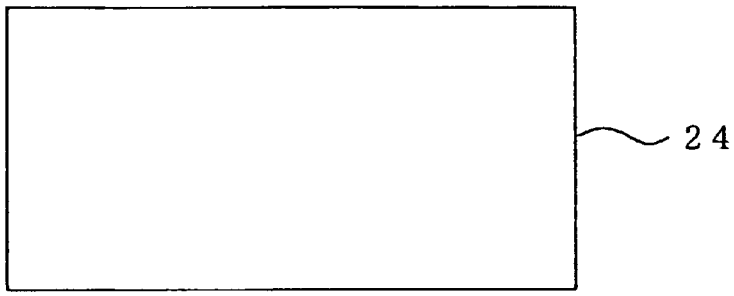
FIGS. 82A to 82E are views showing a tenth interlocking display mode to be informed to the player by the connective staging means in the game process of the slot machine according to the first modification of the second embodiment.
Figure 82B:
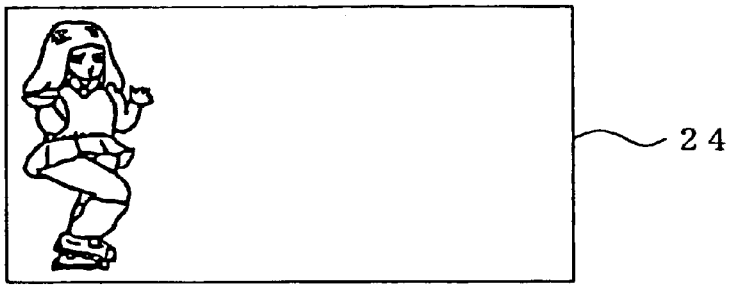
Figure 82C:
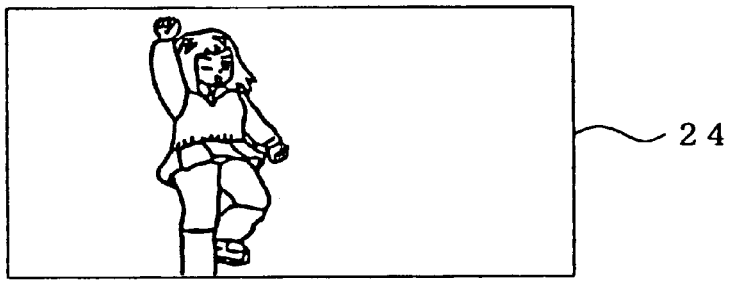
Figure 82D:
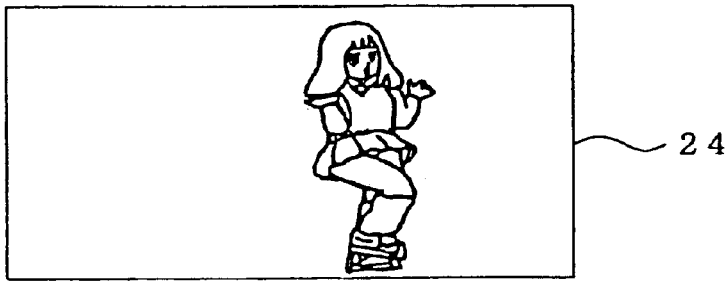
Figure 82E:
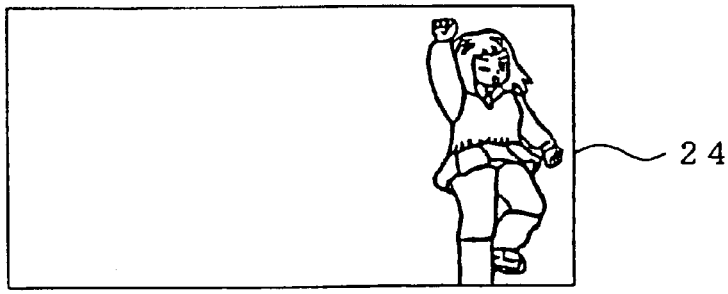
Figure 83A:
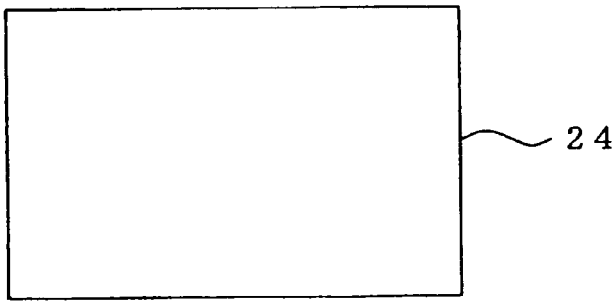
FIGS. 83A to 83D are views showing a first interlocking display mode to be informed to the player by the connective staging means in the game process of the slot machine according to a second modification of the second embodiment.
Figure 83B:
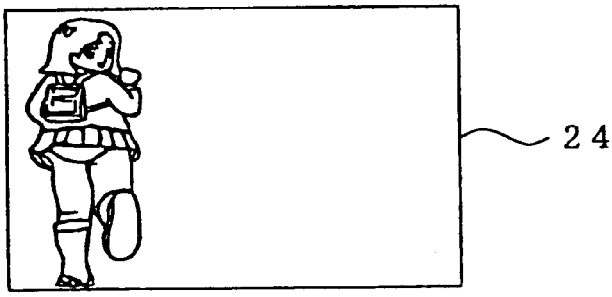
Figure 83C:
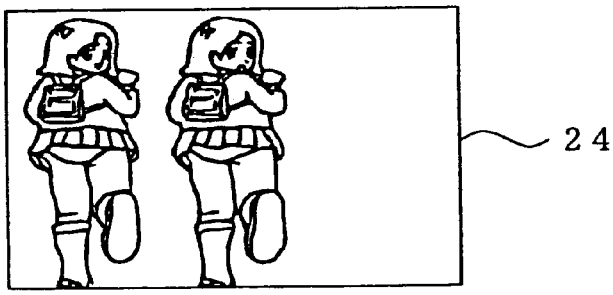
Figure 83D:
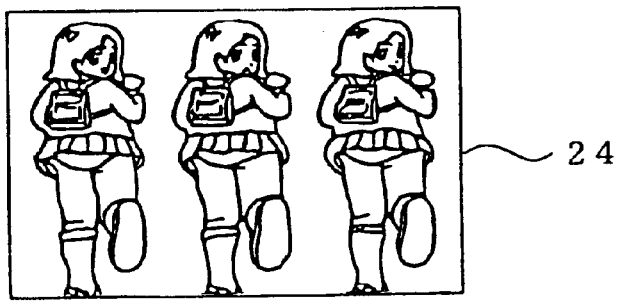
Figure 84A:
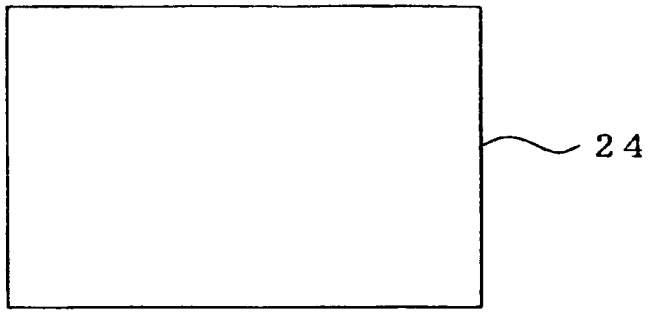
FIGS. 84A to 84D are views showing a second interlocking display mode to be informed to the player by the connective staging means in the game process of the slot machine according to the second modification of the second embodiment.
Figure 84B:
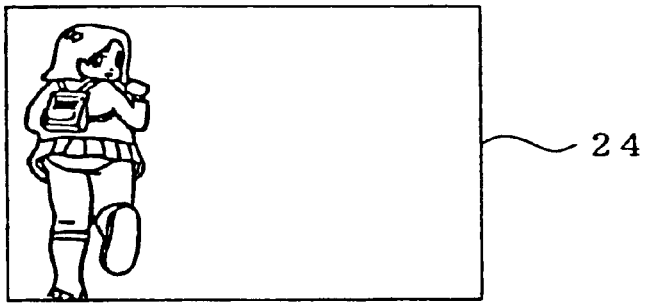
Figure 84C:
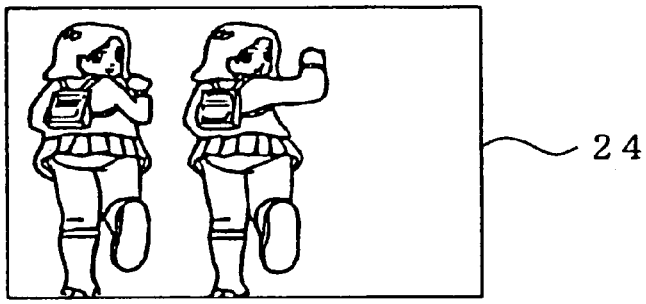
Figure 84D:
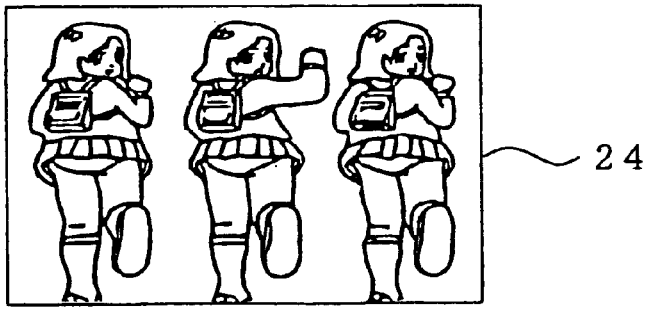
Figure 85A:
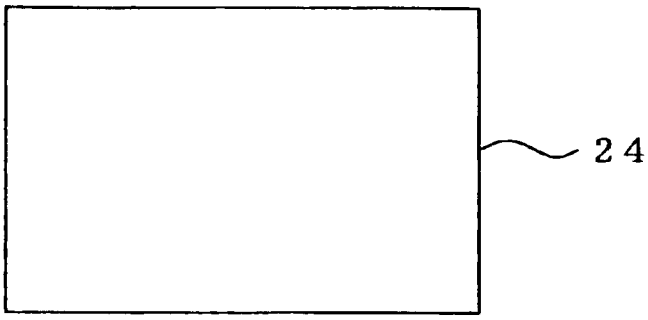
FIGS. 85A to 85D are views showing a third interlocking display mode to be informed to the player by the connective staging means in the game process of the slot machine according to the second modification of the second embodiment.
Figure 85B:
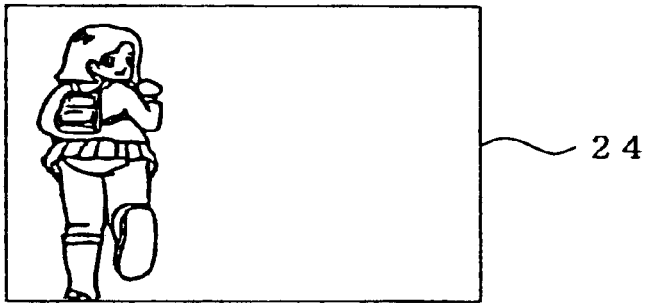
Figure 85C:
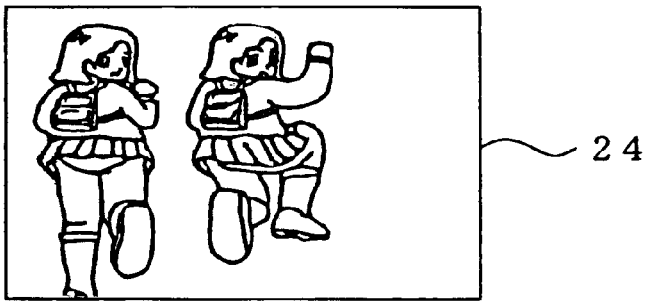
Figure 85D:
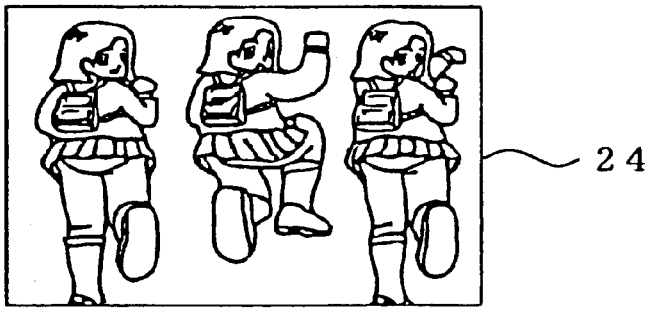
Figure 86A:
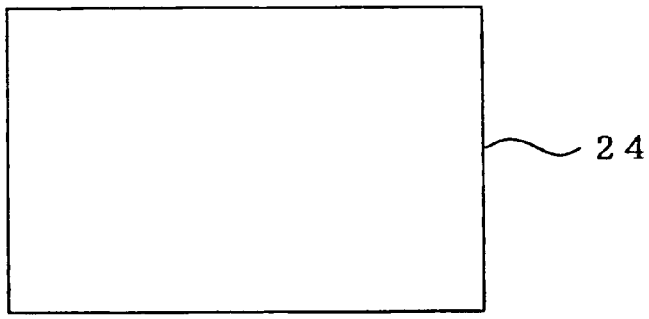
FIGS. 86A to 86D are views showing a fourth interlocking display mode to be informed to the player by the connective staging means in the game process of the slot machine according to the second modification of the second embodiment.
Figure 86B:
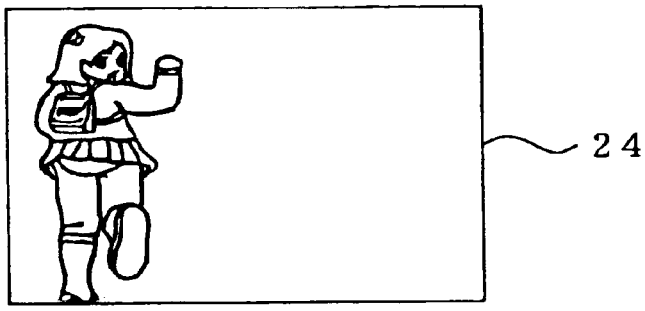
Figure 86C:
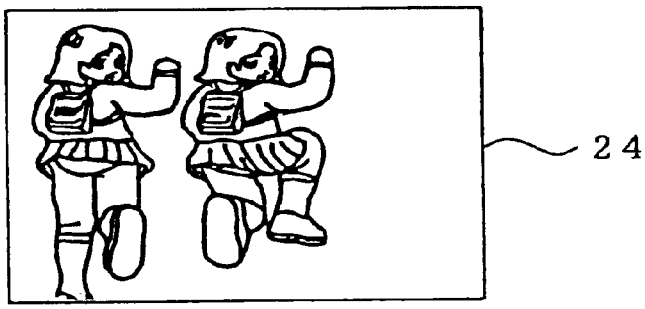
Figure 86D:
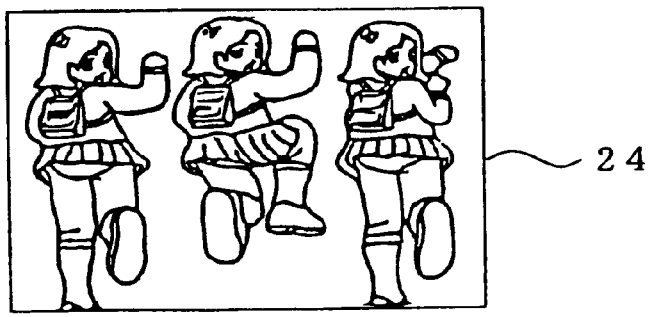
Figure 87A:
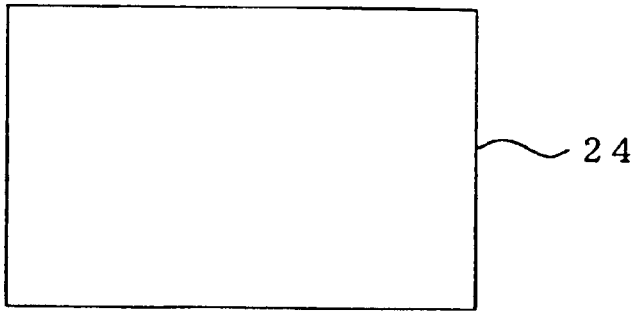
FIGS. 87A to 87D are views showing a fifth interlocking display mode to be informed to the player by the connective staging means in the game process of the slot machine according to the second modification of the second embodiment.
Figure 87B:
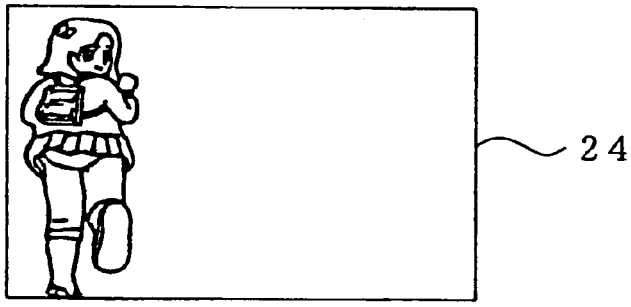
Figure 87C:
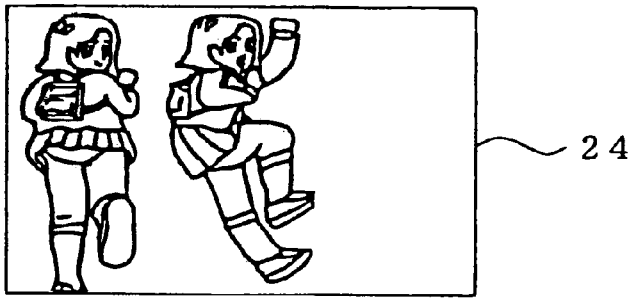
Figure 87D:
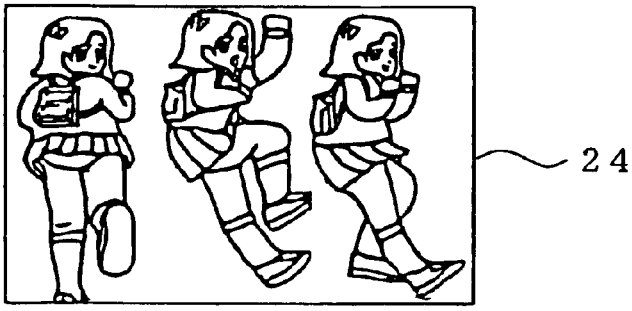
Figure 88A:
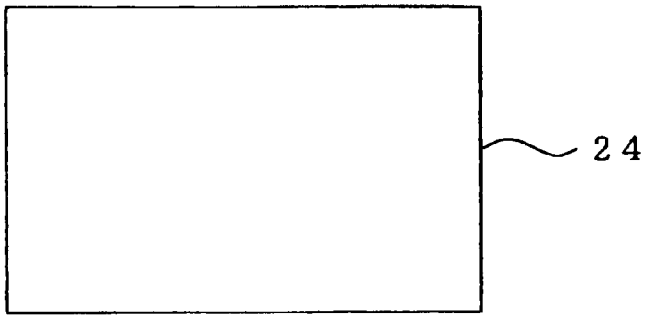
FIGS. 88A to 88D are views showing a sixth interlocking display mode to be informed to the player by the connective staging means in the game process of the slot machine according to the second modification of the second embodiment.
Figure 88B:
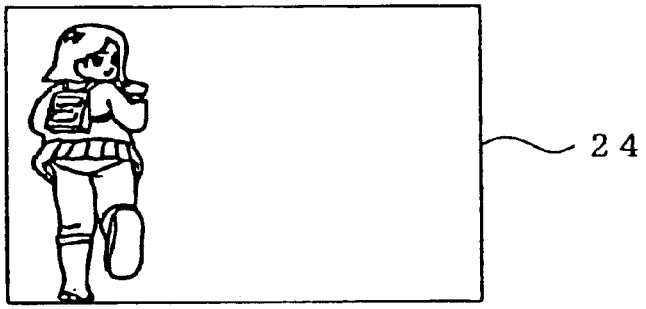
Figure 88C:
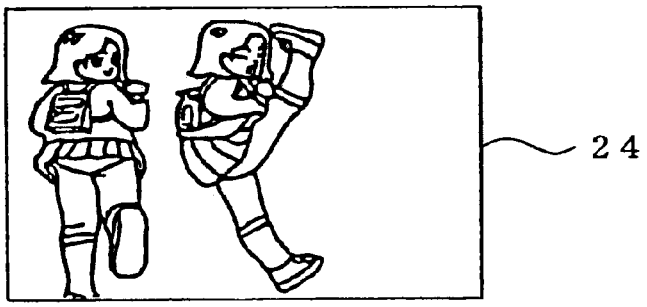
Figure 88D:
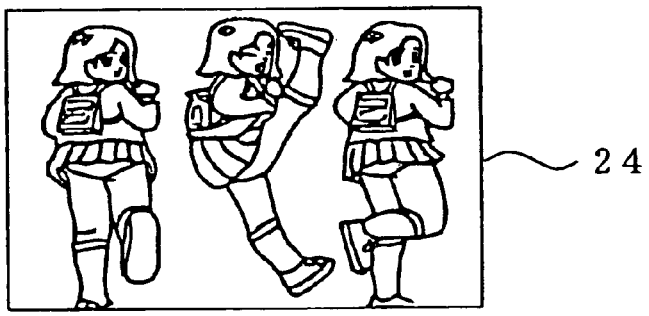
Figure 89A:
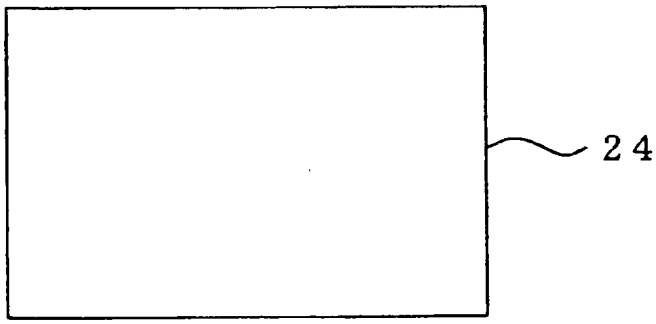
FIGS. 89A to 89D are views showing a seventh interlocking display mode to be informed to the player by the connective staging means in the game process of the slot machine according to the second modification of the second embodiment.
Figure 89B:
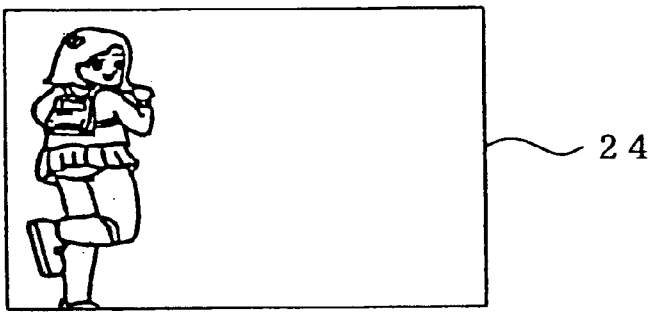
Figure 89C:
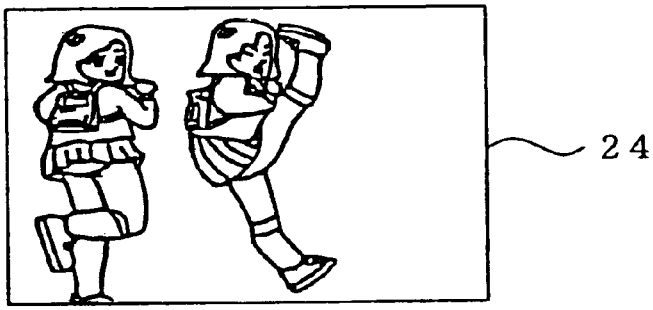
Figure 89D:
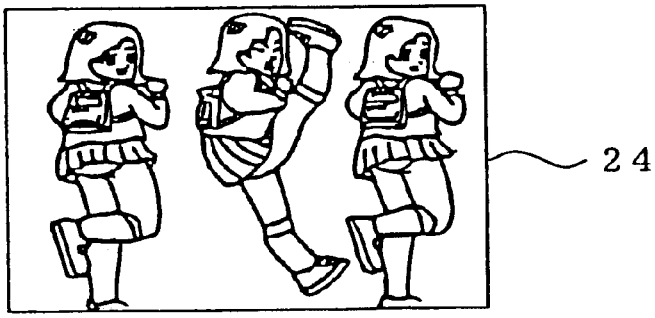
Figure 90A:
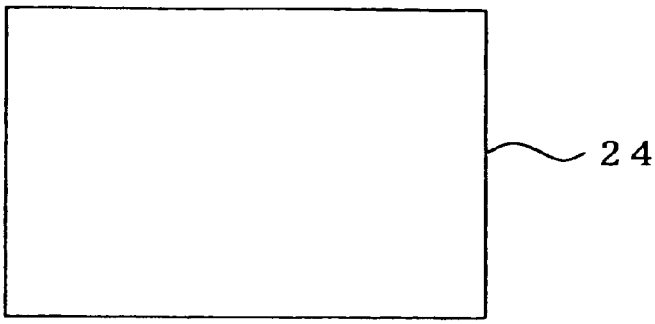
FIGS. 90A to 90D are views showing an eighth interlocking display mode to be informed to the player by the connective staging means in the game process of the slot machine according to the second modification of the second embodiment.
Figure 90B:
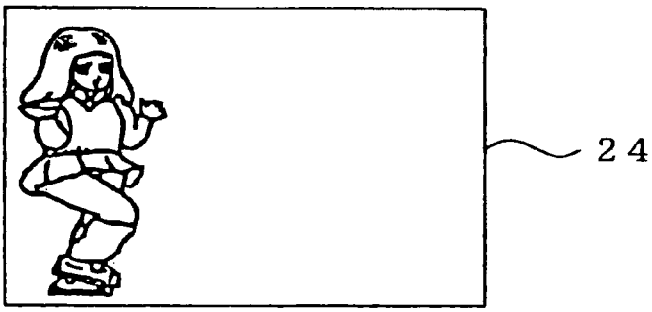
Figure 90C:
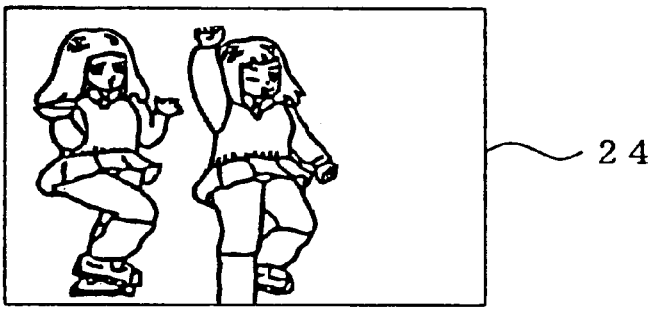
Figure 90D:
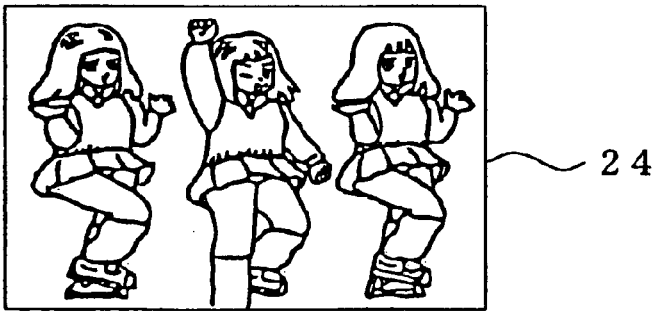
Figure 91A:
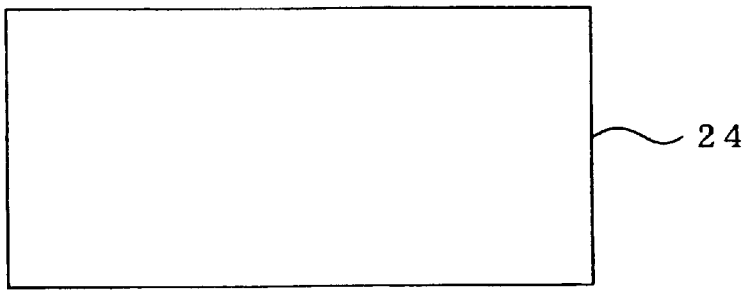
FIGS. 91A to 91E are views showing a ninth interlocking display mode to be informed to the player by the connective staging means in the game process of the slot machine according to the second modification of the second embodiment.
Figure 91B:
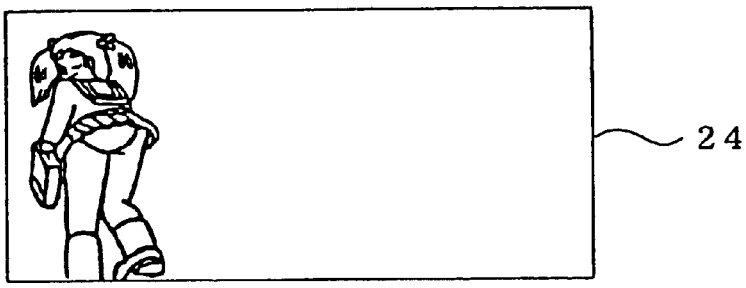
Figure 91C:
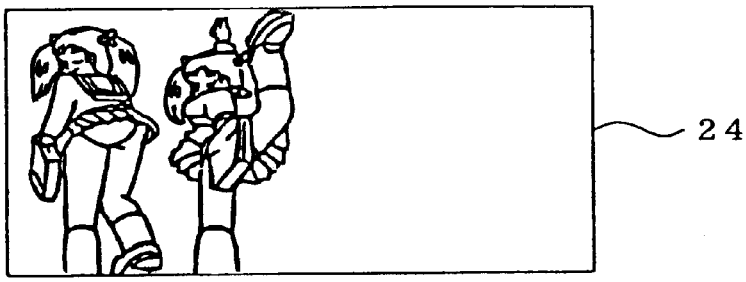
Figure 91D:
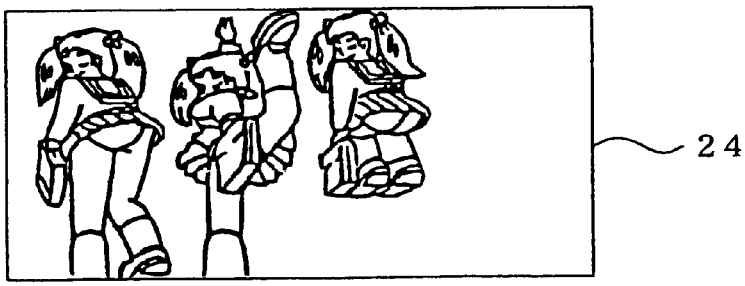
Figure 91E:
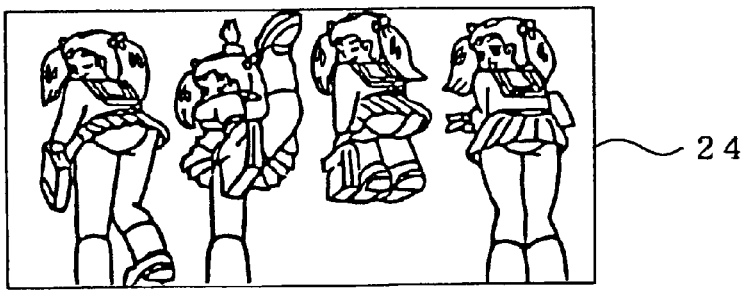
Figure 92A:
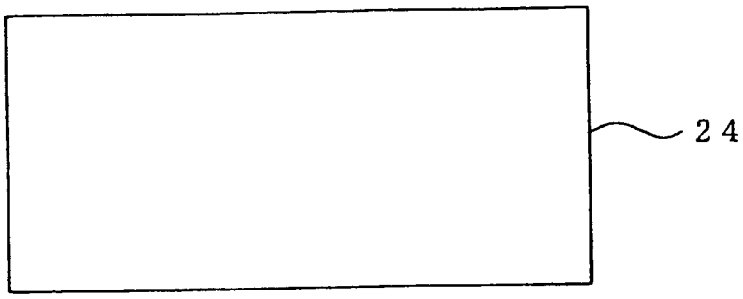
FIGS. 92A to 92E are views showing a tenth interlocking display mode to be informed to the player by the connective staging means in the game process of the slot machine according to the second modification of the second embodiment.
Figure 92B:
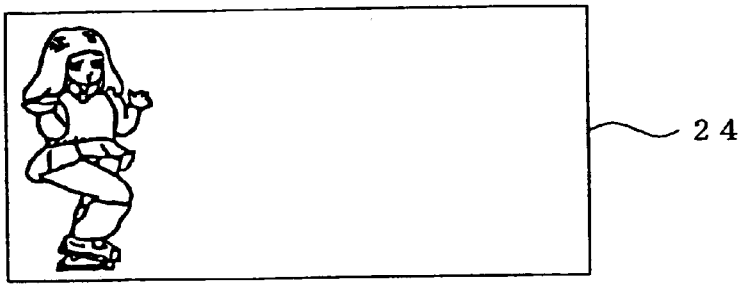
Figure 92C:
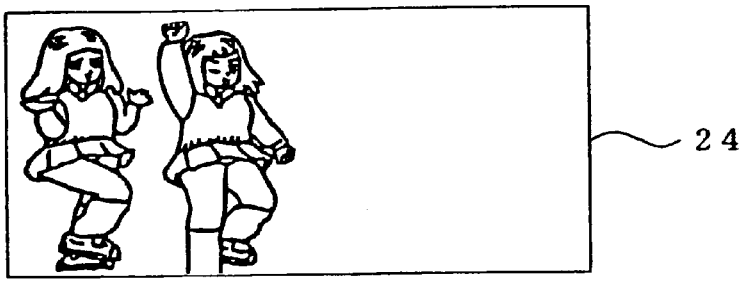
Figure 92D:
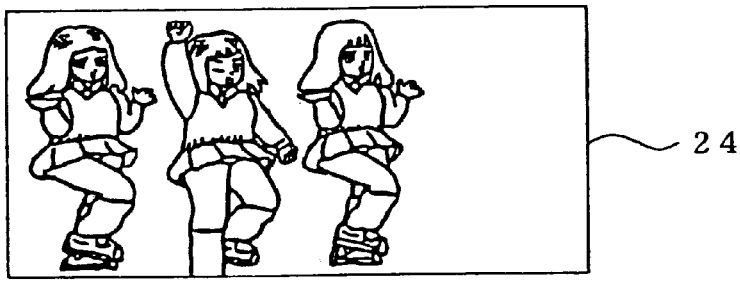
Figure 92E:
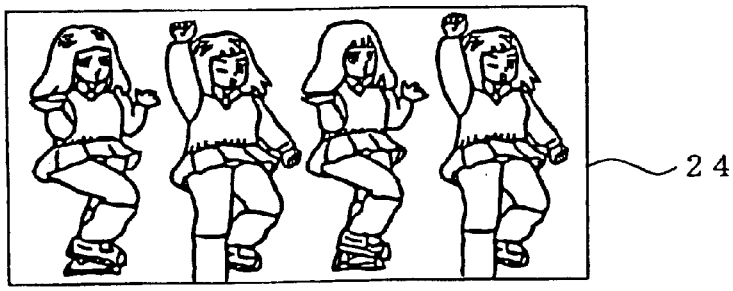
Figure 93A:
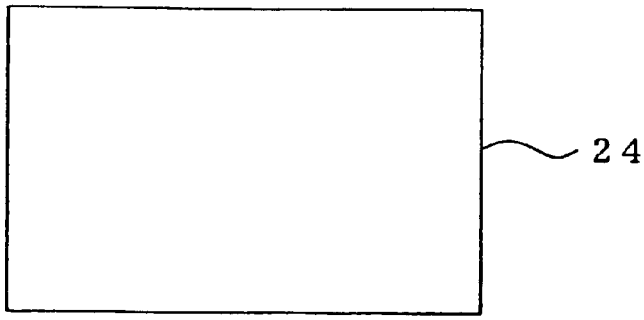
FIGS. 93A to 93D are views showing a first interlocking display mode to be informed to the player by the connective staging means in the game process of the slot machine according to a third modification of the second embodiment.
Figure 93B:
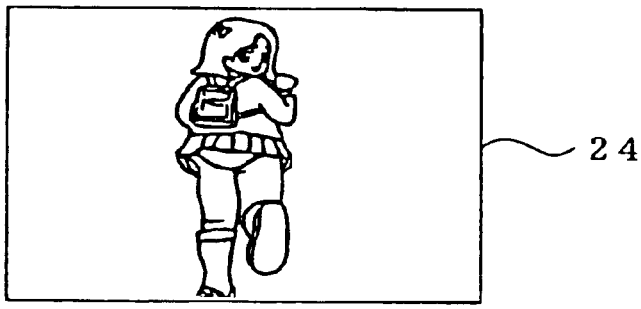
Figure 93C:
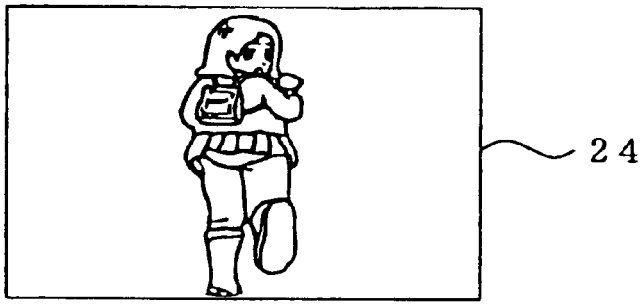
Figure 93D:
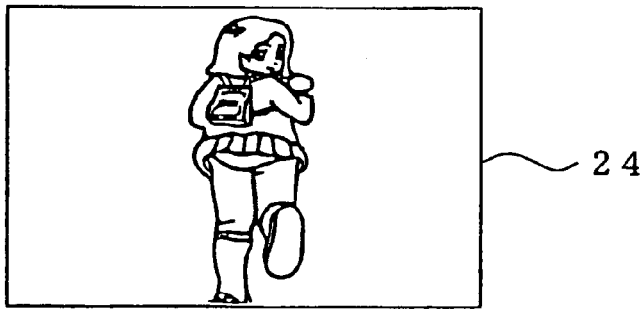
Figure 94A:
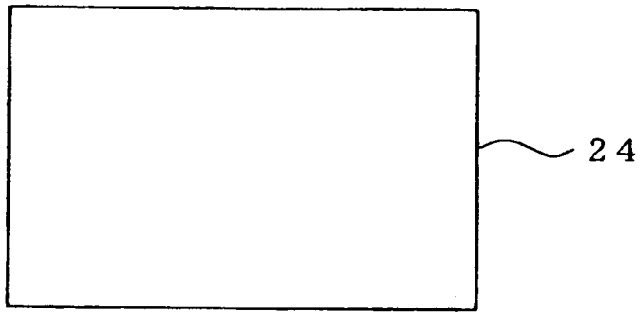
FIGS. 94A to 94D are views showing a second interlocking display mode to be informed to the player by the connective staging means in the game process of the slot machine according to the third modification of the second embodiment.
Figure 94B:
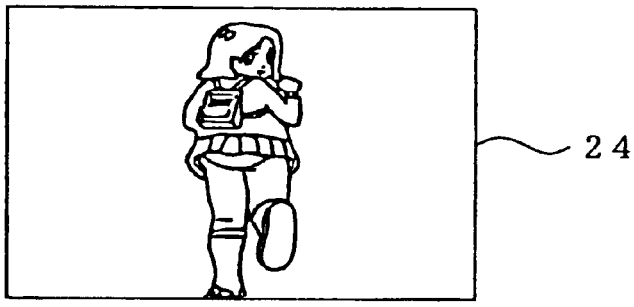
Figure 94C:
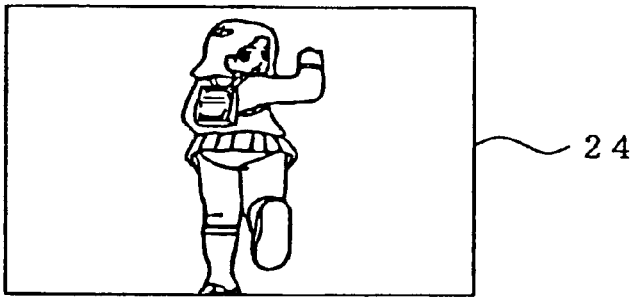
Figure 94D:
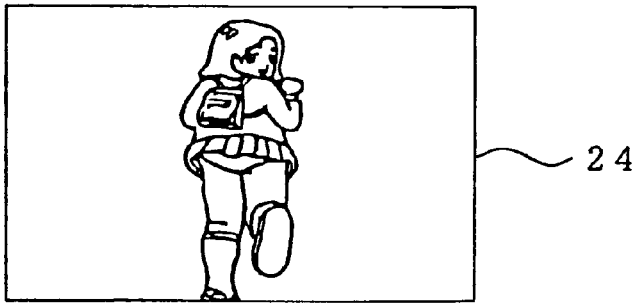
Figure 95A:
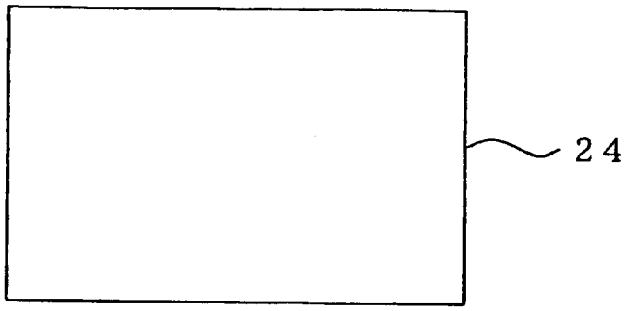
FIGS. 95A to 95D are views showing a third interlocking display mode to be informed to the player by the connective staging means in the game process of the slot machine according to the third modification of the second embodiment.
Figure 95B:
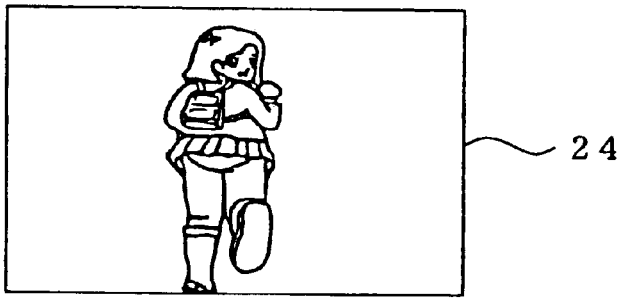
Figure 95C:
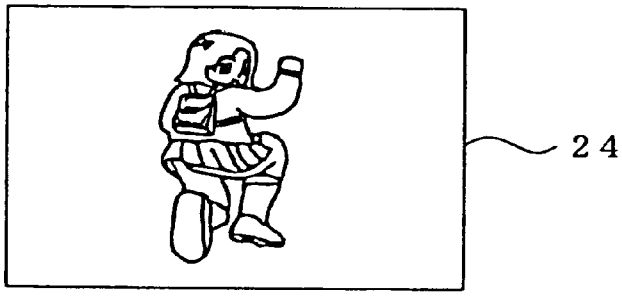
Figure 95D:
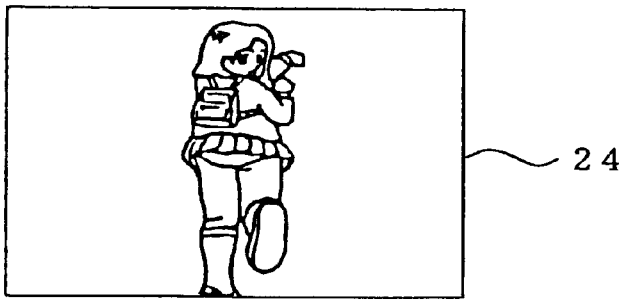
Figure 96A:
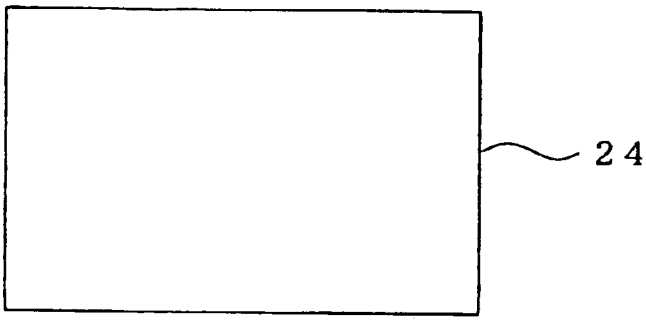
FIGS. 96A to 96D are views showing a fourth interlocking display mode to be informed to the player by the connective staging means in the game process of the slot machine according to the third modification of the second embodiment.
Figure 96B:
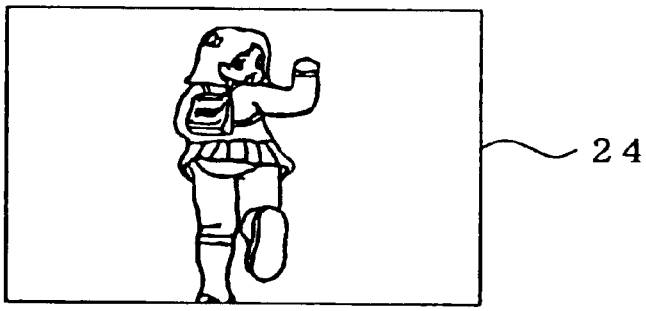
Figure 96C:
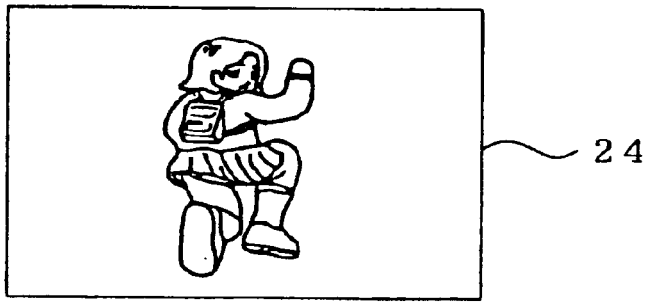
Figure 96D:
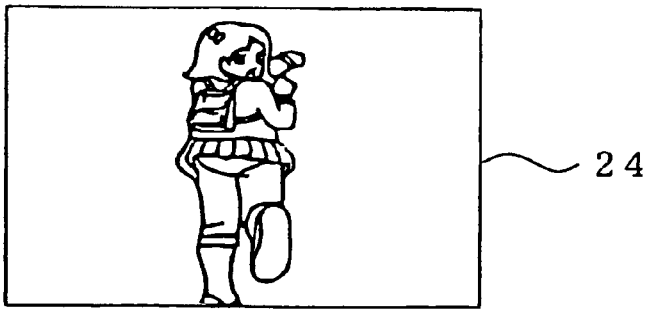
Figure 97A:
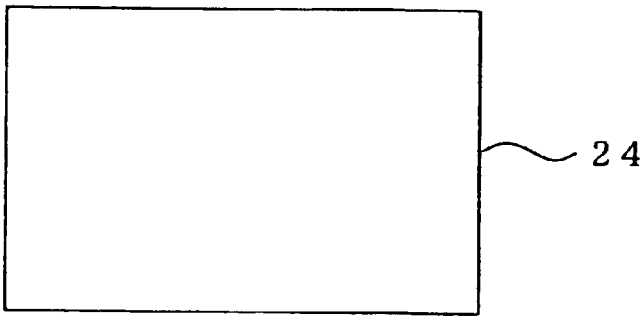
FIGS. 97A to 97D are views showing a fifth interlocking display mode to be informed to the player by the connective staging means in the game process of the slot machine according to the third modification of the second embodiment.
Figure 97B:
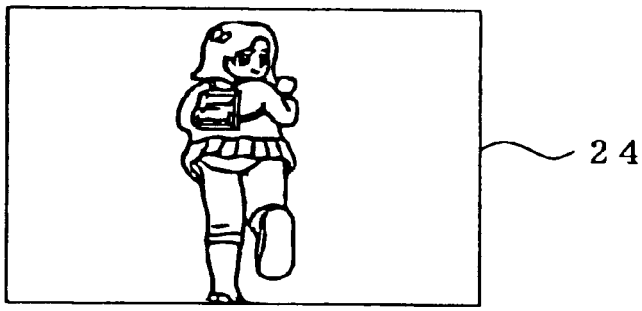
Figure 97C:
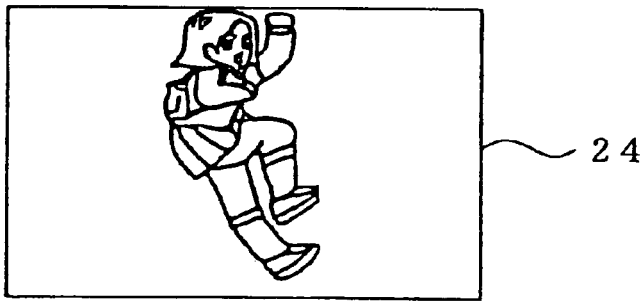
Figure 97D:
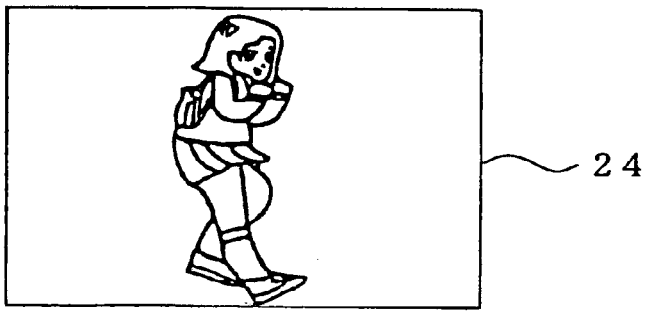
Figure 98A:
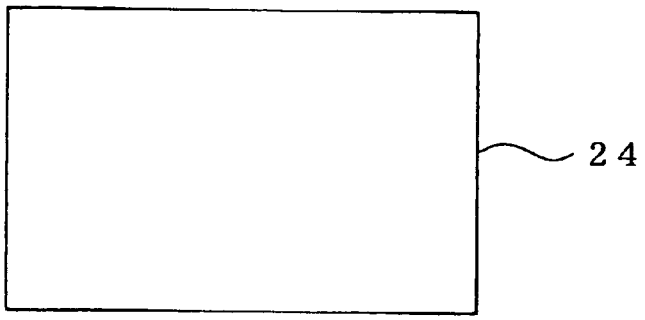
FIGS. 98A to 98D are views showing a sixth interlocking display mode to be informed to the player by the connective staging means in the game process of the slot machine according to the third modification of the second embodiment.
Figure 98B:
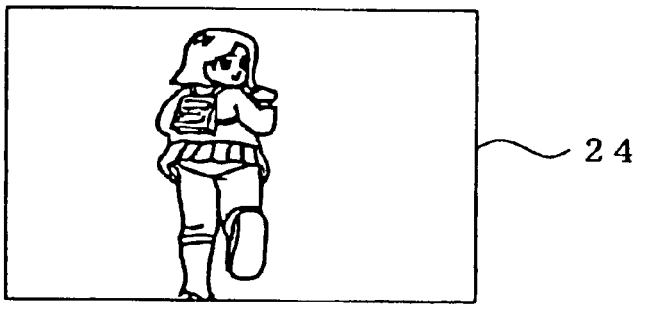
Figure 98C:
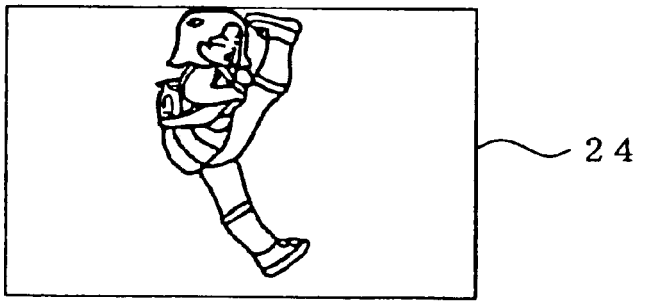
Figure 98D:
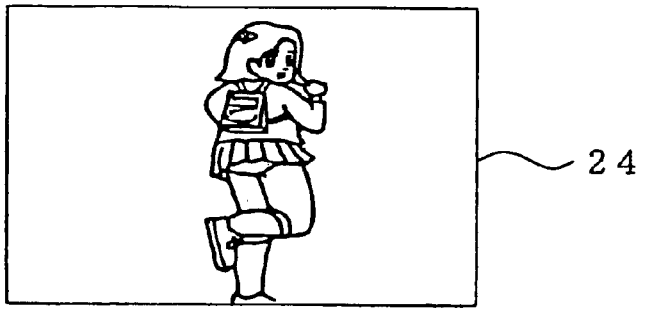
Figure 99A:
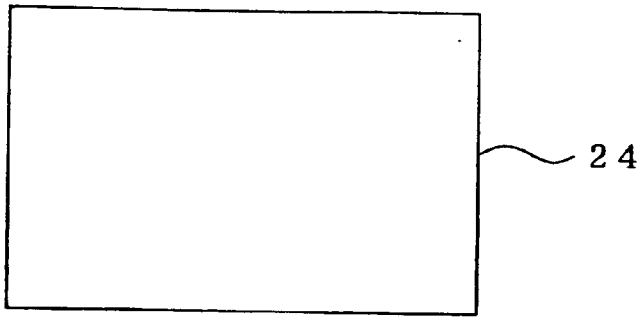
FIGS. 99A to 99D are views showing a seventh connective display mode to be informed to the player by the connective staging means in the game process of the slot machine according to the third modification of the second embodiment.
Figure 99B:
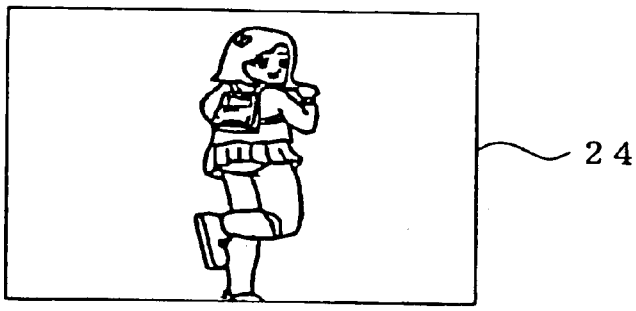
Figure 99C:
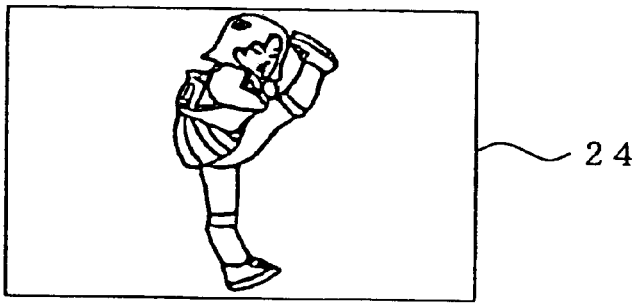
Figure 99D:
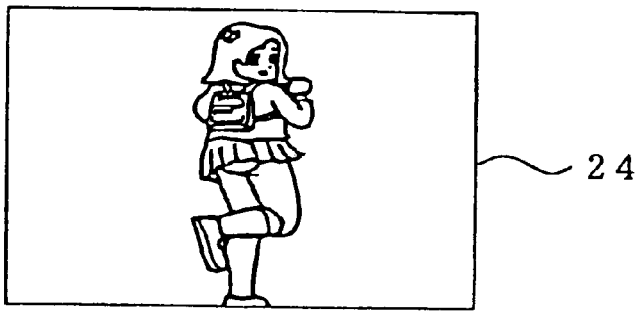
Figure 100A:
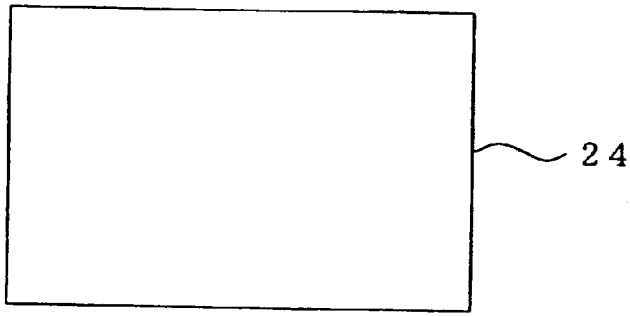
FIGS. 100A to 100D are views showing an eighth connective display mode to be informed to the player by the connective staging means in the game process of the slot machine according to the third modification of the second embodiment.
Figure 100B:
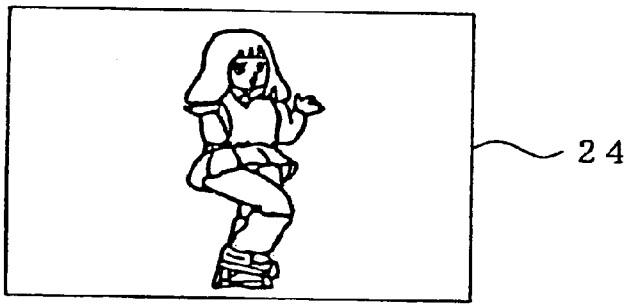
Figure 100C:
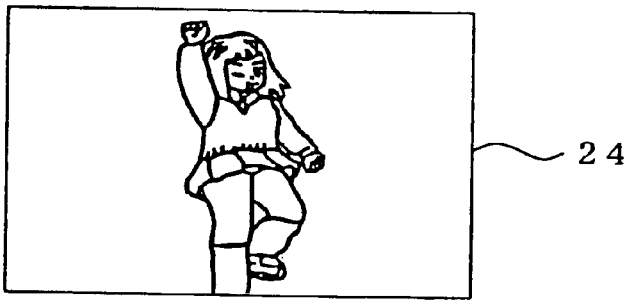
Figure 100D:
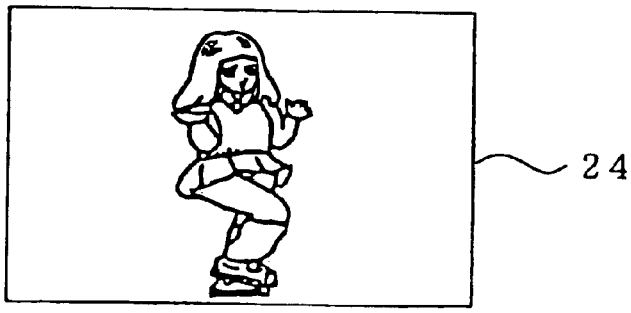
Figure 101A:
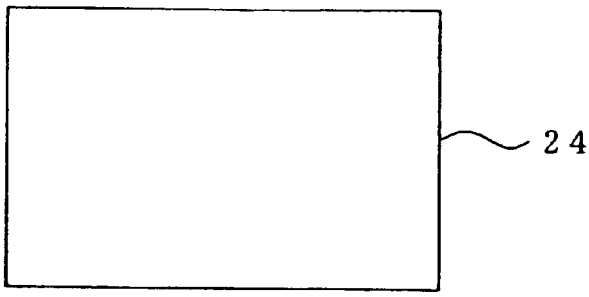
FIGS. 101A to 101E are views showing a ninth connective display mode to be informed to the player by the connective staging means in the game process of the slot machine according to the third modification of the second embodiment.
Figure 101B:
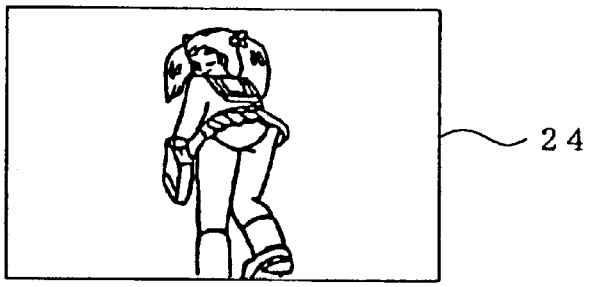
Figure 101C:
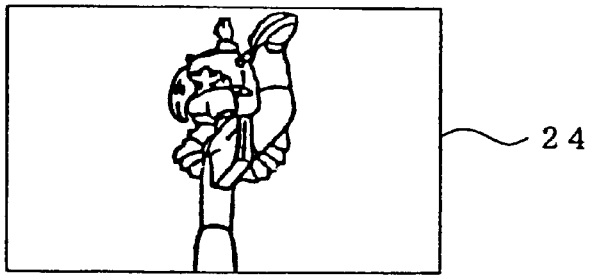
Figure 101D:
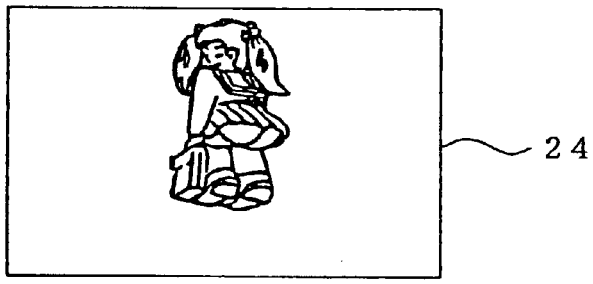
Figure 101E:
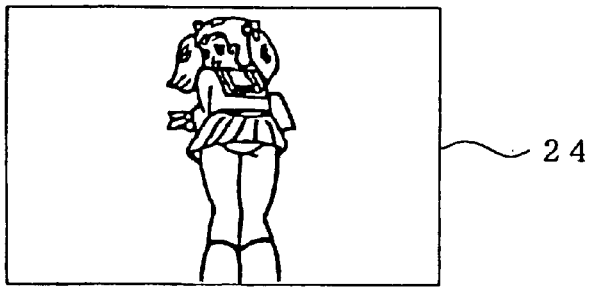
Figure 102A:
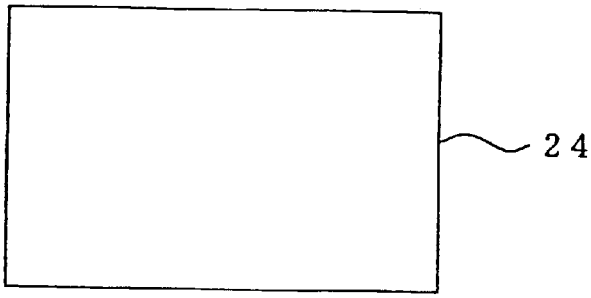
FIGS. 102A to 102E are views showing a tenth connective display mode to be informed to the player by the connective staging means in the game process of the slot machine according to the third modification of the second embodiment.
Figure 102B:
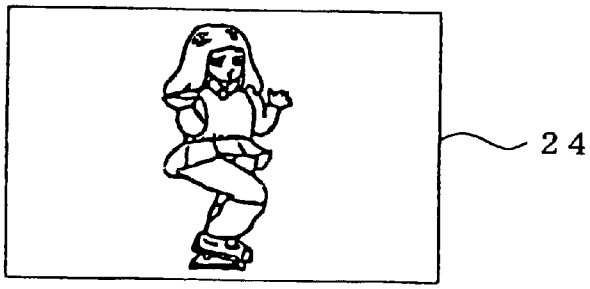
Figure 102C:
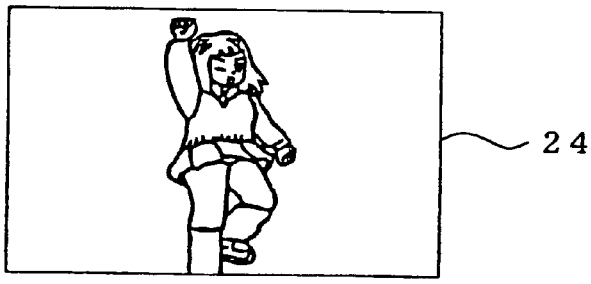
Figure 102D:
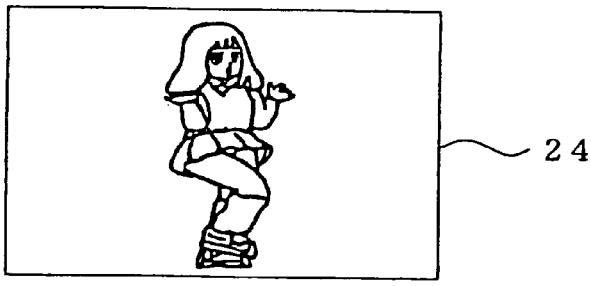
Figure 102E:
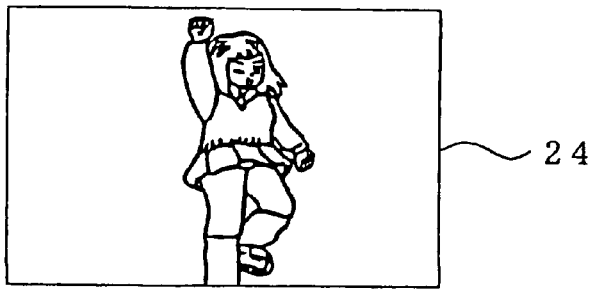

In case the reel lamp flashing pattern is selected as the "flashing pattern 9" by the information selecting lottery operation using the demonstration lottery table, the stop staging means display nothing in the liquid crystal display unit 24, as shown in FIG. 82A, when all the individual reels 3 to 5 are stopped. Successively. on the left of the liquid crystal display unit 24, as shown in FIG. 82B, there is displayed the position of the second character "Yumichan" having a right foot raised slightly and two palms directed upward. Next, the position of the character "Yumichan" having a left leg raised slightly while having a right hand raised highly and holding a left hand down is displayed at the left-hand center of the liquid crystal display unit 24, as shown in FIG. 82C. Next, the position of the character "Yumichan" having a right hand raised slightly and two palms directed upward is displayed at right-hand center of the liquid crystal display unit 24, as shown in FIG. 82D. Finally, the position of the character "Yumichan" having a left leg raised slightly and a right hand raised highly while holding her left-hand down is displayed on the right of the liquid crystal display unit 24, as shown in FIG. 82E.

In place of the ten kinds of the individual reel lamp flashing patterns (as should be referred to FIGS. 40 to 53) in the aforementioned second embodiment, furthermore, the ten kinds of stop display modes may be predicted and informed by staging them with the ten kinds of operation patterns 1 to 10 of the characters appearing in the liquid crystal display unit 24, as shown in FIGS. 83 to 92.

FIGS. 83 to 92 correspond to FIGS. 73 to 82, respectively, and accordingly to the no reel lamp flashing to the reel lamp flashing pattern 9 in the second embodiment, respectively. In the aforementioned operation patterns 1 to 10 shown in FIGS. 73 to 82, only one character is displayed in the liquid crystal display unit 24 after all the individual reels 3 to 5 were stopped. In the operation patterns 1 to 10 shown in FIGS. 83 to 92, the character displayed in the liquid crystal display un it 24 increases in the order of one, two and three as the time elapses.

In place of the ten kinds of the individual reel lamp flashing patterns (as should be referred to FIGS. 40 to 53) in the aforementioned second embodiment, furthermore, the ten kinds of stop display modes may be predicted and informed by staging them with the ten kinds of operation patterns 1 to 10 of the characters appearing in the liquid crystal display unit 24. as shown in FIGS. 93 to 102.

FIGS. 93 to 102 also correspond to FIGS. 73 to 82, respectively, and accordingly to the no reel lamp flashing to the reel lamp flashing pattern 9 in the second embodiment, respectively. In the aforementioned operation patterns 1 to 10 shown in FIGS. 73 to 82, one character is displayed in a moving manner sequentially at the individual left, center and right positions of the liquid crystal display unit 24 after all the individual reels 3 to 5 were stopped. In the operation patterns 1 to 10 shown in FIGS. 93 to 102, however, one character of the individual positions is displayed at the same center position of the liquid crystal display unit 24.

Operations and effects similar to those of the second embodiment can also be achieved even if these three ways of the ten kinds of individual stop display modes shown in FIGS. 73 to 102 are staged and displayed in the liquid crystal display unit 24 after all the individual reels 3 to 5 were stopped.

In the individual embodiments thus far described, furthermore, the informing means is constituted to include: the sound emitting means for generating one of a plurality of effective sounds when the variable display of the individual reels 3 to 5 is started by the variable display starting means (or the start lever 15); the connective staging means for staging the variable display of the individual column in one of a plurality of display modes in connection with the stop of the variable display of the individual columns by the variable display stop means (or the stop buttons 16 to 18); and the stop staging means for staging the variable display device (or the reels 3 to 5) in one of the plurality of display modes when all the variable display of the individual columns is stopped.

However, this information means may be constituted to include the sound emitting means and the connective staging means exclusively. Alternatively, the information means may also be constituted to include the sound emitting means and the stop staging means exclusively. Furthermore, the information means may also be constituted to include the connective staging means and the stop staging means exclusively.

Even if the information means is constituted to have any of the constructions, operations and effects similar to those of the aforementioned individual embodiments can be achieved by preparing such a number of combinations for staging the individual components as can satisfy the kinds of necessary information.

In the fore going individual embodiments, furthermore, the connective staging means controls to flash the individual back lamps 57 of the individual reels 3 to 5 in connection with the individual operations of the stop buttons 16 to 18 thereby to stage the selected connective display mode. When any of the stop buttons 16 to 18, e.g., one of the stop buttons 16 to 18 either selected at random or fixed is operated, however, the connective display modes may be sequentially staged irrespective of the operations of the remaining stop buttons. When the first stop button 16 is operated, for example, the individual back lamps 57*a* to 57*c* of the individual stop reels 3 to 5 are controlled to flash irrespective of the operations of the second stop button 17 and the third stop button 18, thereby to stage the second connection display mode sequentially, as shown in FIGS. 9A to 9D.

Like this, furthermore, the connective display modes may be staged in connection with any two stop buttons either selected at random or fixed. In case the fourth connective display mode shown in FIGS. 11A to 11D is selected as the connective display mode, for example, the back lamps 57 of the first reel 3, as shown in FIG. 11B, of the individual back lamps 57 of the individual reels 3 to 5, as lighting during rotation as shown in FIG. 11A, are extinguished when the first stop button 16 is operated. When the second stop button 17 is operated, furthermore, the back lamps 57*a* to 57*c* of the second reel 4 and the third reel 5 are sequentially extinguished, as shown in FIGS. 11A to 11D, irrespective of the operation of the third stop button 18.

Although an explanation has been given of the case in which the game machine according to the invention is applied to a slot machine in the embodiments thus far described, furthermore, the invention should not be limited thereto but can be applied, for example, to a pinball game machine such as a parching machine or amusement machines having variable display devices. Some game machine is not provided with buttons for stopping the variable display so that the individual variable display portions are successively stopped automatically for each variable display column. In this case, too, effects similar to those of the foregoing embodiments can be achieved if the prize mode informing means is operated at the timing in which the individual variable display columns are automatically stopped.

When the invention is applied to the parching machine, the flow of the game such as the operation of the start lever, sampling of a random number for determining a prize mode and starting to rotate the reels in the slot machines of the foregoing individual embodiments, is replaced by the flow of the game such as the insertion of parching balls into a specific prize slot, sampling of a random number for determining a prize mode and starting to rotate the slot machine reels integrated into the pachinko machine. Furthermore, the operation of paying out coins, which is carried out when the patterns of the reels are stopped and displayed to constitute a specific mode in the slot machines of the foregoing individual embodiments, is replaced by rewarding a special prize in the pachinko game as in providing a large number of balls to the player by opening a variable prize device of an attacker or tulip in the pachinko machine.

Although the present invention has been explained in reference to the embodiments, it is apparent for those skilled in the art that many changes and modifications can be made without departing from the spirit and scope of the invention, as clear from the following claims.

What is claimed is:

1. A game machine comprising:

prize mode determining means which determines a prize mode of a game with reference to a probability table comprising data for classifying a drawing random number into an individual prize mode, and which erects a hit flag of a prize mode to which the drawing random number belongs;

a variable display device for displaying various patterns variably in a plurality of columns and for displaying a combination of the patterns statically in said individual columns in accordance with the prize mode which is determined by said prize mode determining means;

variable display starting means for starting a variable display of said variable display device;

variable display stopping means for stopping said variable display for the individual columns; and information means for informing a player of a kind of a hit flag of a prize mode determined by a random number lottery with reference to an informing determination table, which is different from said probability table, for determining the prize mode to be informed, at a predetermined probability determined by the random number lottery with reference to the informing determination table, in a series of flow of the game in which said variable display is started by said variable display starting means and is ended by said variable display stopping means.

2. A game machine according to claim 1, wherein said information means informs a player of the kind of hit flag of the prize mode to be informed, the hit flag being different from the hit flag erected by said prize mode determining means, at a predetermined probability determined by the random number lottery with reference to the table, in a series of flow of the informing determination game in which said variable display is started by said variable display starting means and is ended by said variable display stopping means.

3. A game machine according to claim 1, wherein said information means comprises: sound emitting means for generating one of a plurality of effective sounds when said variable display is started by said variable display starting means; connective staging means for staging a variable display of at least one column in one of a plurality of display modes in connection with the stop of said variable display of at least one column by said variable display stopping means; and information mode selecting means for selecting the combination of the kinds of the effective sounds, which are generated by said sound emitting means, and the kinds of the connective display modes, which are staged by said connective staging means, in accordance with the prize mode which is determined by said information means.

4. A game machine according to claim 1, wherein said information means comprises: sound emitting means for generating one of a plurality of effective sounds when said variable display is started by said variable display starting means; stop staging means for staging the display of said variable display device in one of a plurality of display modes when all of said variable displays of the individual columns are stopped;

and information mode selecting means for selecting the combination of the kinds of the effective sounds, which are generated by said sound emitting means, and the kinds of the stop display modes, which are staged by said stop staging means, in accordance with the prize mode which is determined by said information means.

5. A game machine according to claim 1, wherein said information means comprises: connective staging means for staging a variable display of at least one column in one of a plurality of display modes in connection with the stop of said variable display of at least one column by said variable display stopping means; stop staging means for staging the display of said variable display device in one of a plurality of display modes when all of said variable displays of the individual columns are stopped; and information mode selecting means for selecting the combination of the kinds of the connective display modes, which are staged by said connective staging means, and the kinds of the stop display modes, which are staged by said stop staging means, in accordance with the prize mode which is determined by said information means.

6. A game machine according to claim 1, wherein said information means comprises: sound emitting means for generating one of a plurality of effective sounds when said variable display is started by said variable display starting means; connective staging means for staging a variable display of at least one column in one of a plurality of display modes in connection with the stop of said variable display of at least one column by said variable display stopping means; stop staging means for staging the display of said variable display device in one of a plurality of display modes when all of said variable displays of the individual columns are stopped; and information mode selecting means for selecting the combination of the kinds of the effective sounds, which are generated by said sound emitting means, the kinds of the connective display modes, which are staged by said connective staging means, and the kinds of the stop staging modes, which are staged by said stop staging means, in accordance with the prize mode which is determined by said information means.

7. A game machine according to any of claims 3 to 6, wherein said game machine is a slot machine.

8. A game machine according to claim 6, wherein said connective staging means stages said variable displays of the individual columns sequentially in one of said plurality of display modes in connection with the stop of said variable displays of the individual columns by said variable display stopping means.

9. A game machine according to claim 8, wherein said sound emitting means generates an effective sound of a predetermined kind or duration each time said displays of the individual columns are staged by said connective staging means.

10. A game machine according to claim 6, wherein the information determination table which is used by said information means for determining the prize mode to be informed is an information selecting lottery probability table comprising data for classifying the drawing random number into individual prize mode to be informed, and said information mode selecting means selects a staging mode combination in accordance with the prize mode to be informed, with reference to a staging mode combination table.

11. A game machine according to claim 6, wherein said information mode selecting means selects a demonstration lottery table which comprises the informing determination table used by said information means for determining the prize mode to be informed in accordance with a game state and a prize mode determined by said prize mode determining means with reference to a demonstration lottery table selecting table comprising data for classifying a combination of the game state and the prize mode into individual demonstration lottery tables, and further wherein said information mode selecting means selects a staging mode combination in accordance with the drawing random number with reference to the selected demonstration lottery table.

12. A game machine according to claim 10 or 11, wherein said prize mode determining means includes: random number generating means for generating a random number within a predetermined range; random number sampling means for sampling an arbitrary one from the random numbers which are generated by said random number generating means; and random number classifying means for classifying the random number, which is sampled by said random number sampling means, into individual prize modes.

13. A game machine according to claim 6, further comprising:

notification means for notifying the player, in conjunction with said information means, about the kind of the hit flag of a specific prize mode determined by said information means, in a predetermined information mode on condition that the specific prize mode to be informed is determined by said information means.

14. A game machine according to claim 13, wherein said notification means notifies the player of the kind of the hit flag of a specific prize mode, in a predetermined information mode on condition that the specific prize mode to be informed to the player at a probability of 100% is determined by said information means.

15. A game machine according to claim 13, wherein said notification means notifies the player of the kind of the hit flag by display of a display device.

16. A game machine according to claim 15, wherein said notification means continues to notify the player through said display device until the end of the game of the specific prize mode.

17. A game machine according to claim 13, wherein said notification means is realized by the predetermined information mode by said information means.

18. A game machine according to claim 13, wherein said specific prize mode is a big or medium hit inner prize mode.

19. A game machine according to claim 6, wherein said variable display stopping means includes a plurality of stop buttons provided to correspond to said individual variable display columns, and wherein said connective staging means stages said variable displays of the individual columns in connection with the operations of said stop buttons.

20. A game machine according to claim 19, wherein said stop buttons are tactile sense type buttons which vibrate a player's fingertip, when operated, in a predetermined mode each time said displays of the individual columns are staged by said connective staging means.

21. A game machine according to claim 19 or 20, wherein said variable display device comprises:

a plurality of rotary reels having various patterns illustrated on their outer circumferences; and a plurality of light sources provided for the individual rotary reels for illuminating the patterns from the rear, wherein said patterns are stopped and displayed by said individual rotary reels, wherein said connective staging means stages said displays of the individual columns by controlling the lighting of said individual light sources for the individual rotary reels in connection with the individual operations of said individual stop buttons, and wherein said stop staging means stages the display of said variable display device by controlling the lighting of said individual light sources of the rotary reels when all said variable displays of the individual columns are stopped.

22. A game machine according to claim 6, wherein said variable display stopping means stops said variable displays automatically for the individual columns, and wherein said connective staging means stages said displays of the individual columns in connection with the automatic stops of said variable displays for the individual columns by said variable display stopping means.

23. A game machine according to claim 22, wherein said variable display device comprises:

a plurality of rotary reels having various patterns illustrated on their outer circumferences; and a plurality of light sources provided for the individual rotary reels for illuminating the patterns from the rear, wherein said patterns are stopped and displayed by said individual rotary reels, wherein said connective staging means stages said displays of the individual columns by controlling the lighting of said individual light sources for the individual rotary reels in connection with the automatic stops of said variable displays for the individual columns by said variable display stopping means, and wherein said stop staging means stages the display of said variable display device by controlling the lighting of said individual light sources of the rotary reels when all said variable displays of the individual columns are stopped.

24. A game machine according to claim 1, wherein said variable display stopping means comprises:

a plurality of stop buttons provided with said individual variable display columns, and wherein said variable display stopping means stops said variable display for the individual columns corresponding to an operation timing of a stop button, and further wherein said variable display stopping means controls the display of the combination of the patterns statically on an effective prize line of said variable display device in accordance with the prize mode, such that when the stop button is not operated at the operation timing, the combination of the patterns corresponding to the hit flag is not displayed on the effective prize line.

* * * * *